US009868290B2

(12) United States Patent
Matsuda et al.

(10) Patent No.: US 9,868,290 B2
(45) Date of Patent: Jan. 16, 2018

(54) LIQUID CONTAINER, LIQUID SUPPLY DEVICE AND LIQUID JET SYSTEM

(71) Applicant: SEIKO EPSON CORPORATION, Tokyo (JP)

(72) Inventors: Takanori Matsuda, Shiojiri (JP); Shoma Kudo, Shiojiri (JP); Hidenao Suzuki, Matsumoto (JP); Naomi Kimura, Okaya (JP); Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/165,409

(22) Filed: May 26, 2016

(65) Prior Publication Data

US 2016/0347075 A1 Dec. 1, 2016

(30) Foreign Application Priority Data

May 29, 2015 (JP) ..... 2015-109536

(51) Int. Cl.
*B41J 2/175* (2006.01)
*B41J 29/13* (2006.01)

(52) U.S. Cl.
CPC ..... *B41J 2/17509* (2013.01); *B41J 2/1752* (2013.01); *B41J 2/17513* (2013.01); *B41J 2/17553* (2013.01); *B41J 29/13* (2013.01)

(58) Field of Classification Search
None
See application file for complete search history.

(56) References Cited

U.S. PATENT DOCUMENTS

| | | | | |
|---|---|---|---|---|
| 7,188,940 | B2 * | 3/2007 | Feliciano | B41J 2/17513 347/87 |
| 8,678,567 | B2 | 3/2014 | Shimizu et al. | |
| 8,926,073 | B2 | 1/2015 | Shimizu et al. | |
| 9,290,001 | B2 * | 3/2016 | Kudo | B41J 2/175 |
| 2005/0041077 | A1 * | 2/2005 | Lee | B41J 2/17513 347/86 |
| 2006/0181584 | A1 * | 8/2006 | Nip | B41J 2/17556 347/86 |

FOREIGN PATENT DOCUMENTS

JP 2012-020495 A 2/2012

* cited by examiner

*Primary Examiner* — An Do
*Assistant Examiner* — Renee I Wilson
(74) *Attorney, Agent, or Firm* — Foley & Lardner LLP

(57) ABSTRACT

With a conventional liquid container, it is difficult to reduce the possibility of soiling with liquid caused by liquid leakage. Provided is a liquid container including a liquid containing portion containing liquid, a liquid inlet portion receiving injection of the liquid into the liquid containing portion, an open air port that communicates with the liquid containing portion and is introducing the atmospheric air into the liquid containing portion, and a liquid absorbent material that is arranged at least in a portion of the periphery of the open air port and that is absorbing the liquid.

10 Claims, 37 Drawing Sheets

LIQUID CONTAINER, LIQUID SUPPLY DEVICE AND LIQUID JET SYSTEM

CROSS REFERENCE TO RELATED APPLICATION

This application claims priority to Japanese Patent Application No. 2015-109536 filed on May 29, 2015, the entire contents of this application are incorporated by reference herein.

BACKGROUND

1. Technical Field

The present invention relates to a liquid container, a liquid supply device, a liquid jet system and the like.

2. Related Art

As an example of a liquid jet device, inkjet printers are conventionally known. Inkjet printers can perform printing on a printing medium such as printing paper by ejecting ink, which is an example of liquid, from a jet head onto the printing medium. Conventionally, regarding such inkjet printers, configurations for supplying ink stored in a tank, which is an example of a liquid container, to the jet head are known. Such a tank is provided with an ink inlet port. A user can replenish ink in the tank through the ink inlet port. Regarding such a tank, a configuration in which a liquid containing chamber that contains ink and an air containing chamber into which air is introduced communicate with each other via a communication portion is conventionally known (for example, refer to JP-A-2012-20495). Note that in the following description, a configuration to which a liquid supply device that supplies ink to a liquid jet device such as an inkjet printer is added may be called a liquid jet system.

SUMMARY

With the tank described in JP-A-2012-20495 above, for example, even if ink in the liquid containing chamber flows out to the air containing chamber side via the communication portion, the ink that flowed out to the air containing chamber side can be stored in the air containing chamber. In such a tank, an open air port is formed to be near the upper surface portion of the air containing chamber in a use orientation. Therefore, with this tank, the ink in the liquid containing chamber is easily prevented from leaking out of the tank via the open air port. However, if the inkjet printer vibrates or rocks in the state in which the ink has flowed into the air containing chamber, the ink that flowed into the air containing chamber easily reaches the open air port. As a result, it is conceivable that the ink in the liquid containing chamber leaks out of the tank via the open air port. If the ink leaks out of the tank, the inkjet printer may be soiled with ink, or an operator working on the inkjet printer may get soiled with ink. Thus, in conventional liquid containing bodies, there is a problem in that it is difficult to reduce the possibility of soiling caused by the liquid leakage.

The invention has been made in order to solve at least the foregoing issue, and can be achieved as the following modes or application examples.

APPLICATION EXAMPLE 1

A liquid container includes a liquid containing portion containing a liquid, a liquid inlet portion receiving injection of the liquid into the liquid containing portion, an open air port that communicates with the liquid containing portion and is introducing atmospheric air into the liquid containing portion, and a liquid absorbent material that is arranged at least in a portion of a periphery of the open air port and is absorbing the liquid.

In this liquid container, the liquid absorbent material is arranged at least in a portion of the periphery of the open air port, and thus even if the liquid leaks out from the open air port, the leaked liquid can be absorbed by the liquid absorbent material. Therefore, it is possible to suppress the possibility of soiling caused by the liquid leakage to a low level.

APPLICATION EXAMPLE 2

In the above-described liquid container, the liquid absorbent material covers the open air port, and an opening portion that is open to atmospheric air is formed in the liquid absorbent material.

In this liquid container, the liquid absorbent material covers the open air port, and thus even if the liquid leaks out from the open air port, it is easy for the liquid absorbent material to reliably absorb the leaked liquid. Accordingly, it is possible to further suppress the possibility of soiling caused by the liquid leakage to a low level. In addition, in this liquid container, the opening portion is formed in the liquid absorbent material, and thus the open air port is easily opened to the atmospheric air.

APPLICATION EXAMPLE 3

In the above-described liquid container, assuming that an orientation when the liquid container is being used is a use orientation of the liquid container, the opening portion is positioned vertically below the open air port in the use orientation.

In this liquid container, in the use orientation of the liquid container, the opening portion of the liquid containing portion is positioned vertically below the open air port. Therefore, for example, in the case where the liquid container adopts an inverted orientation that is inverted from the use orientation, the opening portion of the liquid absorbent material is positioned vertically above the open air port. Accordingly, in the inverted orientation, even if the liquid leaks out from the open air port, the leaked liquid does not easily reach the opening portion of the liquid absorbent material. As a result, in the inverted orientation, even if the liquid leaks out from the open air port, it is possible to suppress the possibility of soiling caused by the liquid leakage to a low level.

APPLICATION EXAMPLE 4

In the above-described liquid container, the liquid absorbent material includes a first portion positioned in a periphery of the open air port and a second portion facing the open air port.

In this liquid container, liquid that leaks out to the periphery of the open air port and in a direction facing the open air port is easily absorbed by the absorbent material.

APPLICATION EXAMPLE 5 in the above-described liquid container, the first portion is separated from the second portion each other.

In this liquid container, the liquid absorbent material can be constituted by a plurality of members.

APPLICATION EXAMPLE 6

The above-described liquid container includes a positioning member for determining a position of the liquid absorbent material.

In this liquid container, the position of the liquid absorbent material is easily determined by the positioning member, and thus it is possible to easily manufacture the liquid container.

APPLICATION EXAMPLE 7

The above-described liquid container includes an absorbent material housing part housing the liquid absorbent material.

In this liquid container, the liquid absorbent material is easily protected by the absorbent material housing part.

APPLICATION EXAMPLE 8

A liquid jet system includes a liquid jet head jetting a liquid, a liquid container containing the liquid that is supplied to the liquid jet head, a supply tube constituting at least a portion of a supply path supplying the liquid from the liquid container to the liquid jet head, and a liquid absorbent material arranged within a liquid container mounting part to which the liquid container is mounted, wherein the liquid container includes a liquid containing portion containing the liquid, a liquid inlet portion receiving injection of the liquid into the liquid containing portion, and an open air port that communicates with the liquid containing portion and is introducing atmospheric air into the liquid containing portion, and assuming that an orientation when the liquid container is being used is a use orientation of the liquid container, the liquid absorbent material is positioned at least at a height of the open air port in the use orientation.

In this liquid jet system, in the use orientation of the liquid container, the liquid absorbent material is positioned at least at the height of the open air port. Therefore, even if liquid leaks out from the open air port, the leaked liquid is easily absorbed by the liquid absorbent material. Accordingly, it is possible to suppress the possibility of soiling caused by the liquid leakage to a low level.

APPLICATION EXAMPLE 9

The above-described liquid jet system includes a positioning part for determining a position of the liquid absorbent material within the liquid container mounting part.

In this liquid jet system, the position of the liquid absorbent material is easily determined by the positioning part, and thus it is possible to prevent the position of the liquid absorbent material from being easily displaced.

APPLICATION EXAMPLE 10

In the above-described liquid jet system, the positioning part is provided on the liquid container.

In this liquid jet system, the position of the liquid absorbent material can be determined by the positioning part provided on the liquid container.

APPLICATION EXAMPLE 11

The above-described liquid jet system includes a second liquid absorbent material above the liquid container in the use orientation.

In this liquid jet system, the second liquid absorbent material is above the liquid container in the use orientation. Therefore, for example, in the case where the liquid container adopts an inverted orientation that is an orientation inverted from the use orientation, even if liquid leaks out from the open air port, the leaked liquid is easily caught by the second liquid absorbent material. As a result, in the inverted orientation, even if the liquid leaks out from the open air port, it is possible to suppress the possibility of soiling caused by the liquid leakage to a low level.

APPLICATION EXAMPLE 12

The above-described liquid jet system includes a second positioning part for determining a position of the second liquid absorbent material.

In this liquid jet system, the position of the second liquid absorbent material is easily determined by the second positioning part, and thus it is possible to prevent the position of the second liquid absorbent material from being easily displaced.

APPLICATION EXAMPLE 13

In the above-described liquid jet system, the second positioning part is provided on the liquid container.

In this liquid jet system, the position of the second liquid absorbent material can be determined by the second positioning part provided on the liquid container.

APPLICATION EXAMPLE 14

A liquid supply device supplying a liquid to a liquid jet head jetting the liquid includes a liquid container containing the liquid and a casing that covers the liquid container, wherein the liquid container includes a liquid containing portion containing the liquid, a liquid inlet portion receiving injection of injecting the liquid into the liquid containing portion, and an open air port that communicates with the liquid containing portion and is introducing atmospheric air into the liquid containing portion, and assuming that an orientation when the liquid container is being used is a use orientation of the liquid container, a liquid holding portion holding the liquid is provided in a portion of the casing that faces the liquid container vertically above the liquid container in the use orientation.

In this liquid supply device, for example, even if the liquid that leaked from the liquid container adheres to the casing, the adhered liquid can be held by the liquid holding portion. Accordingly, it is possible to suppress the possibility of soiling caused by the liquid leakage to a low level.

APPLICATION EXAMPLE 15

In the above-described liquid supply device, the liquid holding portion is constituted by a groove formed in the casing, a recessed portion formed in the casing, or a liquid absorbent material absorbing the liquid.

In this liquid supply device, the liquid can be held by the liquid holding portion constituted by the groove formed in the casing, the recessed portion formed in the casing, or the liquid absorbent material capable of absorbing the liquid.

APPLICATION EXAMPLE 16

In the above-described liquid supply device, a guiding path that guides the liquid to the liquid holding portion constituted by the liquid absorbent material is formed in the casing.

In this liquid supply device, liquid adhering to the casing is easily guided to the liquid holding portion by the guiding path formed in the casing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
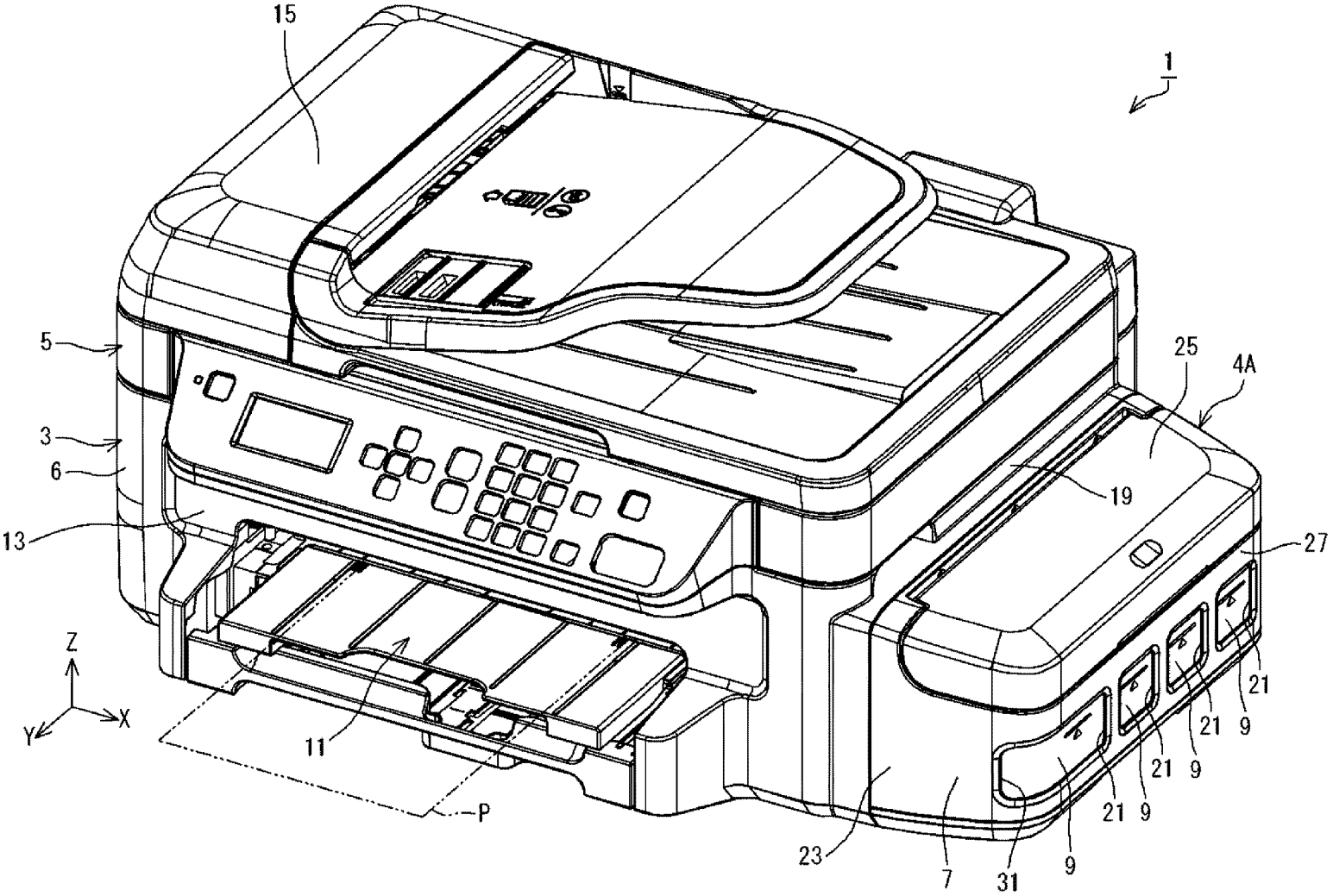
FIG. 1 is a perspective view showing a main configuration of a liquid jet system in an embodiment.

Embodiments will be described with reference to the drawings, taking, as an example, a liquid jet system that includes an inkjet printer (hereinafter, referred to as a printer), which is an example of a liquid jet device. Note that in the drawings, some constituent elements and members are illustrated with a different scale so as to have a size that allows the configuration of respective constituent elements and members to be recognized.

A liquid jet system 1 in this embodiment has a printer 3, which is an example of the liquid jet device, an ink supply device 4A, which is an example of a liquid supply device, and a scanner unit 5, as shown in FIG. 1. The printer 3 has a casing 6. The casing 6 constitutes the outer shell of the printer 3. The ink supply device 4A has a casing 7, which is an example of a liquid container mounting part, and a plurality of (two or more) tanks 9. The casing 6, the casing 7 and the scanner unit 5 constitute the outer shell of the liquid jet system 1. The tank 9 is an example of a liquid container. The liquid jet system 1 can perform printing on a recording medium P such as recording paper using ink, which is an example of liquid.

Note that in FIG. 1, X, Y and Z axes that are coordinate axes orthogonal to one another are given. In the figures after FIG. 1 as well, X, Y and Z axes are given as necessary. In this embodiment, a state in which the liquid jet system 1 is arranged in the horizontal plane (XY plane) that is defined by the X axis and the Y axis is a use state of the liquid jet system 1. The orientation of the liquid jet system 1 when the liquid jet system 1 is arranged on the XY plane is referred to as a use orientation of the liquid jet system 1. The Z axis is an axis orthogonal to the horizontal plane. In the use state of the liquid jet system 1, a Z axis direction is a vertically upward direction. In addition, in the use state of the liquid jet system 1, in FIG. 1, a −Z axis direction is a vertically downward direction. Note that regarding each of the X, Y and Z axes, the direction of the arrow indicates a +(positive) direction, and a direction opposite to the direction of the arrow indicates a −(negative) direction.

In the liquid jet system 1, the printer 3 and the scanner unit 5 are stacked. In the state in which the printer 3 is used, the scanner unit 5 is positioned vertically above the printer 3. The scanner unit 5 is of a flat bed type, and has an imaging element (not illustrated) such as an image sensor. The scanner unit 5 can read, as image data, an image recorded on a medium such as paper or the like via the imaging element. Therefore, the scanner unit 5 functions as a device for reading images or the like. The scanner unit 5 is constituted to be able to rotate with respect to the printer 3. The scanner unit 5 also has a function as a lid of the printer 3. An operator can rotate the scanner unit 5 with respect to the printer 3 by lifting the scanner unit 5 up in the Z axis direction. Accordingly, it is possible to expose the printer 3 using the scanner unit 5 that functions as the lid of the printer 3.

The printer 3 is provided with a paper discharge part 11. In the printer 3, the recording medium P is discharged from the paper discharge part 11. In the printer 3, a surface on which the paper discharge part 11 is provided is assumed to be a front surface 13. In addition, the liquid jet system 1 has an upper surface 15 intersecting the front surface 13 and a side portion 19 intersecting the front surface 13 and the upper surface 15. The ink supply device 4A is provided on the side portion 19. The casing 7 is provided with windows 21. The windows 21 are provided on a side portion 27 intersecting a front surface 23 and an upper surface 25 in the casing 7.

The windows 21 have optical transparency. Four tanks 9 that are described above are provided at the positions at which the tanks 9 and the windows 21 overlap each other. Therefore, an operator that uses the liquid jet system 1 can visually recognize the four tanks 9 through the windows 21. In this embodiment, the windows 21 are provided as an opening formed in the casing 7. The operator can visually recognize the four tanks 9 via the windows 21, which are the openings. Note that the windows 21 are not limited to an opening, and may be constituted by a member having optical transparency, for example.

In this embodiment, at least a portion of a region of each of the tanks 9 that faces the window 21 has optical transparency. Ink in the tanks 9 can be visually recognized through the site of each of the tanks 9 that has optical transparency. Therefore, the operator can visually recognize the amount of ink in each of the tanks 9 by viewing the four tanks 9 via the windows 21. In other words, at least the portion of the site of each of the tanks 9 that faces the windows 21 can be used as a visual recognition portion that enables visual recognition of the amount of ink.

Figure 2:
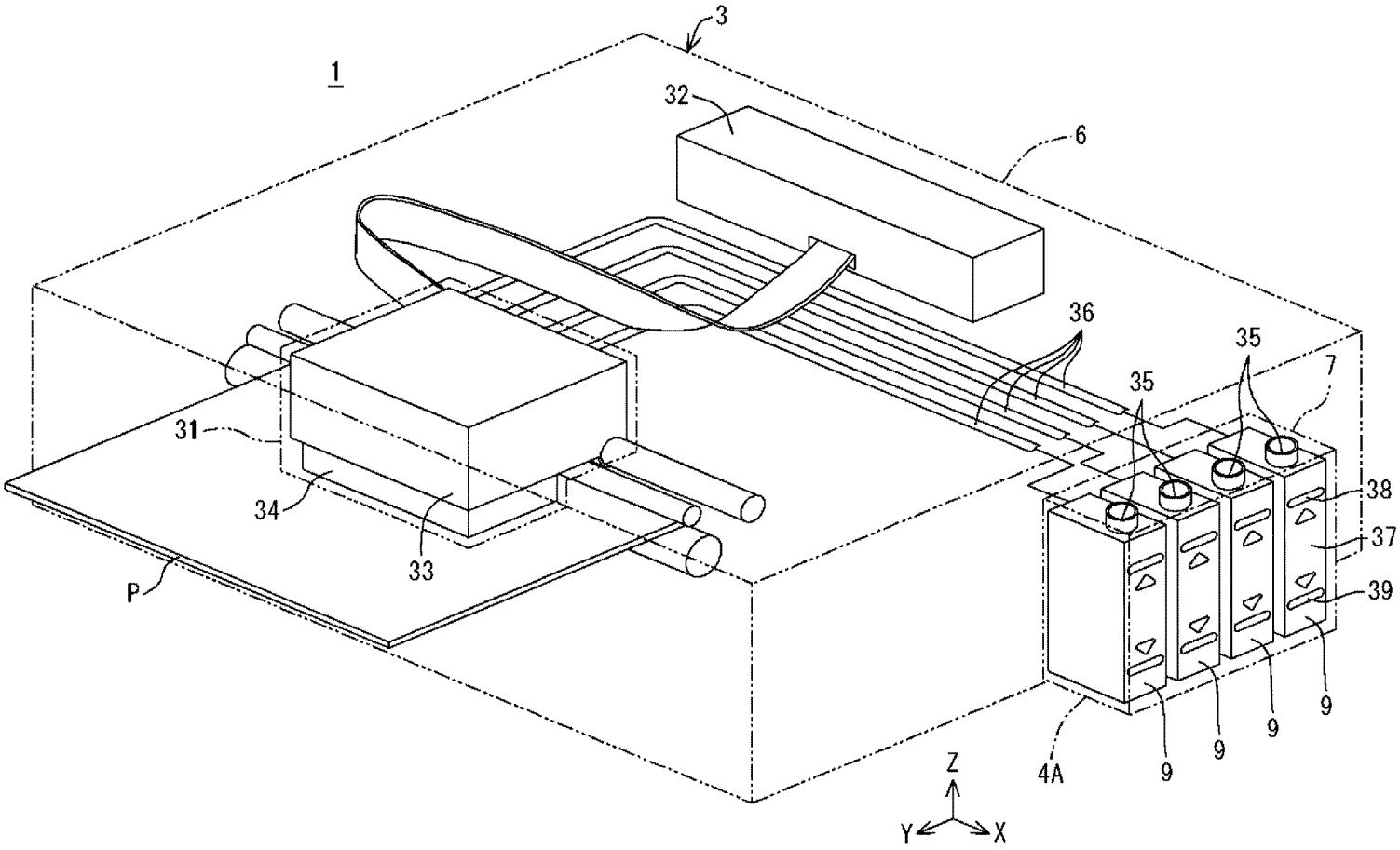
FIG. 2 is a perspective view showing the main configuration of the liquid jet system in the embodiment.

The printer 3 has a recorder 31 and a controller 32 as shown in FIG. 2. In the printer 3, the recorder 31 and the controller 32 are housed in the casing 6. The recorder 31 performs recording using ink, which is an example of liquid, on the recording medium P conveyed by a conveyance device (not illustrated) in the Y axis direction. Note that the conveyance device that is not illustrated intermittently conveys the recording medium P such as recording paper in the Y axis direction. The recorder 31 is constituted to be reciprocally movable along the X axis by a movement device (not illustrated). The ink supply device 4A supplies the ink to the recorder 31. The controller 32 controls the driving of each of the above-described constituent elements. Note that in the liquid jet system 1, at least a portion of the ink supply device 4A protrudes outside of the casing 6. Note that the recorder 31 is housed in the casing 6. Accordingly, the recorder 31 can be protected by the casing 6.

Here, a direction along the X axis is not limited to the direction perfectly parallel to the X axis, and includes directions inclined due to error, tolerance or the like except for the direction orthogonal to the X axis. Similarly, a direction along the Y axis is not limited to the direction perfectly parallel to the Y axis, and includes directions inclined due to error, tolerance or the like except for the direction orthogonal to the Y axis. A direction along the Z axis is not limited to the direction perfectly parallel to the Z axis, and includes directions inclined due to error, tolerance or the like except for the direction orthogonal to the Z axis. In other words, directions along any axes or planes are not limited to directions perfectly parallel to these axes or planes, and include directions inclined due to error, tolerance or the like except for the directions orthogonal to these axes or planes.

The recorder 31 is provided with a carriage 33 and a recording head 34. The recording head 34 is an example of a liquid jet head, and performs recording on the recording medium P by ejecting ink as ink droplets. The carriage 33 is equipped with the recording head 34. Note that the recording head 34 is electrically connected to the controller 32. Ejection of ink droplets from the recording head 34 is controlled by the controller 32.

The ink supply device 4A has a tank 9, which is an example of the liquid container. In this embodiment, the ink supply device 4A has a plurality of (in this embodiment, four) tanks 9. The plurality of tanks 9 protrude outside the casing 6 of the printer 3. The plurality of tanks 9 are housed inside the casing 7. Accordingly, the tanks 9 can be protected by the casing 7. The casing 7 protrudes from the casing 6.

Note that in this embodiment, the ink supply device 4A has a plurality of (four) tanks 9. However, the number of the tanks 9 is not limited to four, and three or less tanks 9 and four or more tanks 9 can be adopted.

Furthermore, in this embodiment, the tanks 9 are constituted separately from one another. However, the configuration of the tanks 9, which are examples of the liquid container, is not limited thereto. As the configuration of the liquid container, a configuration in which a plurality of tanks 9 are integrated and are used as one liquid container can be adopted. In this case, the one liquid container is provided with a plurality of liquid containing portions. The liquid containing portions are individually separated from one another, and are constituted to be able to contain different types of liquid. In this case, for example, the liquid containing portions can individually contain different colors of ink.

Ink, which is an example of a liquid, is stored in the tank 9. A liquid inlet portion 35 is formed on the tank 9. In the tank 9, ink can be injected from outside of the tank 9 into the tank 9 via the liquid inlet portion 35. Note that the operator can access the liquid inlet portion 35 of the tank 9 from outside of the casing 7. In addition, the liquid inlet portion 35 is sealed by a cap (not illustrated). When injecting the ink into the tank 9, the ink is injected after opening the liquid inlet portion 35 by opening the cap.

An ink supply tube 36 is connected to each of the tanks 9. The ink supply tube 36 is an example of a supply tube. Ink in the tanks 9 is supplied from the ink supply device 4A to the recording head 34 via the ink supply tubes 36. The ink supplied to the recording head 34 is then ejected as ink droplets from a nozzle (not illustrated) directed to a recording medium P side. Note that the above-described example was described assuming that the printer 3 and the ink supply device 4A have separate configurations, but the ink supply device 4A can be included in the configuration of the printer 3.

Note that as the tanks 9, a configuration in which an upper limit mark 38, a lower limit mark 39 and the like are added to a visual recognition surface 37 that enables visual recognition of the amount of ink stored in the tank 9 can also be adopted. The operator can recognize the amount of ink in the tank 9 using the upper limit mark 38 and the lower limit mark 39 as markers. Note that the upper limit mark 38 is an ink amount guide for preventing the ink from overflowing from the liquid inlet portion 35, when injecting the ink from the liquid inlet portion 35. Also, the lower limit mark 39 is an ink amount guide for prompting ink inlet. A configuration in which at least the upper limit mark 38 or the lower limit mark 39 is provided on the tank 9 can also be adopted.

Figure 3:
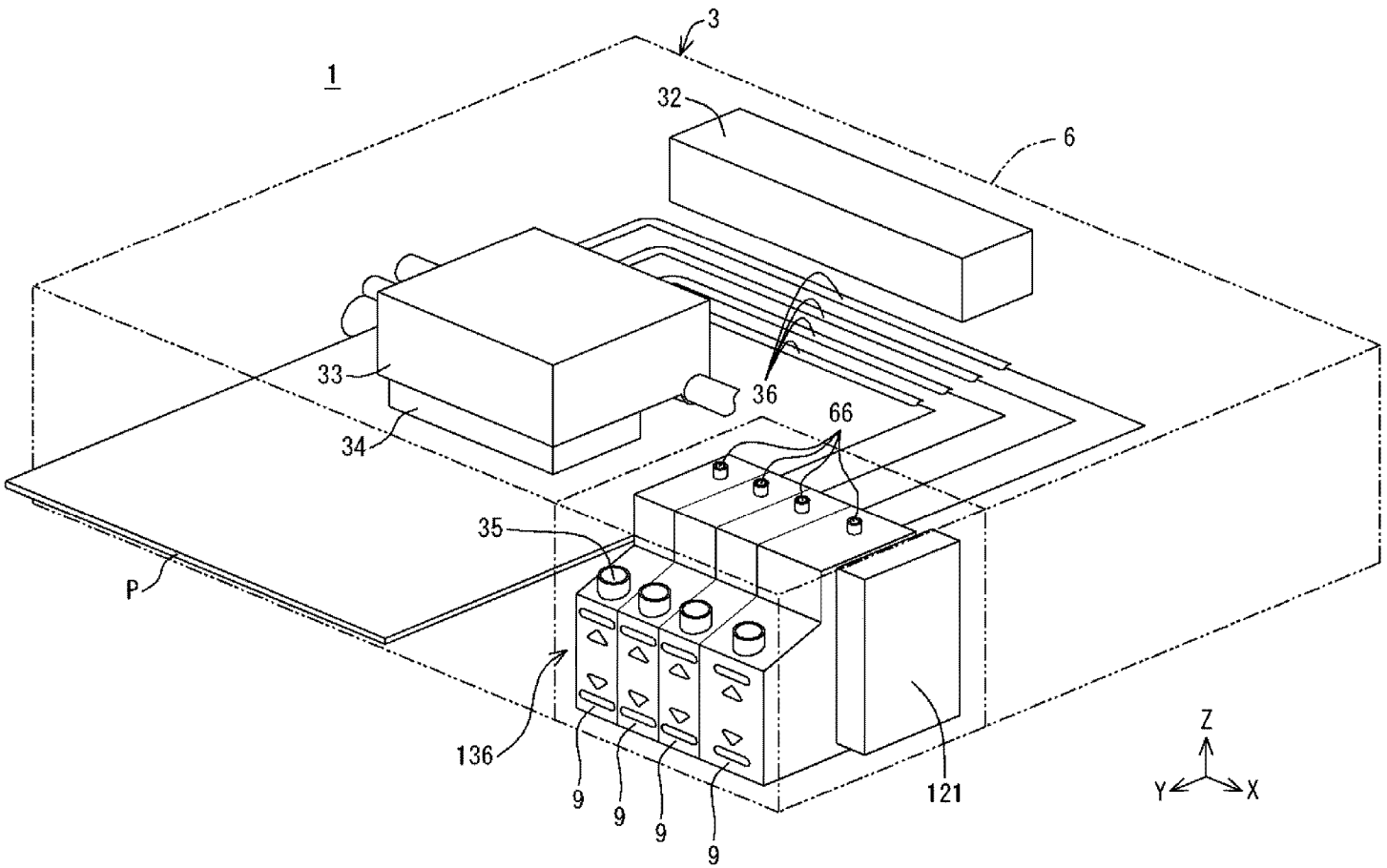
FIG. 3 is a perspective view showing a main configuration of another example of the liquid jet system in the embodiment.

In addition, the casing 7 and the casing 6 may be separated from each other or may be integrated. In the case where the casing 7 and the casing 6 are integrated, the tanks 9 can be housed in the casing 6 along with the recording head 34 and the ink supply tubes 36 as shown in FIG. 3.

In addition, a location in which the tanks 9 are arranged is not limited to the side face side in the X axis direction of the casing 6. As the location in which the tanks 9 are arranged, for example, the front face side in the Y axis direction of the casing 6 as shown in FIG. 3 can also be adopted.

In addition, in this embodiment, the tanks 9 are constituted separately from each other. However, the configuration of the tanks 9 is not limited thereto. As the configuration of the tanks 9, a configuration in which the tanks 9 are integrated as shown in FIG. 3 can also be adopted. In this case, a plurality of ink chambers are provided in one tank 9. The ink chambers are individually separated from one another, and are constituted so as to be able to contain different types of ink. In this case, for example, the ink chambers can individually contain different colors of ink.

In the liquid jet system 1 having the above-described configuration, the recording medium P is conveyed in the Y axis direction and the carriage 33 is moved reciprocally along the X axis while ejecting ink droplets onto the recording head 34 at predetermined positions, and thereby recording is performed on the recording medium P. These operations are controlled by the controller 32.

The ink is not limited to either water-based ink or oil-based ink. Moreover, as the water-based ink, either ink constituted by dissolving a solute such as a dye in a water-based solvent or ink constituted by dispersing a dispersoid such as pigment in a water-based dispersion medium may be used. Also, as the oil-based ink, either ink constituted by dissolving a solute such as a dye in an oil-based solvent or ink constituted by dispersing a dispersoid such as pigment in an oil-based dispersion medium may be used.

Figure 4:
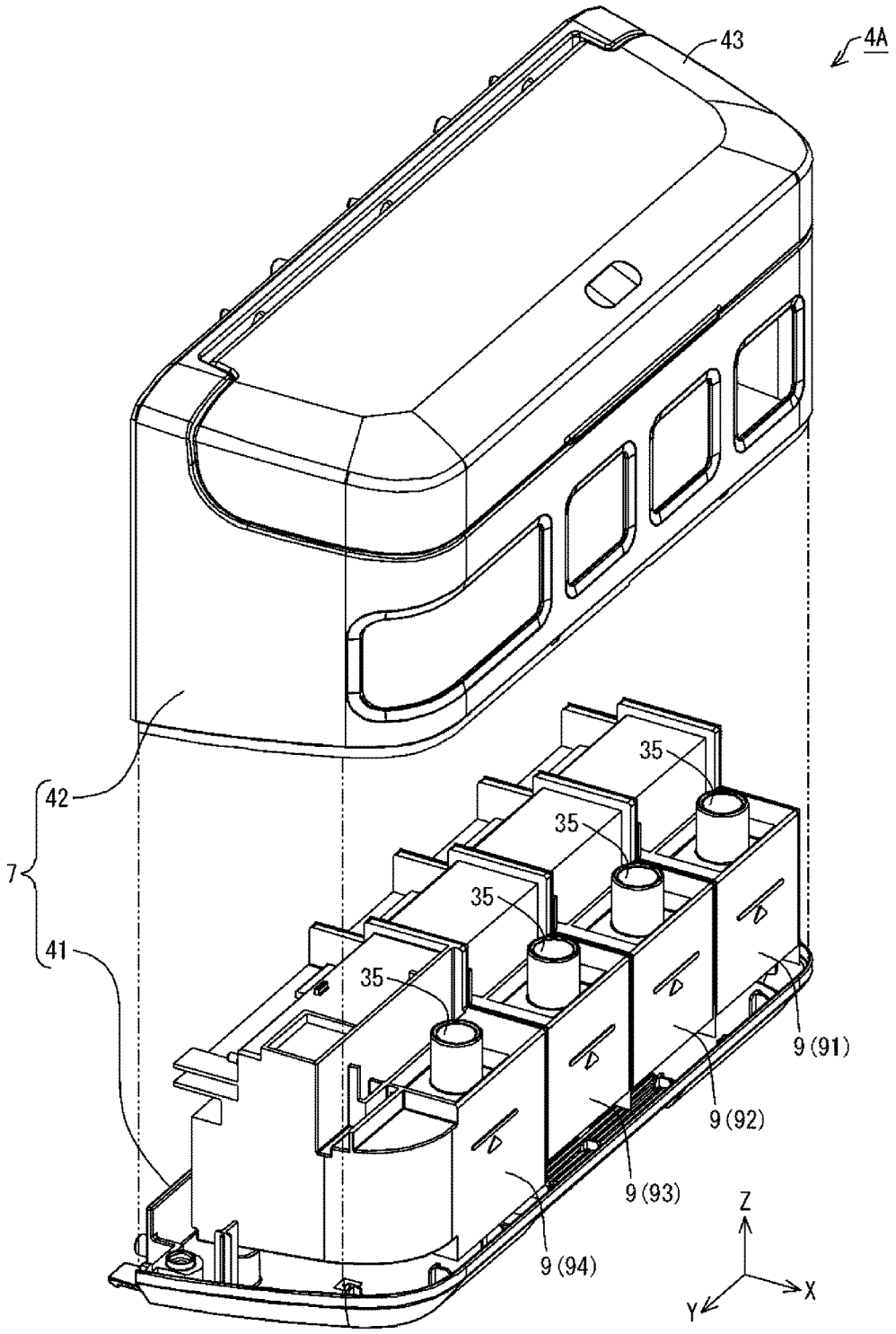
FIG. 4 is an exploded perspective view showing a main configuration of an ink supply device in the embodiment.

In the ink supply device 4A, the casing 7 includes a first casing 41 and a second casing 42, as shown in FIG. 4.

Here, an X axis, a Y axis and a Z axis in FIG. 4 respectively correspond to the X axis, the Y axis and the Z axis for the liquid jet system 1 shown in FIG. 1. Specifically, the X axis, the Y axis and the Z axis in FIG. 4 indicate the X axis, the Y axis and the Z axis in the state where the ink supply device 4A is assembled in the liquid jet system 1. In the case where, hereinafter, figures showing the constituent elements and units of the liquid jet system 1 are given an X axis, a Y axis and a Z axis, those axes also indicate the X axis, the Y axis and the Z axis in the state where the constituent elements and the units are assembled in (mounted to) the liquid jet system 1. Moreover, the orientation of each of the constituent elements and units in the use orientation of the liquid jet system 1 is referred to as a use orientation of those constituent elements and units.

As shown in FIG. 4, the first casing 41 is positioned in the −Z axis direction relative to the tanks 9. The tanks 9 are supported by the first casing 41. The second casing 42 is positioned in the Z axis direction relative to the first casing 41, and covers the tanks 9 from the Z axis direction of the first casing 41. The tanks 9 are covered with the first casing 41 and the second casing 42.

In this embodiment, the four tanks 9 are aligned along the Y axis. In the following description, in the case of individually distinguishing the four tanks 9, the four tanks 9 are individually indicated as a tank 91, a tank 92, a tank 93 and a tank 94. The tank 91, the tank 92, the tank 93 and the tank 94 are aligned in this order in the Y axis direction. Specifically, the tank 92 is positioned in the Y axis direction relative to the tank 91, the tank 93 is positioned in the Y axis direction relative to the tank 92, and the tank 94 is positioned in the Y axis direction relative to the tank 93.

The tank 91, the tank 92 and the tank 93 among the four tanks 9 have the same shape. The tank 94 has a shape different from that of the other tanks 9. The volume of the tank 94 is larger than the volume of the other tanks 9. Except for that point, the tank 94 has the same configuration as the other tanks 9. This configuration is suitable for containing a type of ink that is frequently used in the tank 94, for example. This is because the type of ink that is frequently used can be stored in a greater amount than the other types of ink.

Figure 5:
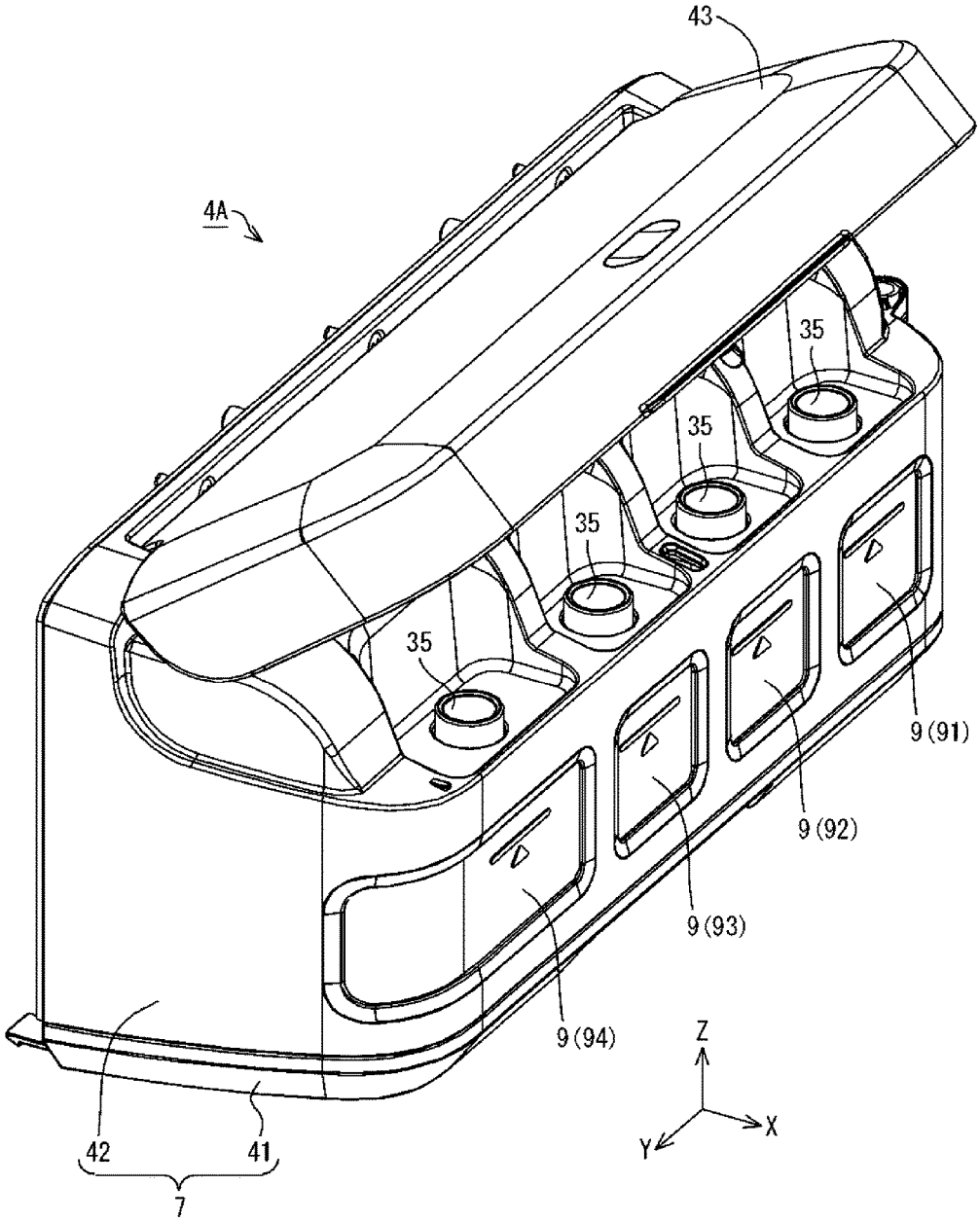
FIG. 5 is a perspective view showing the main configuration of the ink supply device in the embodiment.

The second casing 42 has a cover 43. The cover 43 is constituted so as to be able to rotate with respect to the second casing 42 as shown in FIG. 5. In FIG. 5, the state in which the cover 43 is opened with respect to the second casing 42 is illustrated. When the cover 43 is opened with respect to the second casing 42, the liquid inlet portions 35 of the tanks 9 are exposed. Accordingly, the operator can access the liquid inlet portions 35 of the tanks 9 from outside of the casing 7.

Various examples of the tank 9 and the ink supply device 4A will be described. Note that in the following description, for the purpose of distinguishing the tanks 9 and the ink supply device 4A for each of the examples, an alphabetic character different for each of the examples is given to the reference signs of the tanks 9 and the ink supply device 4A. Moreover, as described above, the tank 94 among the four tanks 9 and the other tanks 9 have the same configuration except that the volumes are different. The examples of the tanks 9 will be described below regarding the tank 91 as an example. The various examples of the tanks 9 can be applied to the tank 94. Therefore, detailed description of the examples of the tank 94 is omitted.

EXAMPLE 1

Figure 6:
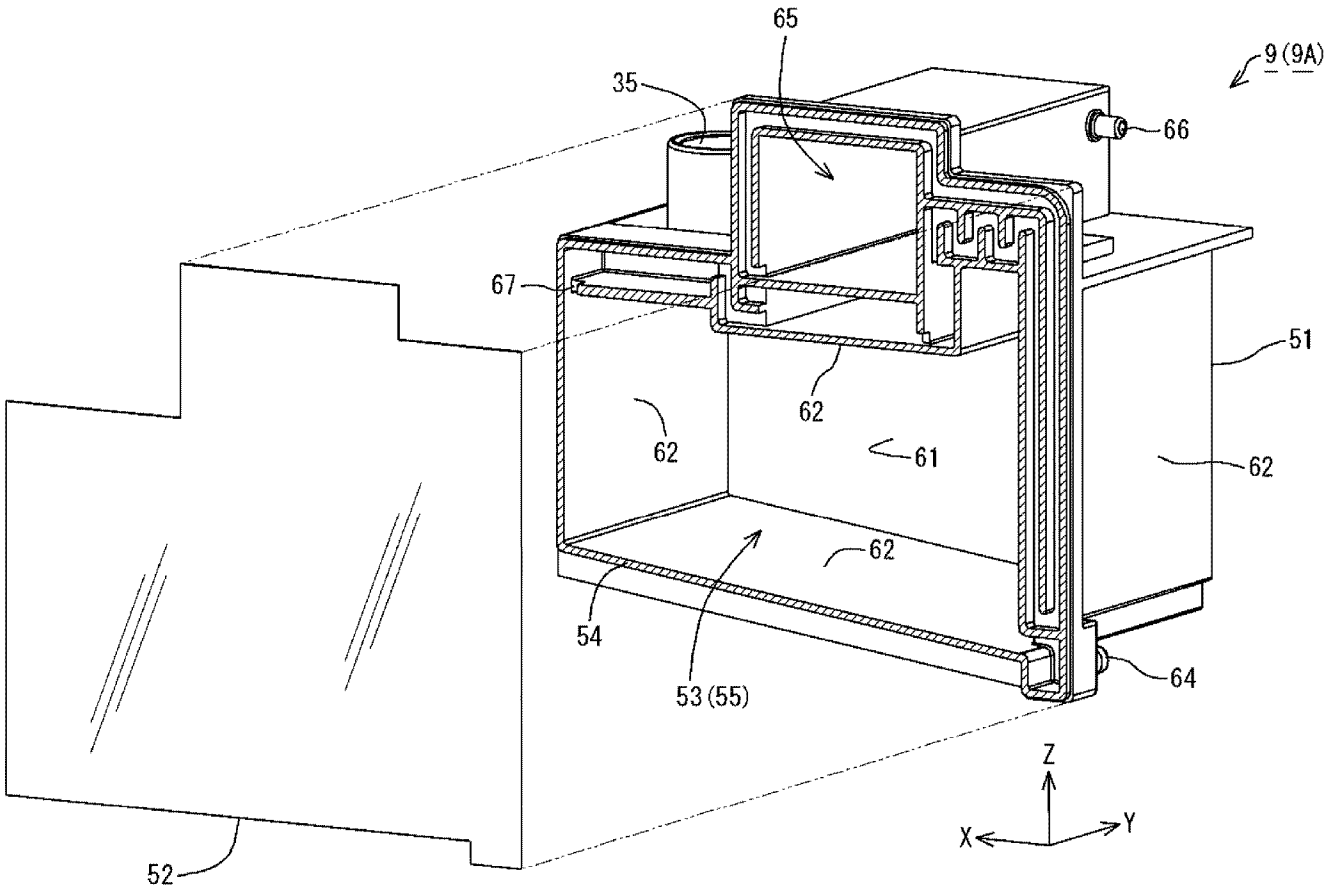
FIG. 6 is an exploded perspective view showing a tank in Example 1.

A tank 9A in Example 1 will be described. The tank 9A has a case 51, which is an example of a tank body, and a sheet member 52 as shown in FIG. 6. The case 51 is made of a synthetic resin such as nylon or polypropylene. Moreover, the sheet member 52 is formed into a film by synthetic resin (ex. nylon or polypropylene), and has flexibility. In this embodiment, the sheet member 52 has optical transparency.

The case 51 has a recessed portion 53 formed therein. The case 51 is also provided with a joining portion 54. In FIG. 6, in order to show the configuration so as to be easily understood, the joining portion 54 is hatched. In this embodiment, the case 51 and the sheet member 52 are joined by welding. When the sheet member 52 is joined to the case 51, the recessed portion 53 is blocked by the sheet member 52. A space surrounded by the recessed portion 53 and the sheet member 52 is referred to as a liquid containing portion 55. Ink is stored in the liquid containing portion 55.

As shown in FIG. 6, the case 51 has a wall 61 and a side wall 62. The wall 61 extends along the XZ plane. The side wall 62 intersect the wall 61. The side wall 62 protrudes from the wall 61 in the −Y axis direction. When the wall 61 is viewed in a planar view in the Y axis direction, the side wall 62 surrounds the wall 61. The wall 61 and the side wall 62 constitute the recessed portion 53 whose bottom is the wall 61. Note that the wall 61 and the side wall 62 are not limited to flat walls, and may include recessed portions, steps and the like.

The recessed portion 53 is constituted in a direction so as to be recessed toward the Y axis direction. The recessed portion 53 is open in the −Y axis direction, that is, toward a sheet member 52 side. In other words, the recessed portion 53 is constituted in a direction so as to be recessed toward the Y axis direction, that is, on a side opposite to the sheet member 52 side. When the sheet member 52 is joined to the case 51, the recessed portion 53 is blocked by the sheet member 52, and the liquid containing portion 55 is formed. In other words, when the sheet member 52 is joined to the case 51, the wall 61, the side walls 62 and the sheet member 52 define the liquid containing portion 55. Note that the liquid inlet portion 35 is positioned in the Z axis direction of the liquid containing portion 55, and passes through the side wall 62 along the Z axis to the liquid containing portion 55.

In addition, the tank 9A has a liquid supply portion 64, an atmospheric air open path 65 and an open air port 66 as shown in FIG. 6. The liquid supply portion 64 is a portion that serves as an outlet for ink stored in the liquid containing portion 55 when the ink is supplied from the liquid containing portion 55 to the recording head 34. The ink stored in the liquid containing portion 55 is ejected to the outside of the tank 9A via the liquid supply portion 64.

The atmospheric air open path 65 communicates with the liquid containing portion 55 via a notch 67 formed in the side wall 62. The liquid containing portion 55 is open to the atmospheric air at the open air port 66 from the notch 67 via the atmospheric air open path 65. Therefore, the atmospheric air introduced from the open air port 66 to the atmospheric air open path 65 can flow into the liquid containing portion 55 through the atmospheric air open path 65. Note that the notch 67 constitutes a portion of the atmospheric air open path 65. In other words, the notch 67 is included in the atmospheric air open path 65. In addition, the open air port 66 is an opening formed on the case 51, and is defined as an opening that is open to the outside of the tank 9A.

Figure 7:
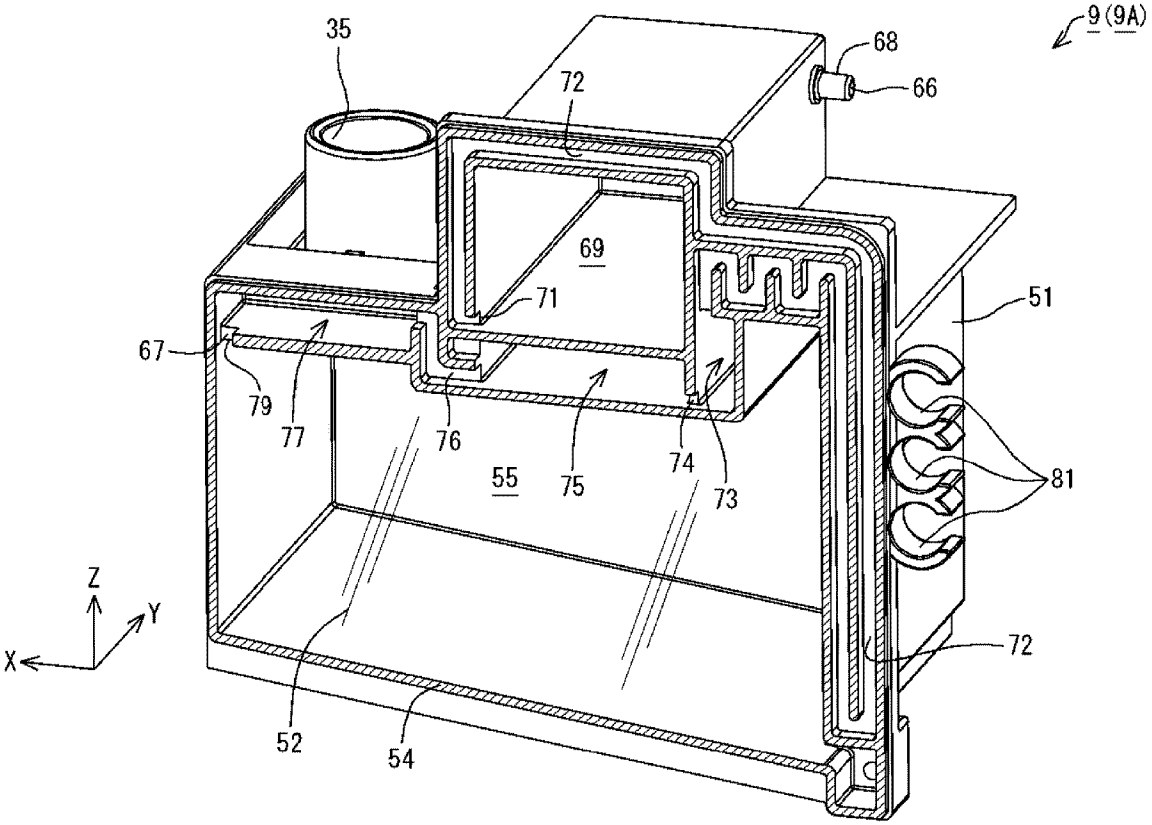
FIG. 7 is a perspective view showing the tank in Example 1.

The atmospheric air introduced from the open air port 66 to the atmospheric air open path 65 flows into a first atmospheric air chamber 69 through an introduction portion 68 as shown in FIG. 7. Note that in FIG. 7, a state in which the tank 9A is viewed from the sheet member 52 side is shown, and the case 51 viewed through the sheet member 52 is illustrated. Moreover, in FIG. 7, in order to show the configuration so as to be easily understood, the joining portion 54 is hatched. The first atmospheric air chamber 69 is positioned in the Z axis direction relative to the liquid containing portion 55.

The first atmospheric air chamber 69 communicates with a first introduction path 72 via a communication port 71. The communication port 71 is defined as an opening formed at an intersection at which the internal wall of the first atmospheric air chamber 69 intersects the first introduction path 72. In other words, the communication port 71 is a location at which the first introduction path 72 is connected to the first atmospheric air chamber 69. Note that a configuration in which tube holding portions 81 are provided on the tank 9 can also be adopted. In an example shown in FIG. 7, the tube holding portions 81 are formed on the case 51. The tube holding portions 81 each have an annular appearance, and have a configuration in which a portion of the annular shape is cut away. The tube holding portions 81 are constituted such that the ink supply tubes 36 (FIG. 3) connected to the introduction portions 68 can be inserted thereinto. The ink supply tubes 36 can be held by the tube holding portions 81. With the tank 9 that is provided with the tube holding portions 81, it is sufficient that the ink supply tubes 36 are inserted into the tube holding portions 81, and thus the ink supply tubes 36 can be easily fixed during the assembly.

Figure 8:
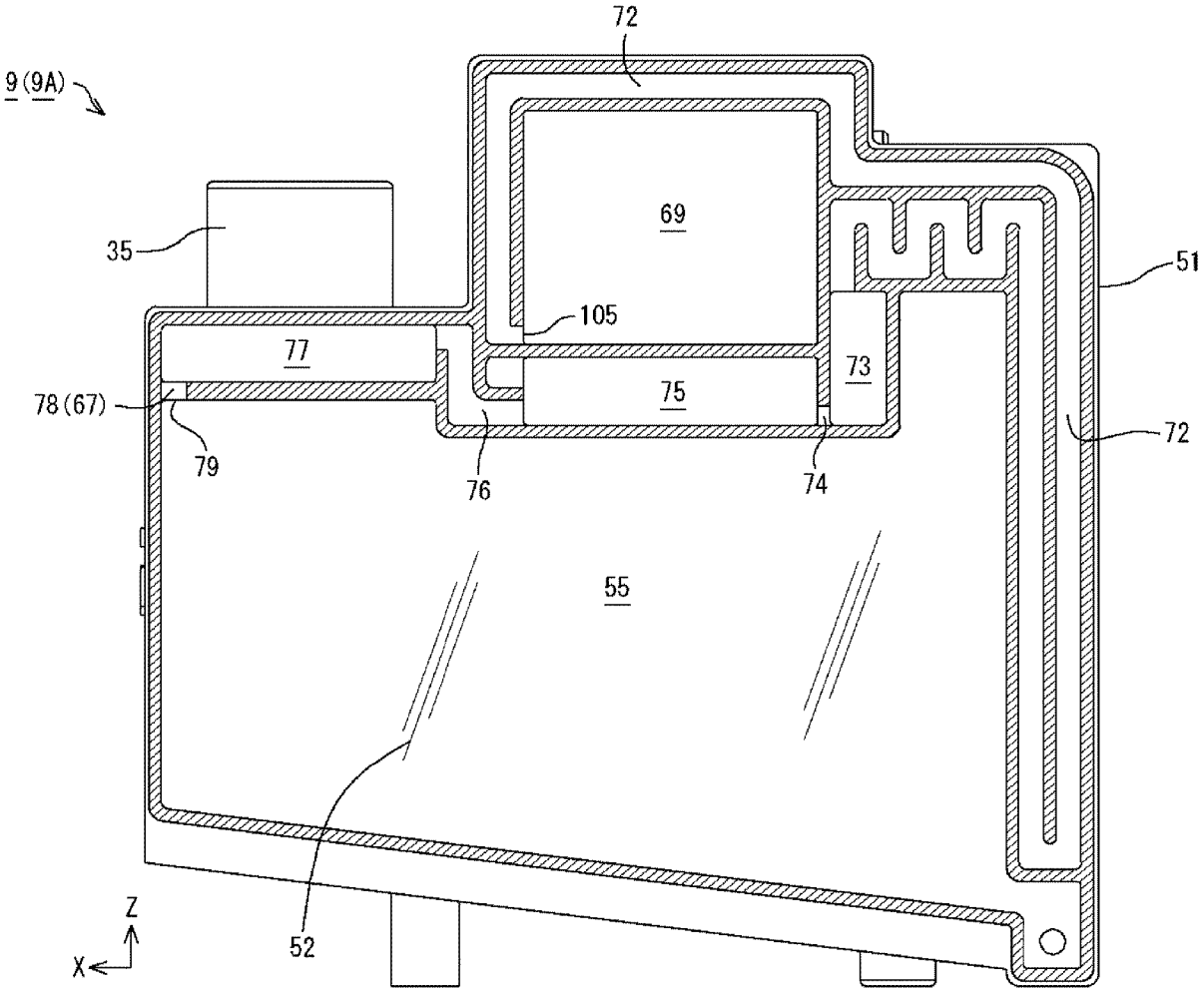
FIG. 8 is a side view of the tank in Example 1 when viewed from a sheet member side.

The first introduction path 72 extends around outside the first atmospheric air chamber 69, in the state where the tank 9A is viewed in a planar view in the Y axis direction, as shown in FIG. 8. The first introduction path 72 extends around outside the first atmospheric air chamber 69 and extends along the peripheral edge of the case 51, and leads to a second atmospheric air chamber 73 via a route that turns back and meanders.

The second atmospheric air chamber 73 is positioned in the −X axis direction relative to the first atmospheric air chamber 69. The second atmospheric air chamber 73 leads to a third atmospheric air chamber 75 via a communication path 74. The third atmospheric air chamber 75 is positioned in the −Z axis direction relative to the first atmospheric air chamber 69, and is positioned in the X axis direction relative to the second atmospheric air chamber 73. The third atmospheric air chamber 75 is positioned along the Z axis between the first atmospheric air chamber 69 and the liquid containing portion 55. The third atmospheric air chamber 75 leads to a fourth atmospheric air chamber 77 via a communication path 76. The fourth atmospheric air chamber 77 is positioned in the X axis direction relative to the third atmospheric air chamber 75. The fourth atmospheric air chamber 77 leads to a communication path 78. The communication path 78 is an area surrounded by the notch 67 formed on the case 51 and the sheet member 52.

The communication path 78 communicates with the liquid containing portion 55 via a communication port 79. The communication port 79 is defined as an opening formed at an intersection at which the internal wall of the liquid containing portion 55 intersects the communication path 78. In other words, the communication port 79 is a location in which the communication path 78 is connected to the liquid containing portion 55. According to the above configuration, the atmospheric air open path 65 includes the introduction portion 68 shown in FIG. 7, the first atmospheric air chamber 69, the first introduction path 72, the second atmospheric air chamber 73, the communication path 74, the third atmospheric air chamber 75, the communication path 76, the fourth atmospheric air chamber 77, and the communication path 78. In addition, one end of the atmospheric air open path 65 is the open air port 66, and the other end of the atmospheric air open path 65 is the communication port 79.

Note that the configuration of the atmospheric air open path 65 is not limited thereto, and configurations in which the combination and order of various atmospheric air chambers, introduction paths, communication paths and the like are arbitrarily changed can also be adopted. Furthermore, configurations in which a portion of various atmospheric air chambers, introduction paths or communication paths is omitted or added can also be adopted. Furthermore, in addition to such configurations, a configuration in which the introduction portion 68 is omitted can also be adopted. In the configuration in which the introduction portion 68 is omitted, the open air port 66 is defined as an opening that is opened in the outer wall of the case 51.

Ink in the liquid containing portion 55 is supplied to the recording head 34 along with printing performed by the recording head 34. At this time, the pressure in the liquid containing portion 55 decreases below the atmospheric air pressure along with the printing performed by the recording head 34. When the pressure in the liquid containing portion 55 decreases below the atmospheric air pressure, the ink in the liquid containing portion 55 is prevented from being easily supplied to the recording head 34. When this occurs, the ability of the recording head 34 to eject the ink tends to deteriorate, and thus recording quality deteriorates in some cases. To deal with this, in the tank 9A, the liquid containing portion 55 is open to the atmospheric air via the atmospheric air open path 65, and thus the pressure in the liquid containing portion 55 is easily maintained at the atmospheric air pressure. Therefore, in the liquid jet system 1 in this embodiment, it is easy to maintain high recording quality.

EXAMPLE 2

Figure 9:
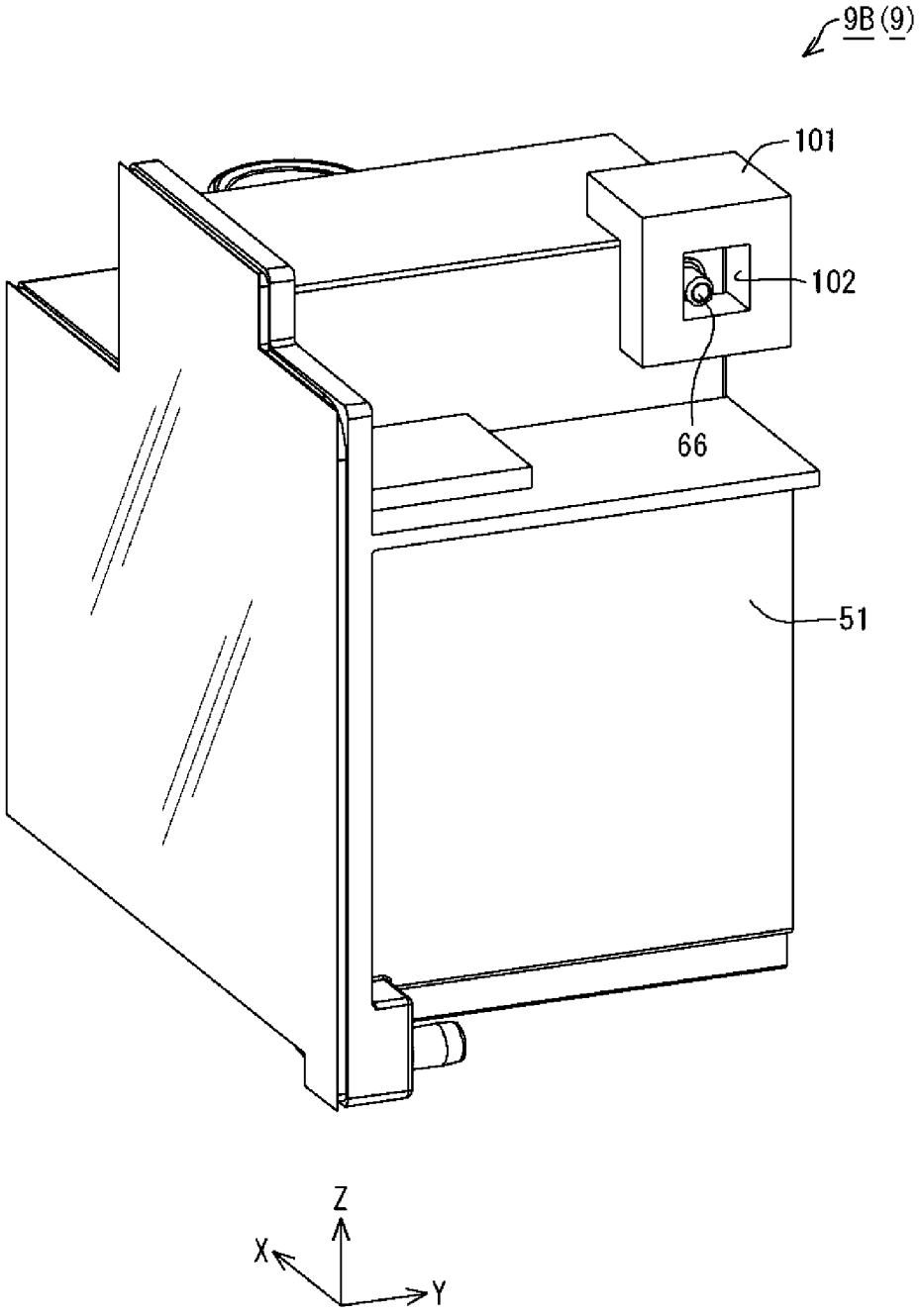
FIG. 9 is a perspective view showing a tank in Example 2.
Figure 10:
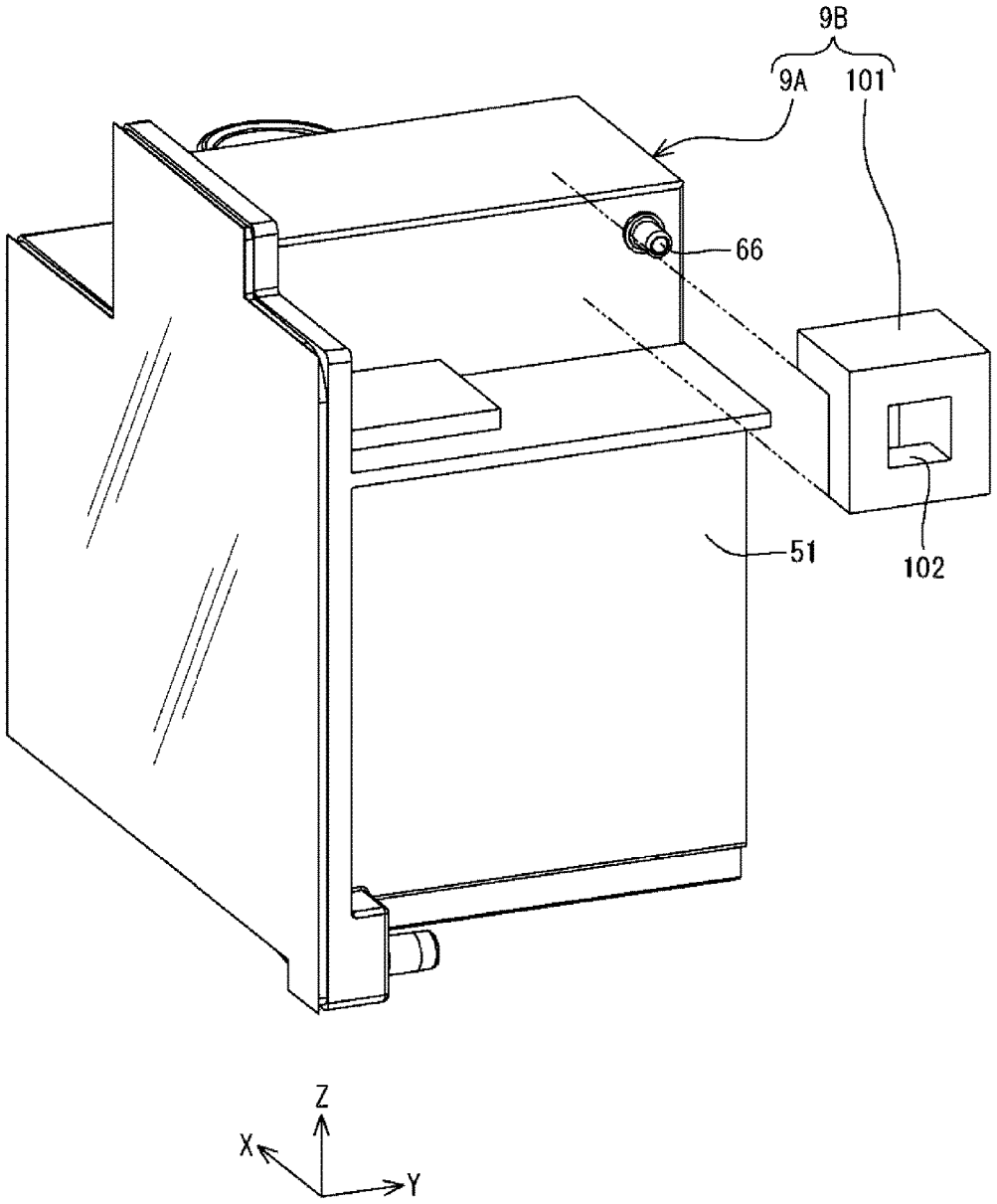
FIG. 10 is an exploded perspective view showing the tank in Example 2.

A tank 9B of Example 2 has a liquid absorbent material 101 as shown in FIG. 9. The tank 9B of Example 2 has a configuration in which the liquid absorbent material 101 is added to the tank 9A of Example 1 as shown in FIG. 10. Except for that point, the tank 9B of Example 2 has the same configuration as the tank 9A of Example 1. Therefore, in the following description, the same reference signs as Example 1 are given to the same constituent elements as Example 1, and detailed description thereof is omitted.

The liquid absorbent material 101 has a property of absorbing liquid and holding the absorbed liquid. As the material of the liquid absorbent material 101, various materials such as foam, felt and a nonwoven fabric can be adopted. A through hole 102 is formed on the liquid absorbent material 101. Due to the through hole 102, the liquid absorbent material 101 has an annular appearance when viewed in a planar view in the X axis direction. As shown in FIG. 9, the liquid absorbent material 101 is arranged on the case 51 such that the open air port 66 is positioned inside the through hole 102. Therefore, the liquid absorbent material 101 is arranged around the open air port 66.

Note that in the tank 9B, the liquid absorbent material 101 is joined to the case 51. Various joining methods of the joining of the liquid absorbent material 101 to the case 51 can be adopted, such as bonding, welding and attachment using an adhesive tape.

With the tank 9B of Example 2, the liquid absorbent material 101 is arranged around the open air port 66, and thus even if ink leaks out from the open air port 66, the leaked ink can be absorbed by the liquid absorbent material 101. Accordingly, the possibility of soiling caused by the ink leakage can be suppressed to a low level. Note that in Example 2, an example in which the liquid absorbent material 101 is constituted by one member is described. However, the configuration of the liquid absorbent material 101 is not limited thereto. As the configuration of the liquid absorbent material 101, a configuration in which two members are in contact with each other, a configuration in which three or more members are in contact with one another and the like can be adopted. With such configurations, a similar effect is obtained.

EXAMPLE 3

In the tank 9B of Example 2, the liquid absorbent material 101 is provided over the entire periphery of the open air port 66. However, the configuration of the tank 9 is not limited thereto. As the configuration of the tank 9, a configuration in which the liquid absorbent material 101 is arranged only in a portion of the periphery of the open air port 66 can also be adopted. A configuration in which the liquid absorbent material 101 is arranged only in a portion of the periphery of the open air port 66 will be described as a tank 9C of Example 3.

Figure 11:
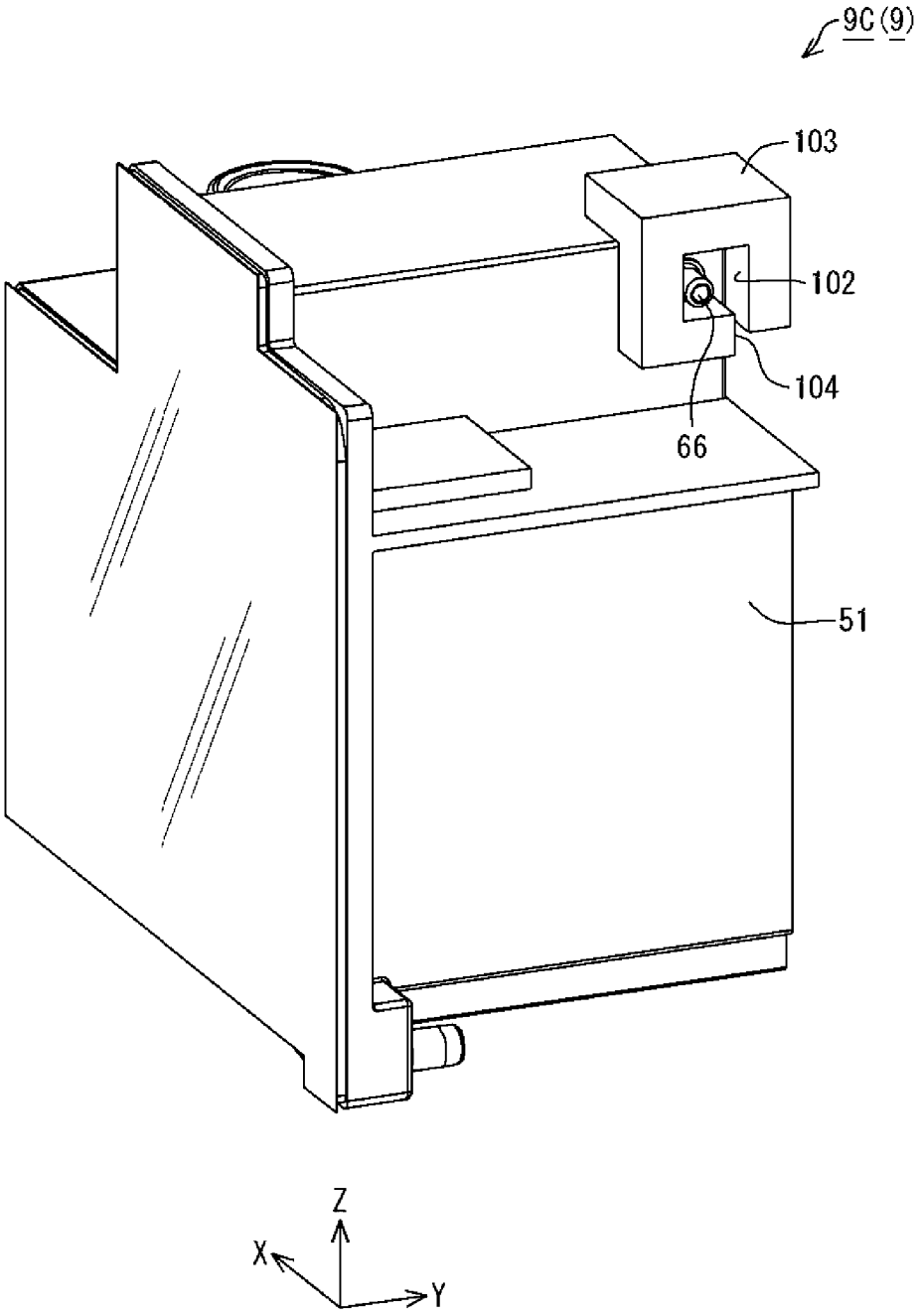
FIG. 11 is a perspective view showing a tank in Example 3.

The tank 9C of Example 3 has a liquid absorbent material 103 as shown in FIG. 11. In the tank 9C of Example 3, the liquid absorbent material 101 of the tank 9B of Example 2 (FIG. 9) is replaced by the liquid absorbent material 103. Except for that point, the tank 9C of Example 3 has the same configuration as the tank 9B of Example 2. Therefore, in the following description, the same reference signs as Example 1 and Example 2 are given to the same constituent elements as Example 1 and Example 2, and detailed description thereof is omitted.

The liquid absorbent material 103 has a configuration in which an opening portion 104 is formed on the liquid absorbent material 101 in Example 2. The liquid absorbent material 103 has a shape in which the annular shape of the liquid absorbent material 101 having an annular shape with the through hole 102 shown in FIG. 9 is partially open. Except for that point, the liquid absorbent material 103 has the same configuration as the liquid absorbent material 101. Therefore, in the following description, the same reference signs as Example 2 are given to the same constituent elements as Example 2, and detailed description thereof is omitted.

Figure 12:
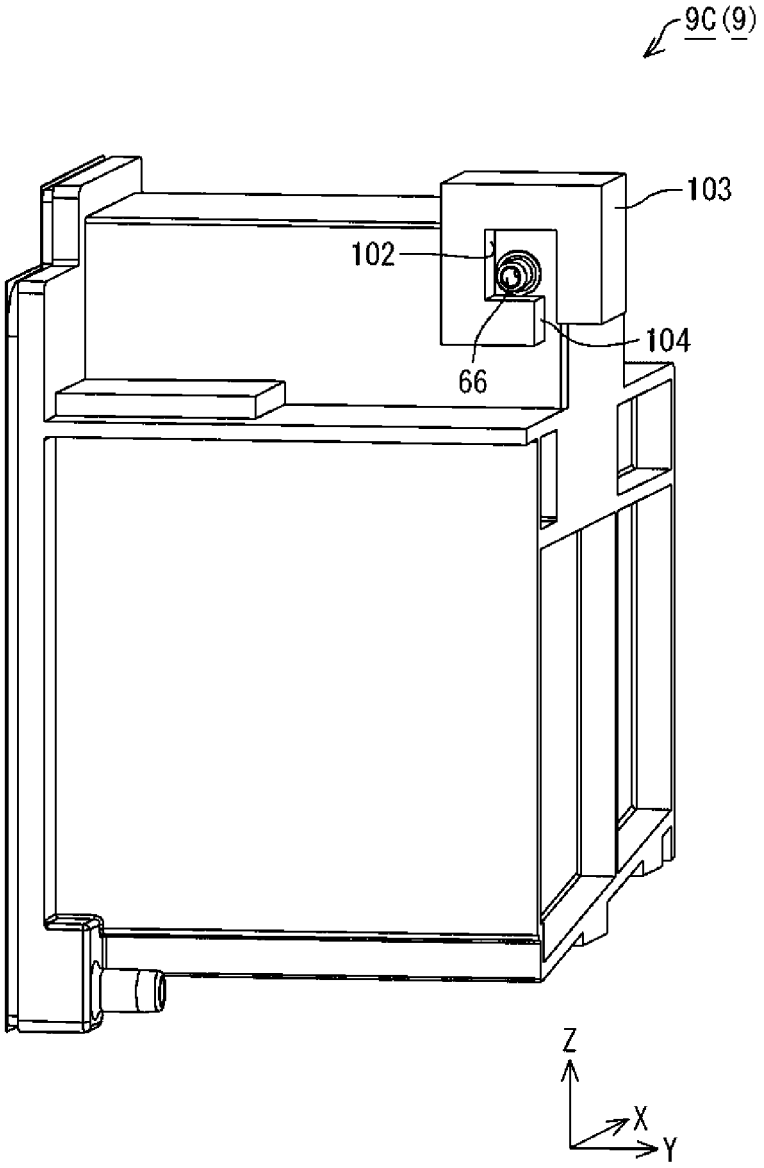
FIG. 12 is a perspective view showing the tank in Example 3.

In Example 3, as shown in FIG. 12, with the opening portion 104, a configuration in which the liquid absorbent material 103 is arranged only in a portion of the periphery of the open air port 66 is provided. With a configuration in which the liquid absorbent material is arranged only in a portion of the periphery of the open air port 66 such as Example 3 in which the liquid absorbent material 103 is adopted, an effect of reducing soiling caused by ink that has leaked out from the open air port 66 is obtained. In other words, in Example 3 as well, the same effect as Example 2 is obtained. Therefore, with any configuration in which a liquid absorbent material is arranged at least in a portion of the periphery of the open air port 66, soiling caused by the ink that has leaked from the open air port 66 can be reduced. Note that the position of the opening portion 104 is not limited to the position illustrated in FIG. 12, and any position in the annular shape can be adopted.

EXAMPLE 4

Figure 13:
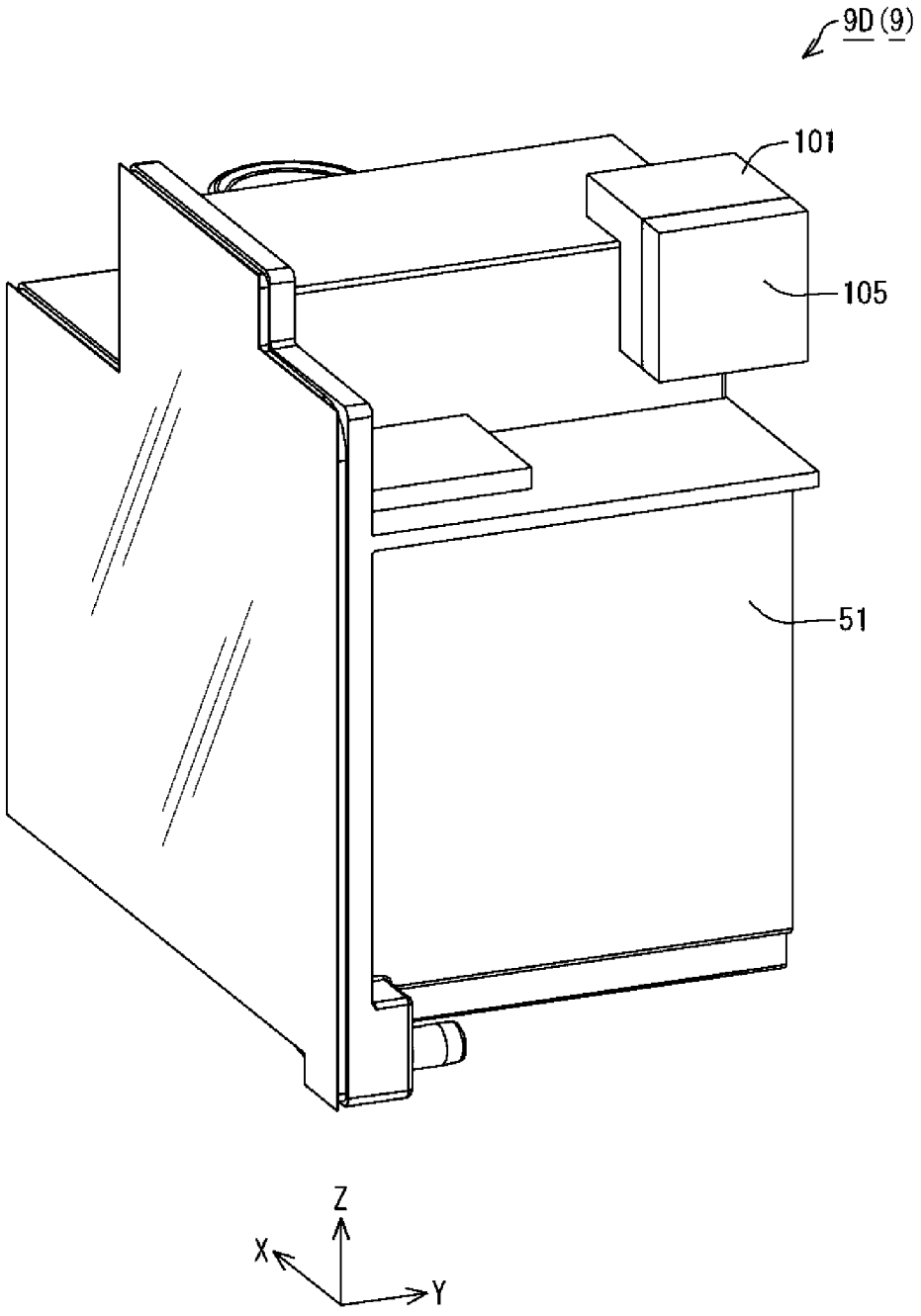
FIG. 13 is a perspective view showing a tank in Example 4.
Figure 14:
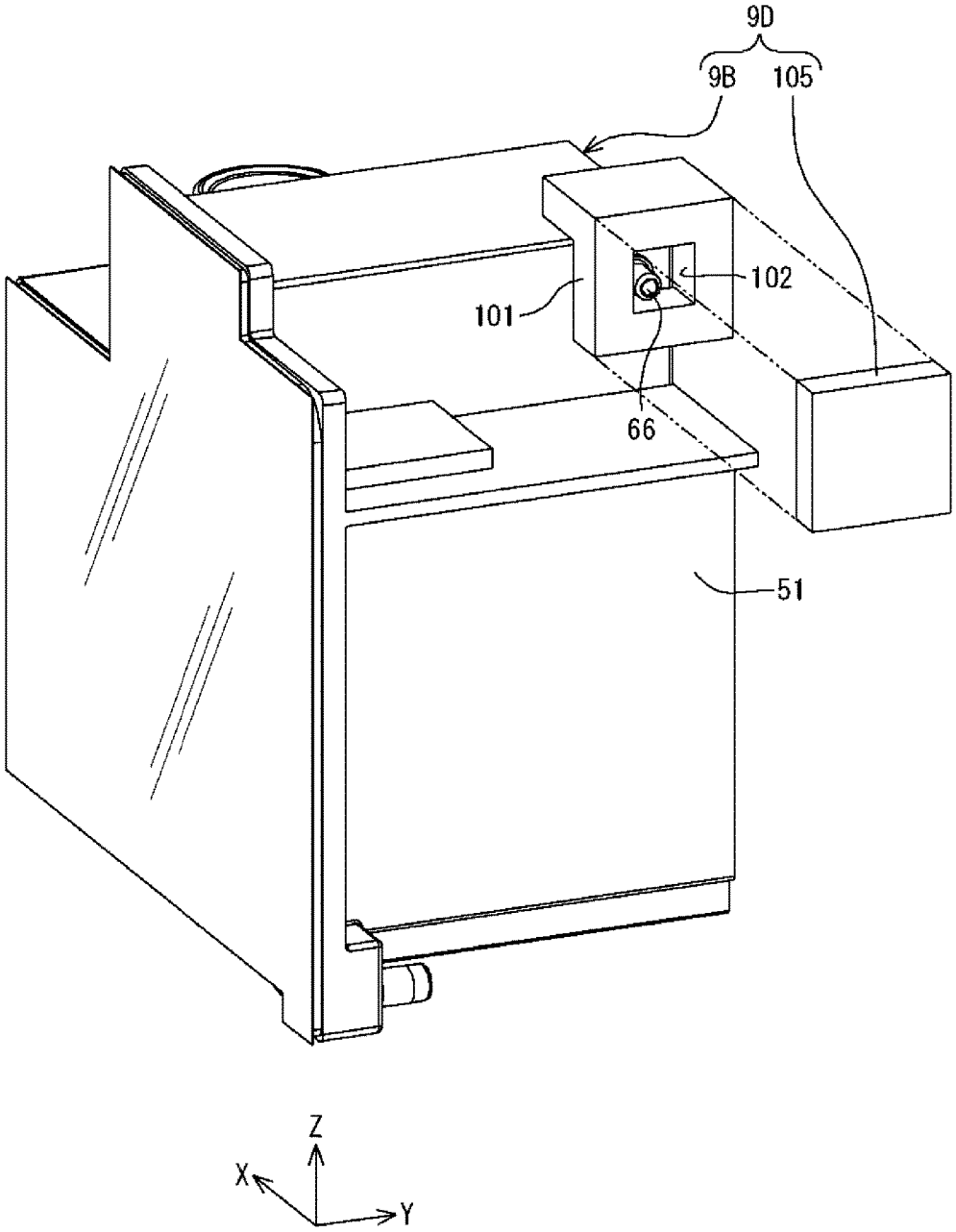
FIG. 14 is an exploded perspective view showing the tank in Example 4.

A tank 9D of Example 4 has a liquid absorbent material 105 as shown in FIG. 13. The tank 9D of Example 4 has a configuration in which the liquid absorbent material 105 is added to the tank 9B of Example 2 as shown in FIG. 14. Except for that point, the tank 9D of Example 4 has the same configuration as the tank 9B of Example 2. Therefore, in the following description, the same reference signs as Example 1 or Example 2 are given to the same constituent elements as Example 1 or Example 2, and detailed description thereof is omitted.

The liquid absorbent material 105 has a property of absorbing liquid and holding the absorbed liquid. As the material of the liquid absorbent material 105, the same material as the liquid absorbent material 101 can be adopted. The liquid absorbent material 105 is arranged at a position facing the open air port 66. As shown in FIG. 13, the liquid absorbent material 105 is joined to the liquid absorbent material 101 in the state of blocking the through hole 102 of the liquid absorbent material 101 (FIG. 14). Therefore, the open air port 66 (FIG. 14) is covered with the liquid absorbent material 101 and the liquid absorbent material 105. As the joining of the liquid absorbent material 105 to the liquid absorbent material 101, various joining methods such as bonding, welding or attachment using an adhesive tape can be adopted. Note that in Example 4, the liquid absorbent material 101 is an example of a first portion, and the liquid absorbent material 105 is an example of a second portion. In Example 4 as well, the same effect as Example 2 and Example 3 is obtained.

Furthermore, with the tank 9D of Example 4, due to the liquid absorbent material 101 positioned at the periphery of the open air port 66 and the liquid absorbent material 105 facing the open air port 66, ink leaking out to the periphery of the open air port 66 and in a direction facing the open air port is easily absorbed by the liquid absorbent material 101 and the liquid absorbent material 105. In other words, in the tank 9D of Example 4, the liquid absorbent material 101 and the liquid absorbent material 105 covers the open air port 66, and therefore even if the ink leaks out from the open air port 66, it is easy for the liquid absorbent material 101 and the liquid absorbent material 105 to reliably absorb the leaked ink. Accordingly, the possibility of soiling caused by the ink leakage can be further suppressed to a low level.

Note that in the tank 9D of Example 4, the liquid absorbent material 101 and the liquid absorbent material 105 are constituted separately from each other. However, the configuration of the tank 9D is not limited thereto. As the configuration of the tank 9D, a configuration in which the liquid absorbent material 101 and the liquid absorbent material 105 are formed integrally with each other can also be adopted. In addition, in Example 4 as well, a configuration in which the liquid absorbent material 101 is arranged only in a portion of the periphery of the open air port 66 similarly to the liquid absorbent material 103 of Example 3 can also be adopted. With the configuration in which the liquid absorbent material 101 is arranged only in a portion of the periphery of the open air port 66 as well, an effect of reducing soiling caused by ink that has leaked from the open air port 66 is obtained.

EXAMPLE 5

Figure 15:
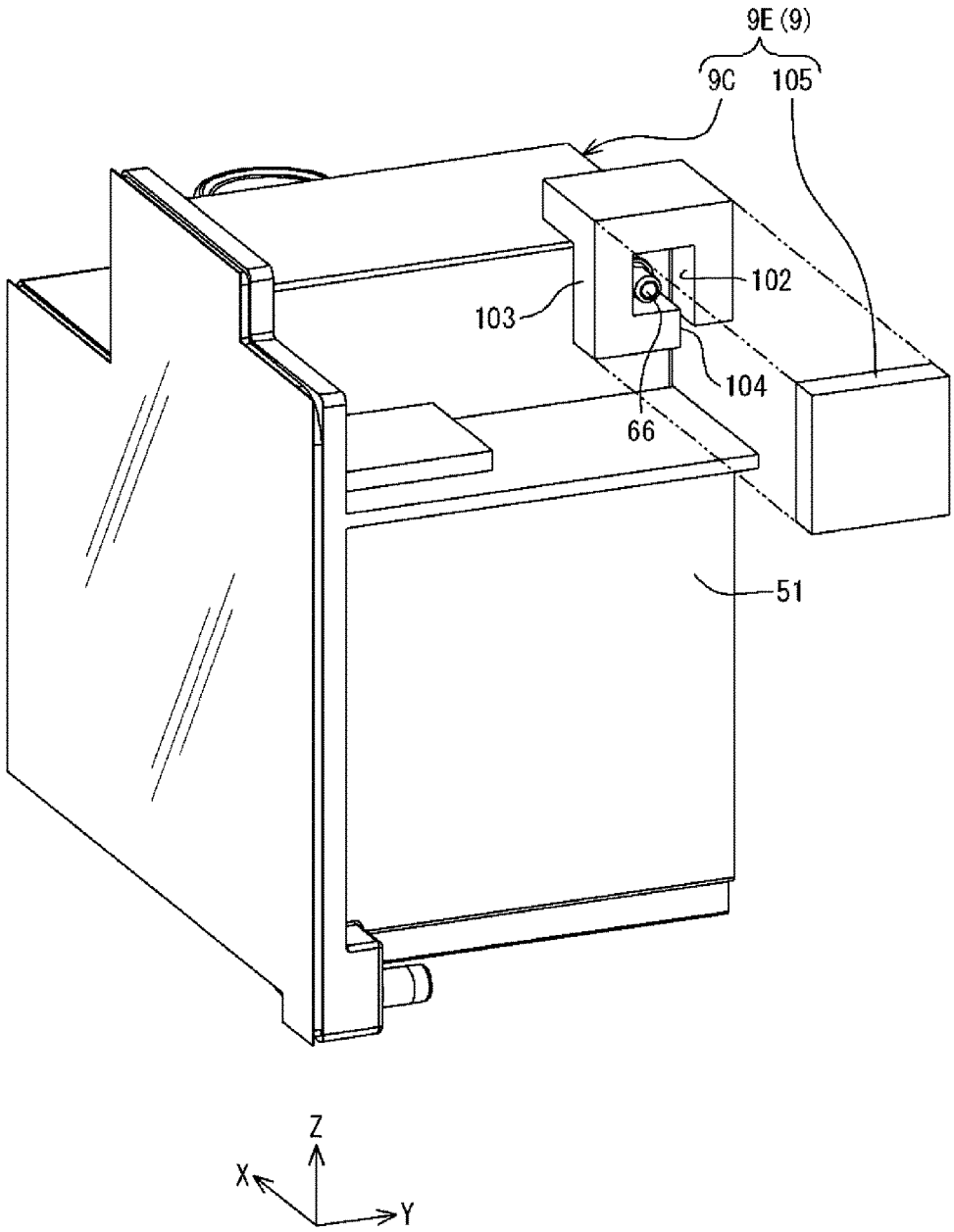
FIG. 15 is an exploded perspective view showing a tank in Example 5.

A tank 9E of Example 5 has the liquid absorbent material 103 and the liquid absorbent material 105 as shown in FIG. 15. In the tank 9E of Example 5, the liquid absorbent material 101 of the tank 9D of Example 4 (FIG. 14) is replaced by the liquid absorbent material 103 of Example 2. Except for that point, the tank 9E of Example 5 has the same configuration as the tank 9D of Example 4. From another viewpoint, the tank 9E of Example 5 has a configuration in which the liquid absorbent material 105 in the tank 9D of Example 4 is added to the tank 9C of Example 3 (FIG. 11). Therefore, in the following description, the same reference signs as Example 1 to Example 4 are given to the same constituent elements as Example 1 to Example 4, and detailed description thereof is omitted.

Figure 16:
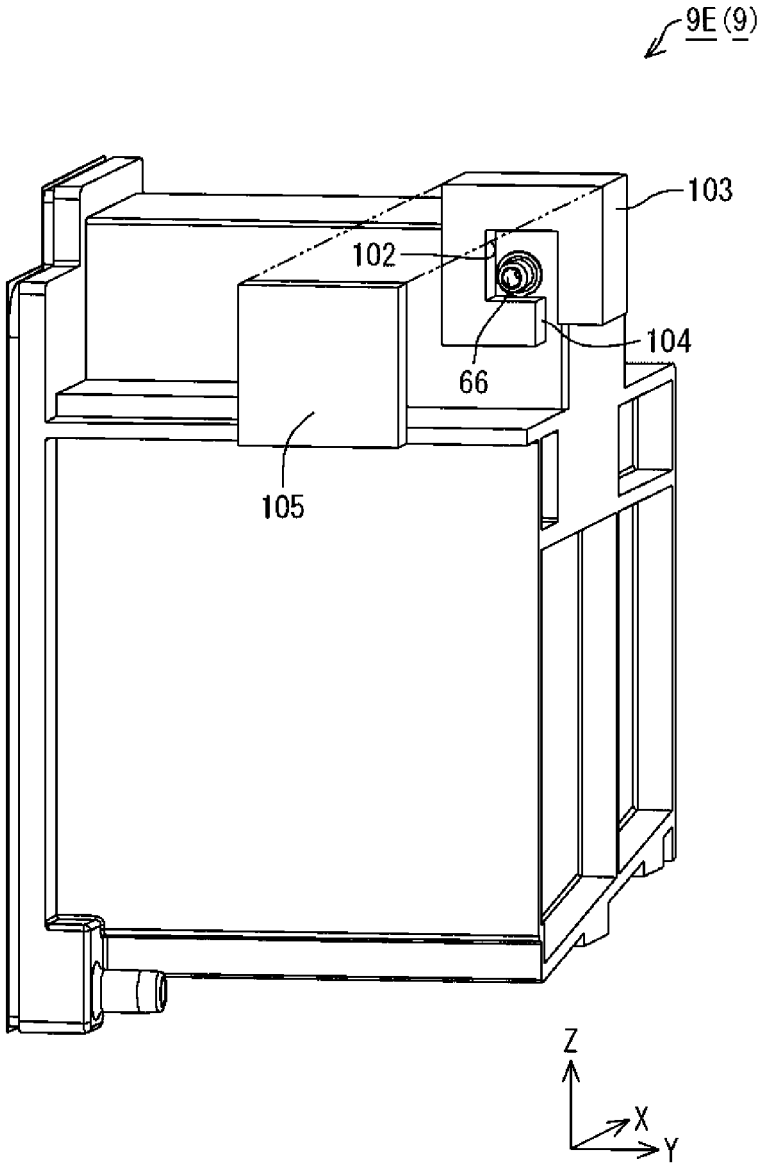
FIG. 16 is an exploded perspective view showing the tank in Example 5.

In Example 5, as shown in FIG. 16, the opening portion 104 formed on the liquid absorbent material 103 is open to the atmospheric air. Therefore, in Example 5, the open air port 66 is easily opened to the atmospheric air via the opening portion 104 formed on the liquid absorbent material 103. In Example 5 as well, the same effect as Example 2 to Example 4 is obtained. Note that the opening portion 104 has a shape formed by cutting away a portion of the annular shape of the liquid absorbent material 101 shown in FIG. 9. Therefore, the opening portion 104 can be regarded as a notch portion formed by cutting away a portion of the annular shape of the liquid absorbent material 101 shown in FIG. 9.

Moreover, in Example 5, as shown in FIG. 16, the opening portion 104 is positioned vertically below the open air port 66, in other words, the opening portion 104 is positioned in the −Z axis direction relative to the open air port 66. Therefore, for example, in the case where the tank 9 adopts an inverted orientation that is inverted from the use orientation, the opening portion 104 of the liquid absorbent material 103 is positioned vertically above the open air port 66. Accordingly, in the inverted orientation, even if ink leaks out from the open air port 66, the leaked ink does not easily reach the opening portion 104 of the liquid absorbent material 103. As a result, in the inverted orientation, even if ink leaks out from the open air port 66, the possibility of soiling caused by the ink leakage can be suppressed to a low level.

Note that in the use orientation of the tank 9, as shown in FIG. 7, the open air port 66 is positioned in the Z axis direction relative to the liquid containing portion 55. In other words, in the use orientation of the tank 9, the open air port 66 is positioned vertically above the liquid containing portion 55. In contrast, in the inverted orientation of the tank 9, the orientation of the tank 9 is inverted from the use orientation, and the open air port 66 is positioned in the −Z axis direction relative to the liquid containing portion 55. In other words, in the inverted orientation of the tank 9, the orientation of the tank 9 is inverted from the use orientation, and the open air port 66 is positioned vertically below the liquid containing portion 55. The inverted orientation is a state in which the Z axis direction is a vertically downward direction. The state in which the Z axis direction is the vertically downward direction is not limited to the state in which the Z axis is perfectly parallel to the vertical line. The state in which the Z axis direction is the vertically downward direction includes the state in which the Z axis is inclined with respect to the vertical line except for the state in which the Z axis is parallel to the horizontal direction.

Moreover, in Example 5, the liquid absorbent material 103 is an example of the first portion, and the liquid absorbent material 105 is an example of the second portion. In the tank 9E of Example 5, the liquid absorbent material 103 and the liquid absorbent material 105 are constituted separately from each other. However, the configuration of the tank 9E is not limited thereto. As the configuration of the tank 9E, a configuration in which the liquid absorbent material 103 and the liquid absorbent material 105 are constituted integrally with each other can also be adopted.

EXAMPLE 6

Figure 17:
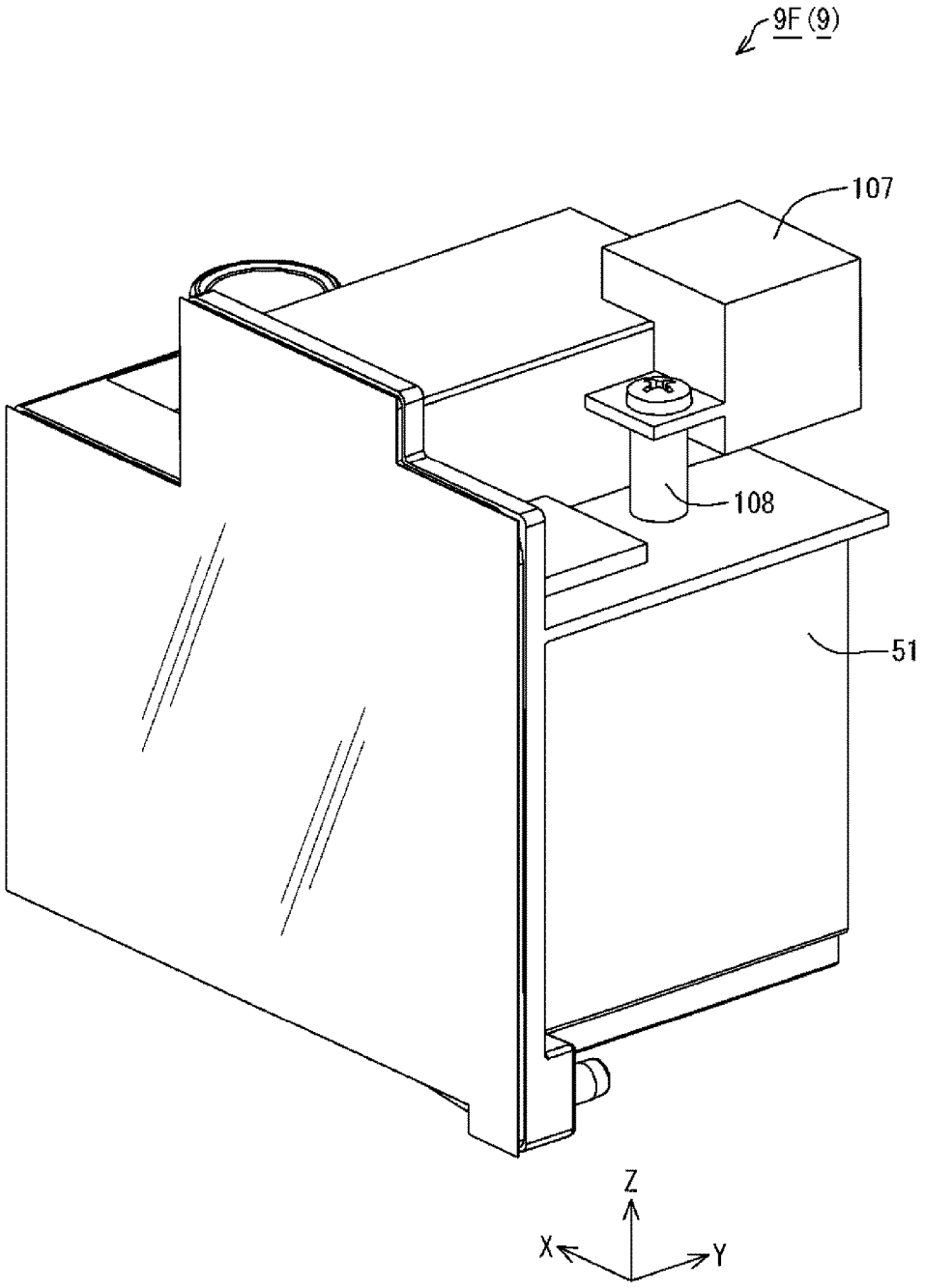
FIG. 17 is a perspective view showing a tank in Example 6.

A tank 9F of Example 6 has a positioning member 107 and a coupling portion 108 as shown in FIG. 17. The tank 9F of Example 6 has a configuration in which the positioning member 107 and the coupling portion 108 are added to one of the tanks 9 of Example 2 to Example 5. Except for that point, the tank 9F of Example 6 has the same configuration as the tanks 9 of Example 2 to Example 5. Therefore, in the following description, the same reference signs as Example 2 to Example 5 are given to the same constituent elements as Example 2 to Example 5, and detailed description thereof is omitted.

Figure 18:
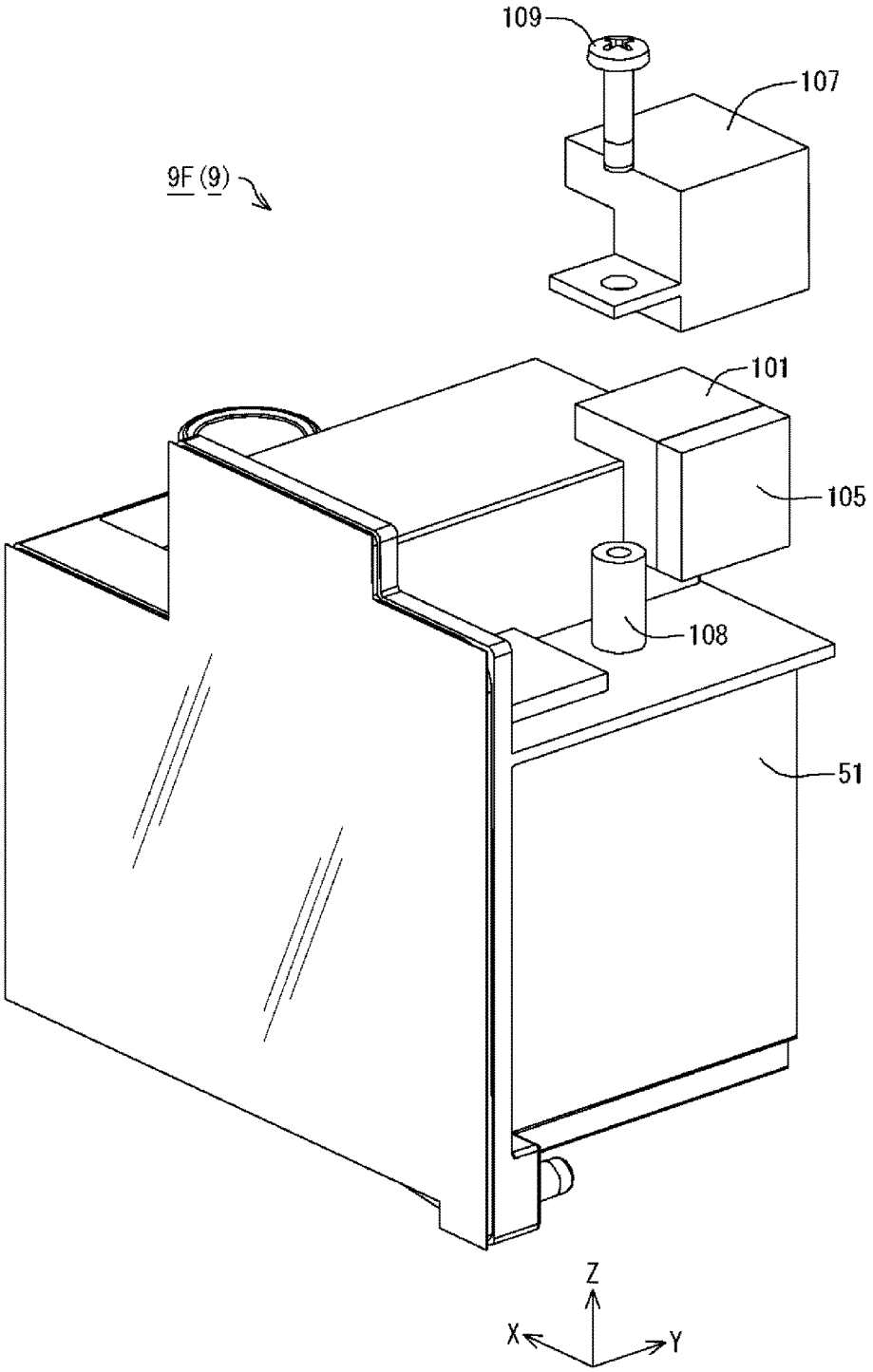
FIG. 18 is an exploded perspective view showing the tank in Example 6.

The positioning member 107 is formed to have a hollow shape as shown in FIG. 18, and is constituted so as to be able to house the liquid absorbent material 101 and the liquid absorbent material 105. The coupling portion 108 is a portion to which the positioning member 107 is coupled, and is provided on the case 51. Note that as a mode in which the coupling portion 108 is arranged on the case 51, a mode in which the coupling portion 108 is joined to the case 51, a mode in which the coupling portion 108 is formed integrally with the case 51 and the like can be adopted. Furthermore, as a joining method in the case of the mode in which the coupling portion 108 is joined to the case 51, various methods such as bonding, welding, fitting, and screwing can be adopted.

In the state of covering the liquid absorbent material 101 and the liquid absorbent material 105, the positioning member 107 is coupled to the coupling portion 108 using a screw 109 or the like. Note that the coupling between the positioning member 107 and the coupling portion 108 is not limited to coupling using the screw 109. As a mode in which the positioning member 107 and the coupling portion 108 are coupled, for example, a mode in which the positioning member 107 is joined to the coupling portion 108 can also be adopted. As a joining method in this case, various methods such as bonding, welding and fitting can be adopted. In Example 6 as well, the same effect as Example 2 to Example 5 is obtained.

Furthermore, in Example 6, the position of the liquid absorbent material 101 and the position of the liquid absorbent material 105 with respect to the case 51 can be determined by the positioning member 107. Moreover, in the tank 9F of Example 6, the liquid absorbent material 101 and the liquid absorbent material 105 can be held by the positioning member 107. Therefore, joining of the liquid absorbent material 101 to the case 51, joining of the liquid absorbent material 105 to the liquid absorbent material 101 and the like can be omitted. In addition, in the tank 9F of Example 6, the liquid absorbent material 101 and the liquid absorbent material 105 can be housed in the positioning member 107. Therefore, the liquid absorbent material 101 and the liquid absorbent material 105 can be protected by the positioning member 107.

Note that the tank 9F of Example 6 is applicable to each of the tanks 9 of Example 2 to Example 5. For example, in the case where the tank 9F of Example 6 is applied to the tank 9 of Example 2, the position of the liquid absorbent material 101 can be determined by the positioning member 107, and the liquid absorbent material 101 can be held by the positioning member 107. The tank 9F of Example 6 can be similarly applied to each of the tanks 9 of Example 3 to Example 5.

EXAMPLE 7

Figure 19:
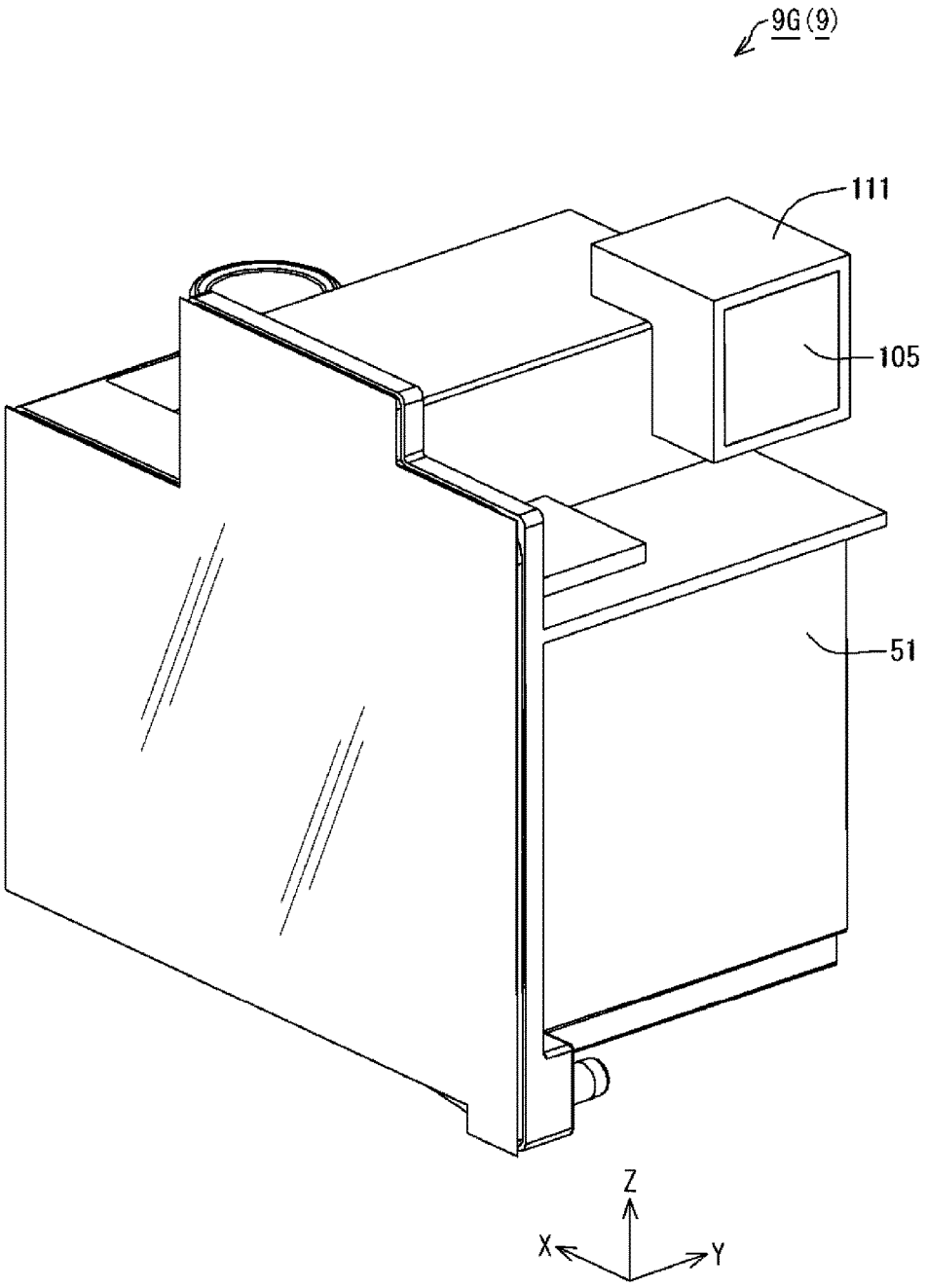
FIG. 19 is a perspective view showing a tank in Example 7

A tank 9G of Example 7 has an absorbent material housing part 111 as shown in FIG. 19. The tank 9G of Example 7 has a configuration in which the absorbent material housing part 111 is added to any of the tanks 9 of Example 2 to Example 5. Except for that point, the tank 9G of Example 7 has the same configuration as the tanks 9 of Example 2 to Example 5. Therefore, in the following description, the same reference signs as Example 2 to Example 5 are added to the same constituent elements as Example 2 to Example 5, and detailed description thereof is omitted.

Figure 20:
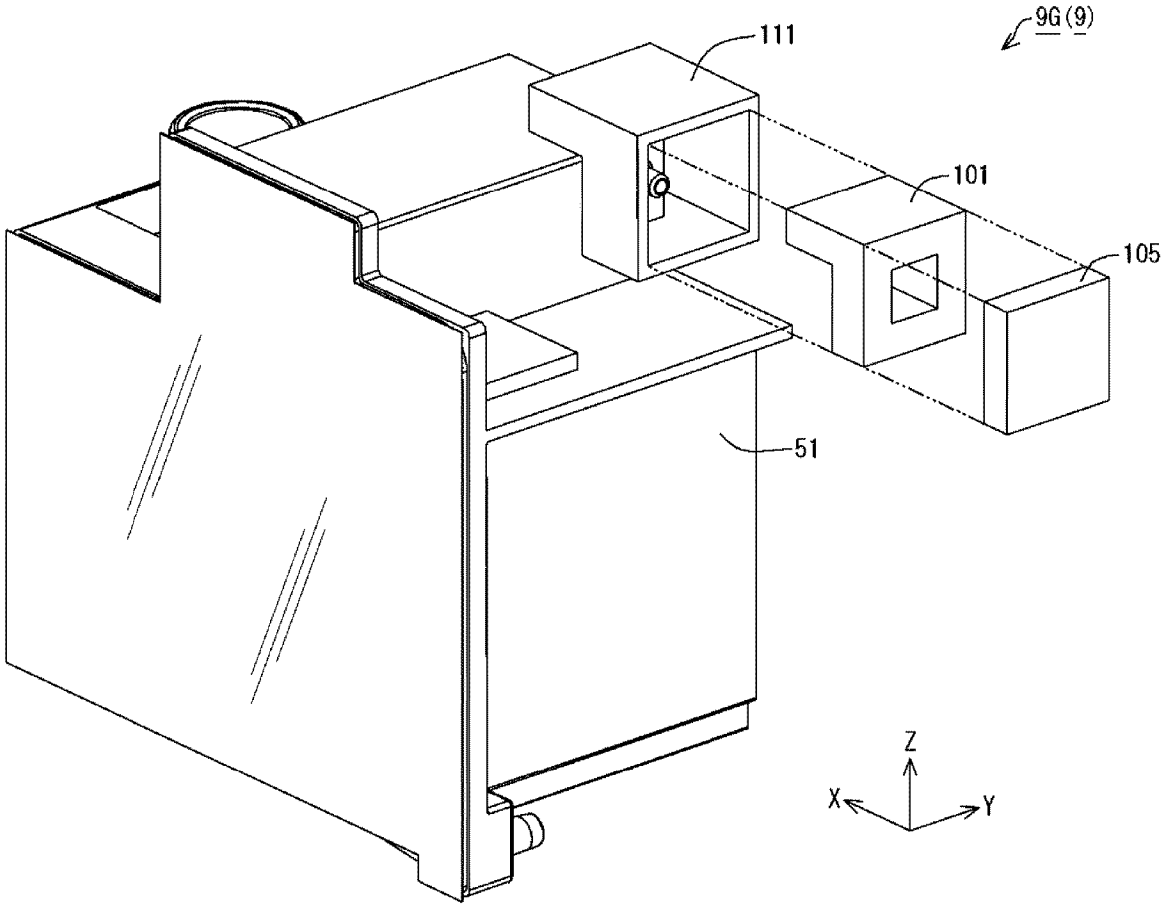
FIG. 20 is an exploded perspective view showing the tank in Example 7.

The absorbent material housing part 111 is formed to have a hollow shape as shown in FIG. 20, and is constituted so as to be able to house the liquid absorbent material 101 and the liquid absorbent material 105. Note that as a mode in which the absorbent material housing part 111 is arranged on the case 51, a mode in which the absorbent material housing part 111 is joined to the case 51, a mode in which the absorbent material housing part 111 is formed integrally with the case 51 and the like can be adopted. Furthermore, as a joining method in the case of the mode in which the absorbent material housing part 111 is joined to the case 51, various methods such as bonding, welding, fitting and screwing can be adopted. In Example 7 as well, the same effect as Example 2 to Example 5 is obtained.

Furthermore, in Example 7, the position of the liquid absorbent material 101 and the position of the liquid absorbent material 105 with respect to the case 51 can be determined using the absorbent material housing part 111. In addition, in the tank 9G of Example 7, the liquid absorbent material 101 and the liquid absorbent material 105 can be held by the absorbent material housing part 111. Therefore, joining of the liquid absorbent material 101 to the case 51, joining of the liquid absorbent material 105 to the liquid absorbent material 101 and the like can be omitted. Moreover, in the tank 9G of Example 7, the liquid absorbent material 101 and the liquid absorbent material 105 can be housed in the absorbent material housing part 111. Therefore, the liquid absorbent material 101 and the liquid absorbent material 105 can be protected by the absorbent material housing part 111.

Note that the tank 9G of Example 7 is applicable to each of the tanks 9 of Example 2 to Example 5. For example, in the case where the tank 9G of Example 7 is applied to the tank 9 of Example 2, the position of the liquid absorbent material 101 can be determined using the absorbent material housing part 111, and the liquid absorbent material 101 can be held by the absorbent material housing part 111. The tank 9G of Example 7 can be similarly applied to each of the tanks 9 of Example 3 to Example 5.

EXAMPLE 8

Figure 21:
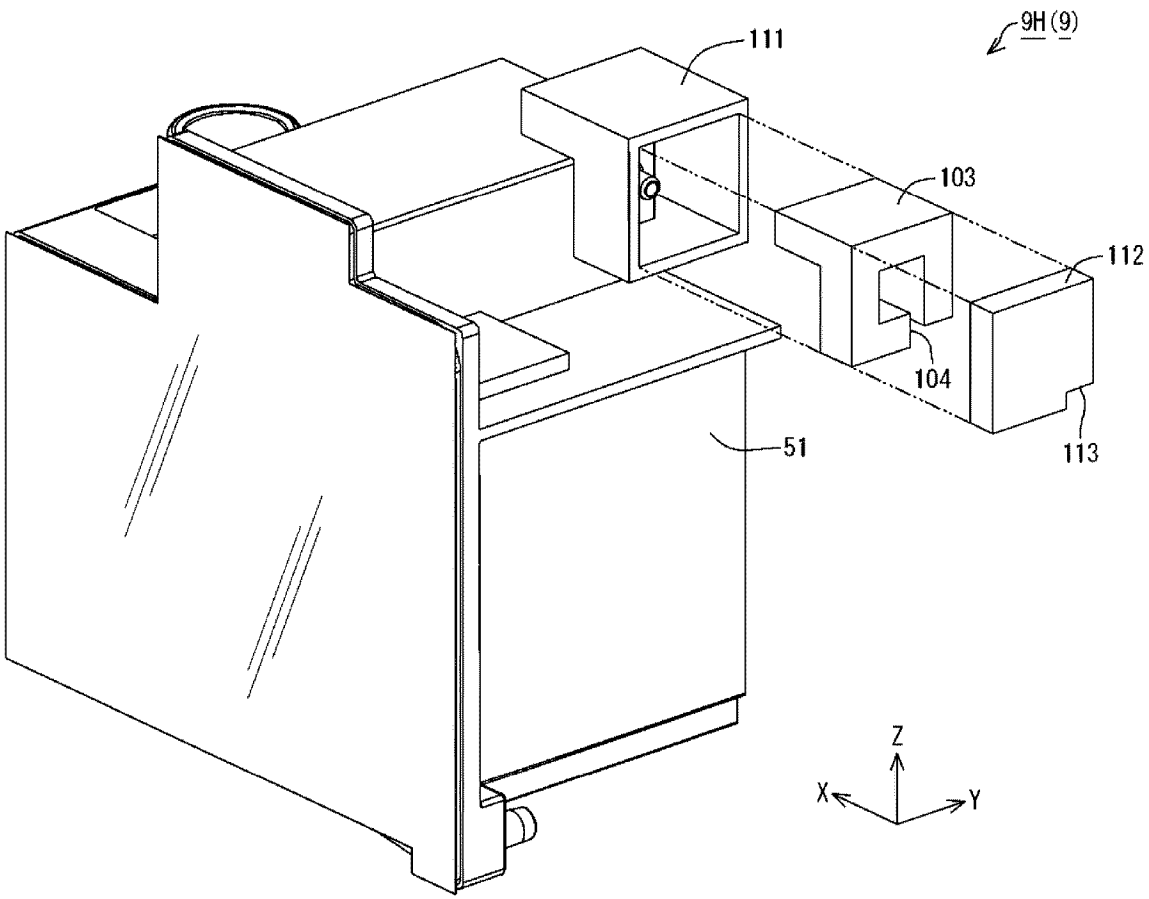
FIG. 21 is an exploded perspective view showing a tank in Example 8.

A tank 9H of Example 8 has the absorbent material housing part 111, the liquid absorbent material 103 and a liquid absorbent material 112 as shown in FIG. 21. The tank 9H of Example 8 has a configuration in which the absorbent material housing part 111 and the liquid absorbent material 112 are added to the tank 9C of Example 3 (FIG. 11). Except for that point, the tank 9H of Example 8 has the same configuration as the tank 9C of Example 3. Therefore, in the following description, the same reference signs as Example 1 to Example 3 are given to the same constituent elements as Example 1 to Example 3, and detailed description thereof is omitted. Also, the absorbent material housing part 111 has the same configuration as Example 7. Therefore, detailed description of the absorbent material housing part 111 is omitted. In Example 8 as well, the same effect as Example 7 is obtained.

A notch portion 113 is formed on the liquid absorbent material 112. The liquid absorbent material 112 has a configuration in which the notch portion 113 is formed on the liquid absorbent material 105 (FIG. 14). In other words, except that the notch portion 113 is formed, the liquid absorbent material 112 has the same configuration as the liquid absorbent material 105. In the state where the tank 9H is viewed in a planar view in the X axis direction, the notch portion 113 of the liquid absorbent material 112 is formed in an area overlapping at least a portion of the opening portion 104 of the liquid absorbent material 103. Accordingly, when the tank 9H is viewed in a planar view in the X axis direction, at least a portion of the opening portion 104 of the liquid absorbent material 103 is open to the atmospheric air via the notch portion 113 of the liquid absorbent material 112. Therefore, in Example 8, the open air port 66 is easily opened to the atmospheric air via the opening portion 104 of the liquid absorbent material 103 and the notch portion 113 of the liquid absorbent material 112.

EXAMPLE 9

Figure 22:
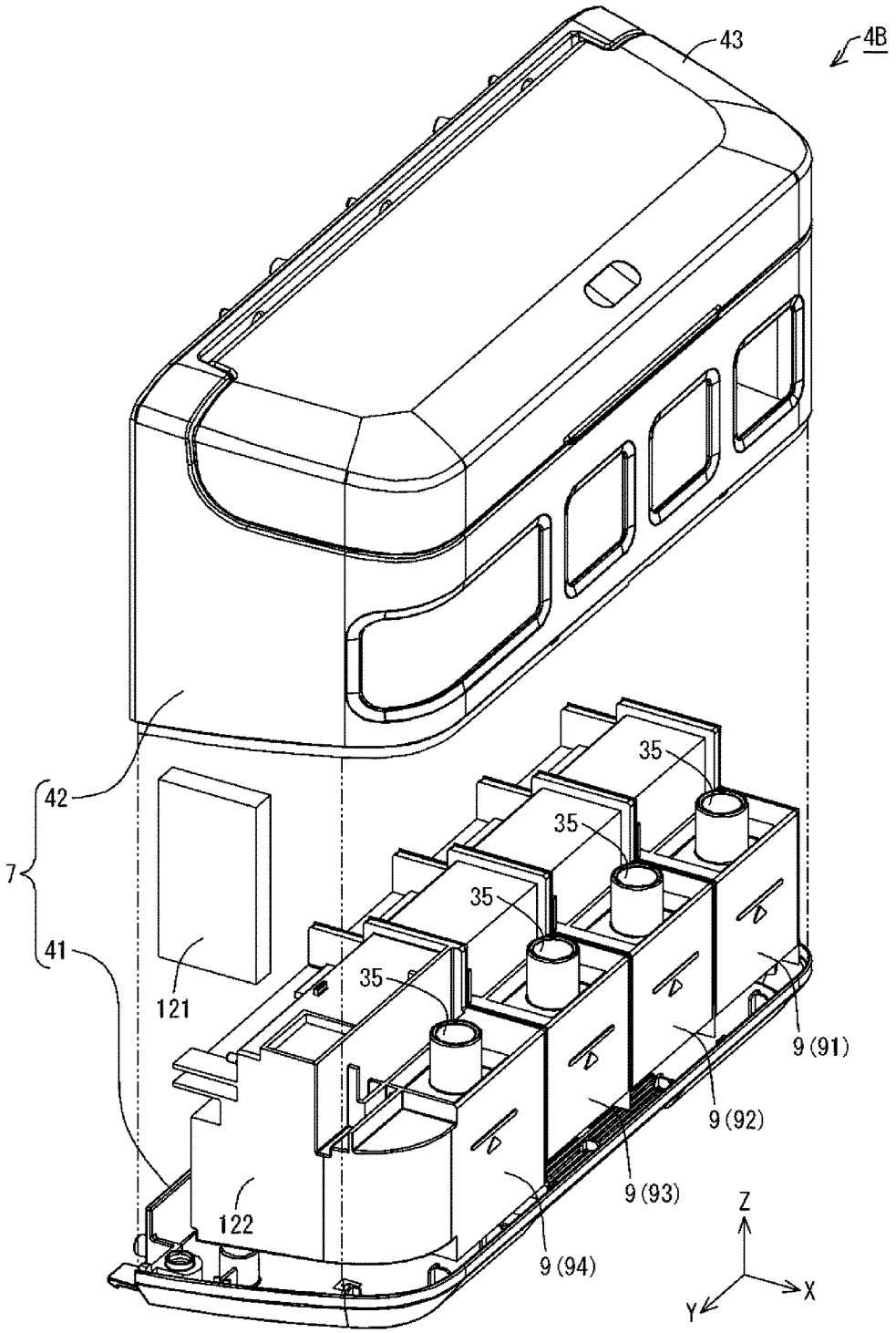
FIG. 22 is an exploded perspective view showing a main configuration of an ink supply device in Example 9.

An ink supply device 4B of Example 9 has a liquid absorbent material 121 as shown in FIG. 22. The ink supply device 4B of Example 9 has a configuration in which the liquid absorbent material 121 is added to the ink supply device 4A (FIG. 4). Except for that point, the ink supply device 4B of Example 9 has the same configuration as the ink supply device 4A. Therefore, in the following description, the same reference signs as the ink supply device 4A are given to the same constituent elements as the ink supply device 4A, and detailed description thereof is omitted.

The liquid absorbent material 121 is housed in the casing 7 along with the tanks 9. The liquid absorbent material 121 has a property of absorbing liquid and holding the absorbed liquid. As the material of the liquid absorbent material 121, various materials such as foam, felt and a nonwoven fabric can be adopted. Within the casing 7, the liquid absorbent material 121 is positioned between the tank 94 among the tanks 9 and the second casing 42. Therefore, the liquid absorbent material 121 is positioned in the Y axis direction relative to the tanks 9.

When the ink supply device 4B is viewed in the −Y axis direction, the liquid absorbent material 121 has a size so as to be within an area overlapping the tank 94. Therefore, when the ink supply device 4B is viewed in the −Y axis direction, the liquid absorbent material 121 does not project from the area overlapping the tank 94. In the ink supply device 4B, the liquid absorbent material 121 is arranged between the casing 7 and a side portion 122 of the tank 94. In this example, the side portion 122 is a surface of the tank 94 that faces in the Y axis direction. The liquid absorbent material 121 having the above-described configuration is housed in the casing 7 so as to come in contact with the side portion 122 of the tank 94, or be able to absorb ink that has leaked from the open air port 66 of the tank 94 even if the liquid absorbent material 121 does not come in contact with the side portion 122, when the ink supply device 4B falls over or is inclined such that the casing 7 on the side on which the liquid absorbent material 121 is arranged (a portion of the casing 7 that faces the side portion 122) is placed downward.

Figure 23:
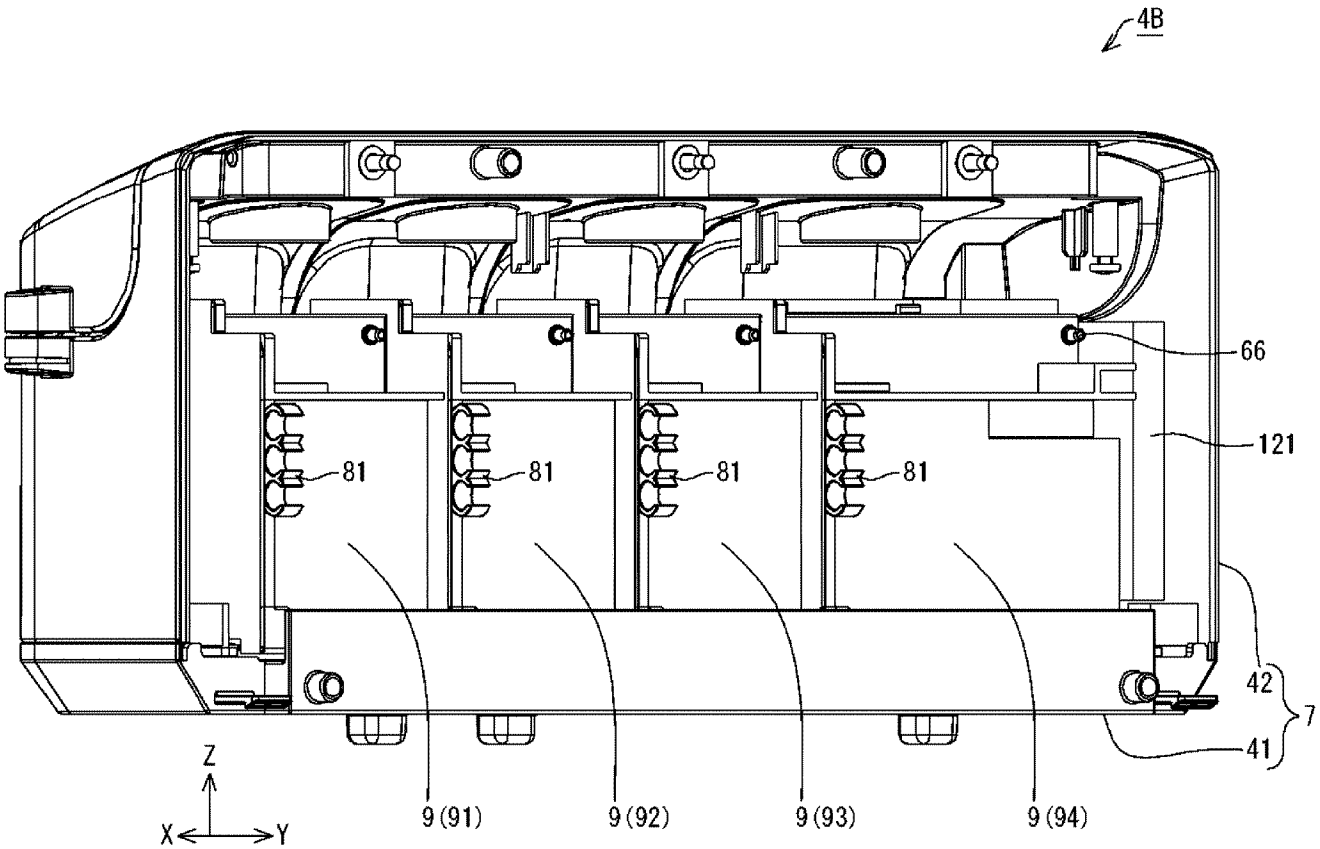
FIG. 23 is a perspective view showing the main configuration of the ink supply device in Example 9.

In the casing 7, the liquid absorbent material 121 is positioned over the range of height from the first casing 41 to the open air port 66 of the tank 94 as shown in FIG. 23. In the ink supply device 4B, in the use orientation of the tank 9, the liquid absorbent material 121 is positioned at the height of the open air port 66. Therefore, even if ink leaks out from the open air port 66, the leaked ink is easily absorbed by the liquid absorbent material 121. Accordingly, the possibility of soiling caused by the ink leakage can be suppressed to a low level.

Note that from the viewpoint of absorbing the ink that has leaked from the open air port 66 using the liquid absorbent material 121, it is sufficient that the liquid absorbent material 121 is positioned at least at the height of the open air port 66. Therefore, the liquid absorbent material 121 does not need to be arranged over the range of height from the first casing 41 to the open air port 66 of the tank 94. For example, with a configuration in which the liquid absorbent material 121 is arranged only in the area overlapping the open air port 66 of the tank 94 in the state in which the ink supply device 4B is viewed in the −Y axis direction as well, the possibility of soiling caused by the ink leakage can be reduced.

In addition, the above-described tube holding portion 81 may be provided for all of the tanks 9, or may be provided for at least one of the tanks 9. In an ink supply device 4 having the tanks 9 provided with the tube holding portion 81, it is sufficient that the ink supply tubes 36 (FIG. 3) are inserted into the tube holding portions 81, and thus the ink supply tubes 36 can be easily fixed during assembly.

In the ink supply device 4B, if the position of the liquid absorbent material 121 is fixed with respect to the tank 94, displacement of the position of the liquid absorbent material 121 with respect to the open air port 66 of the tank 94 can be suppressed to a low level. Therefore, it is preferred to fix the position of the liquid absorbent material 121 with respect to the tank 94. As a method for fixing the position of the liquid absorbent material 121 with respect to the tank 94, a method for joining the liquid absorbent material 121 to the tank 94, a method for joining the liquid absorbent material 121 to the casing 7, or a method for joining the liquid absorbent material 121 to both the tank 94 and the casing 7 can be adopted. As a joining method in these cases, various joining methods such as bonding, welding and attachment using an adhesive tape can be adopted. Also, as a method for positioning the liquid absorbent material 121 between the tank 94 and the casing 7, a method for press-fitting the liquid absorbent material 121 between the tank 94 and the casing 7 can also be adopted. Examples of the method for positioning the liquid absorbent material 121 between the casing 7 and the tank 94 (hereinafter, referred to as a positioning examples) will be described below.

POSITIONING EXAMPLE 1

Figure 24:
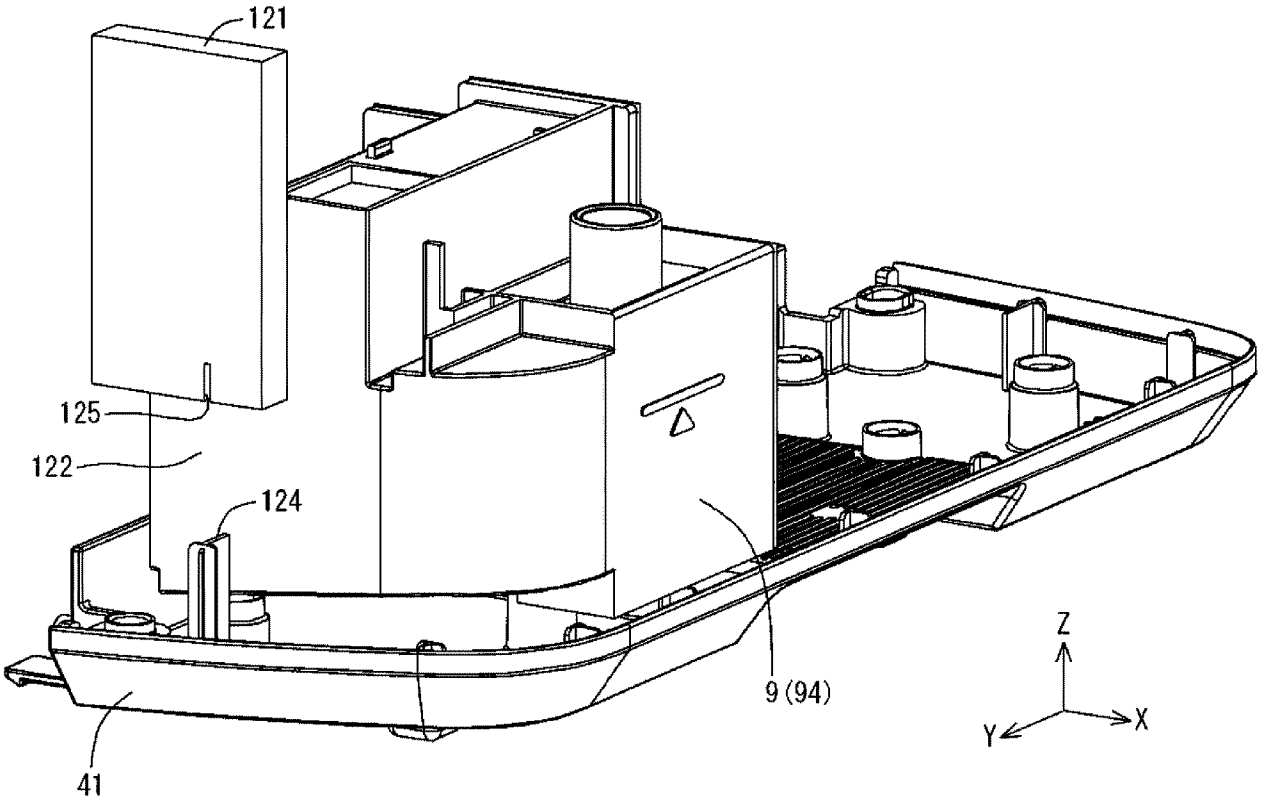
FIG. 24 is an exploded perspective view showing a main configuration of Positioning Example 1.

In Positioning Example 1, the first casing 41 has a positioning part 124 as shown in FIG. 24. The positioning part 124 is provided at the bottom of the first casing 41, and protrudes from the first casing 41 in the Z axis direction. The positioning part 124 is positioned in the Y axis direction relative to the side portion 122 of the tank 94. If the first casing 41 and the second casing 42 (FIG. 22) are combined, the positioning part 124 is hidden within the casing 7. Therefore, the positioning part 124 is positioned between the tank 94 and the casing 7.

As shown in FIG. 24, in Positioning Example 1, a slit 125 is formed in the liquid absorbent material 121. The positioning part 124 and the slit 125 are constituted so as to be able to be fitted with each other. The liquid absorbent material 121 is fitted with the positioning part 124 by inserting the positioning part 124 into the slit 125 in the Z axis direction. Accordingly, a position of the liquid absorbent material 121 with respect to the tank 94 can be determined. The ink supply device 4B in which the configuration of Positioning Example 1 is adopted is an example of a liquid supply device having the positioning part 124.

Note that the function of the positioning part 124 of Positioning Example 1 is not limited to the function of determining the position of the liquid absorbent material 121. The positioning part 124 may also have a positioning function of determining a position between the first casing 41 and the second casing 42 when combining the first casing 41 and the second casing 42 (FIG. 22), and the like. In addition, the positioning part 124 may also have a coupling function for coupling the first casing 41 and the second casing 42 (FIG. 22), and the like.

Moreover, in Positioning Example 1, the positioning part 124 is provided on the first casing 41. However, the location in which the positioning part 124 is provided is not limited to the first casing 41, and the second casing 42 can also be adopted. Furthermore, a configuration in which both the first casing 41 and the second casing 42 are provided with the positioning part 124 can also be adopted.

POSITIONING EXAMPLE 2

Figure 25:
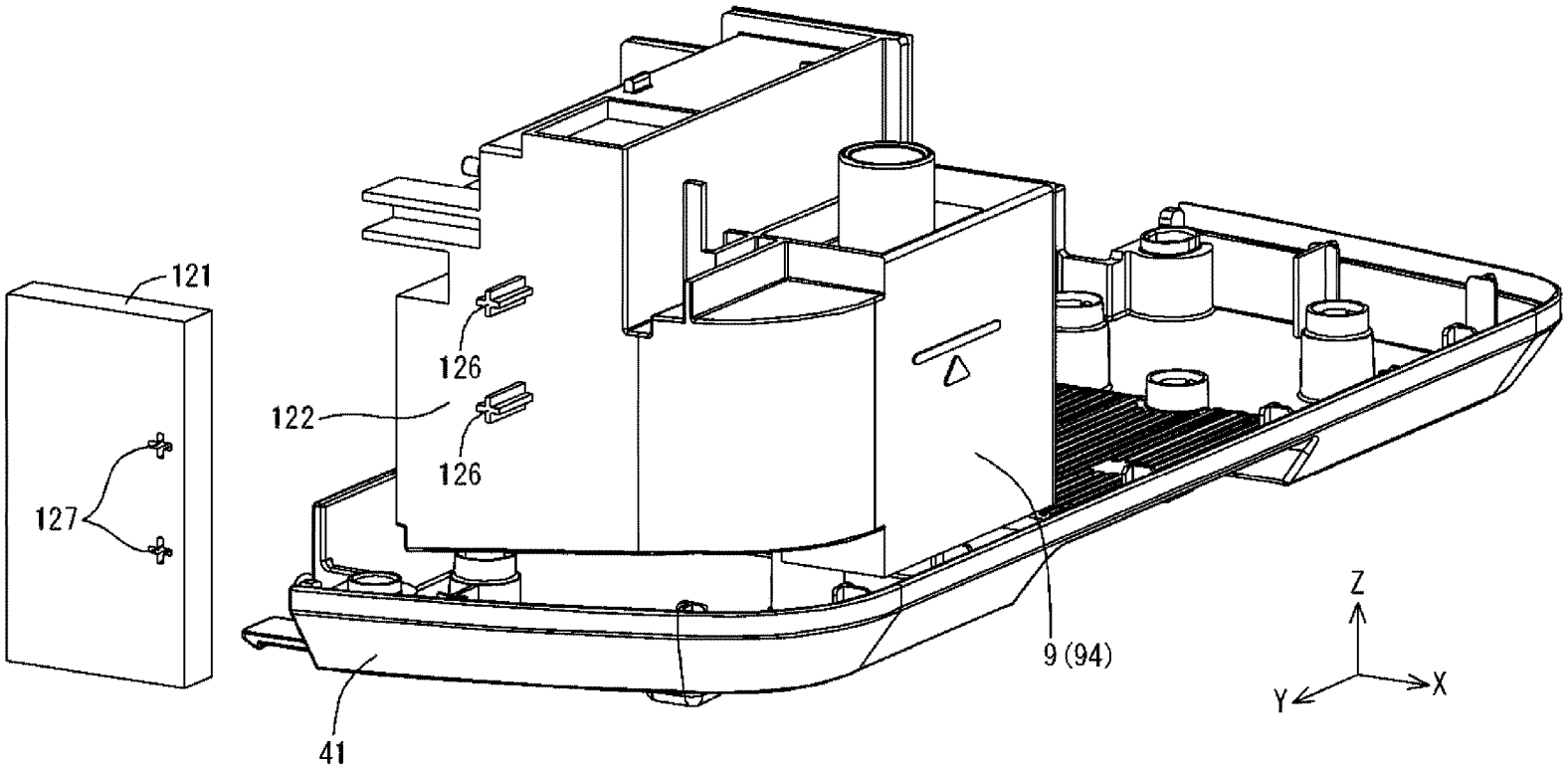
FIG. 25 is an exploded perspective view showing a main configuration of Positioning Example 2.

In Positioning Example 2, as shown in FIG. 25, the tank 94 has positioning parts 126. In an example shown in FIG.

25, the tank 94 has two positioning parts 126. However, the number of the positioning parts 126 is not limited thereto, and one positioning part or three or more positioning parts can also be adopted. The positioning parts 126 are provided on the side portion 122 of the tank 94, and protrude from the side portion 122 in the Y axis direction. When combining the first casing 41 and the second casing 42 (FIG. 22), the positioning parts 126 are hidden within the casing 7. Therefore, the positioning parts 126 are positioned between the tank 94 and the casing 7.

As shown in FIG. 25, in Positioning Example 2, fitting holes 127 are formed in the liquid absorbent material 121. In this example, two fitting holes 127 are formed in the liquid absorbent material 121 in correspondence with the number of the positioning parts 126. The number of the fitting holes 127 can be increased or decreased in accordance with the number of the positioning parts 126. The positioning parts 126 and the fitting holes 127 are constituted so as to be able to be fitted with each other. The liquid absorbent material 121 is fitted with the positioning parts 126 by inserting the positioning parts 126 into the fitting hole 127 in the Y axis direction. Accordingly, a position of the liquid absorbent material 121 with respect to the tank 94 can be determined. The ink supply device 4B in which the configuration of Positioning Example 2 is adopted is an example of a liquid supply device having the positioning parts 126.

Note that in Positioning Example 2, the positioning parts 126 are provided on the tank 94. However, a location in which the positioning parts 126 are provided is not limited to the tank 94, and the second casing 42 can also be adopted. Furthermore, a configuration in which the positioning parts 126 are provided on both the tank 94 and the second casing 42 can also be adopted.

EXAMPLE 10

Figure 26:
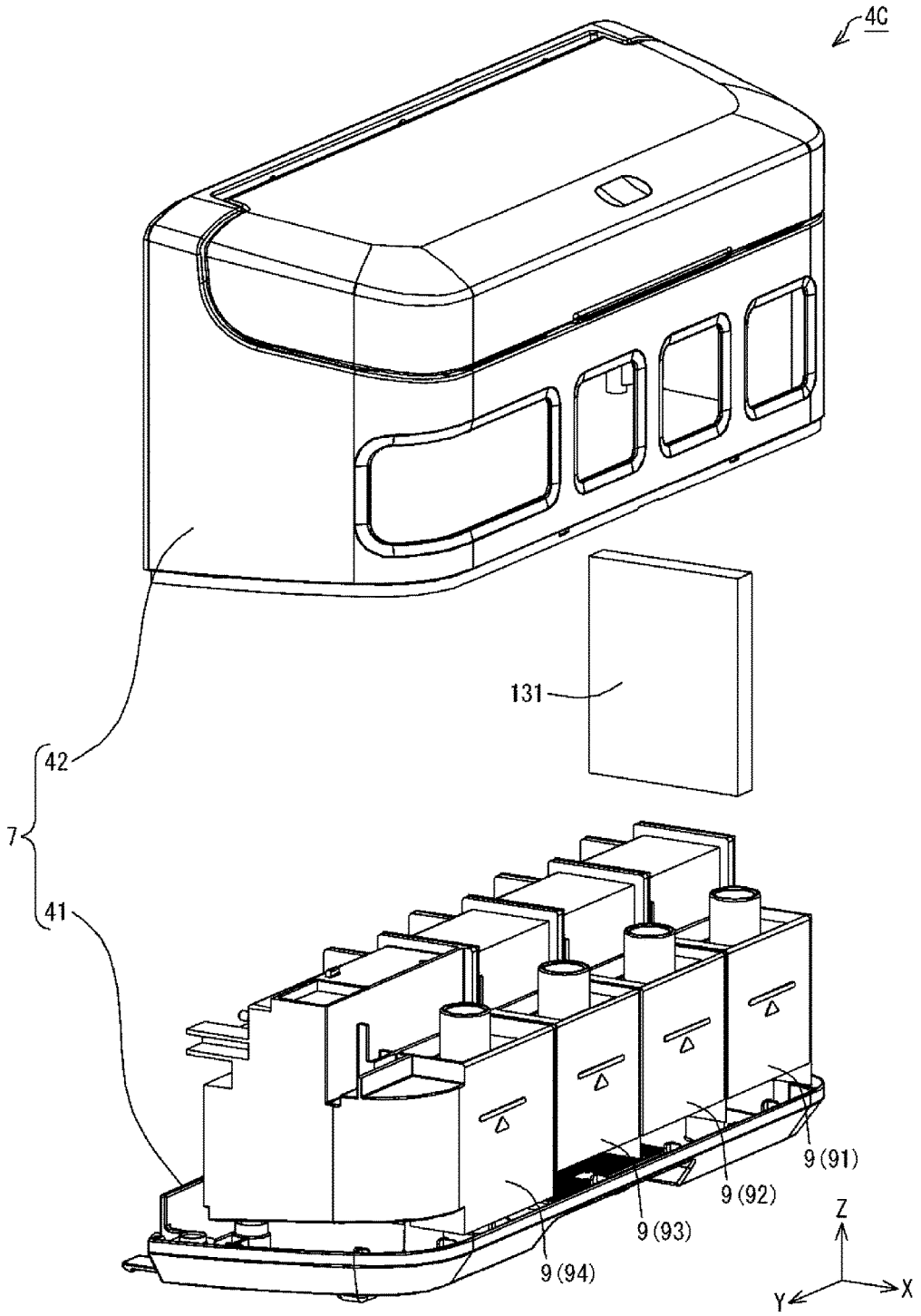
FIG. 26 is an exploded perspective view showing a main configuration of an ink supply device in Example 10.

An ink supply device 4C of Example 10 has a liquid absorbent material 131 as shown in FIG. 26. The ink supply device 4C of Example 10 has a configuration in which the liquid absorbent material 131 is added to the ink supply device 4A (FIG. 4). Except for that point, the ink supply device 4C of Example 10 has the same configuration as the ink supply device 4A. Therefore, in the following description, the same reference signs as the ink supply device 4A are given to the same constituent elements as the ink supply device 4A, and detailed description thereof is omitted.

The liquid absorbent material 131 is housed in the casing 7 along with the tanks 9. The liquid absorbent material 131 has a property of absorbing liquid and holding the absorbed liquid. As the material of the liquid absorbent material 131, various materials such as foam, felt and a nonwoven fabric can be adopted. The liquid absorbent material 131 is positioned between the tank 91 among the tanks 9 and the second casing 42, in the casing 7. Therefore, the liquid absorbent material 131 is positioned in the −Y axis direction relative to the tanks 9.

When the ink supply device 4C is viewed in the Y axis direction, the liquid absorbent material 131 has a size so as to be within an area overlapping the tank 91. Therefore, when the ink supply device 4C is viewed in the Y axis direction, the liquid absorbent material 131 is not projected from the area overlapping the tank 91. In the ink supply device 4C, the liquid absorbent material 131 is in contact with a side portion of the tank 91. In this example, the side portion of the tank 91 is a surface of the tank 91 that faces in the −Y axis direction. The liquid absorbent material 131 having the above-described configuration is housed in the casing 7 in the state of being in contact with the side portion of the tank 91.

Figure 27:
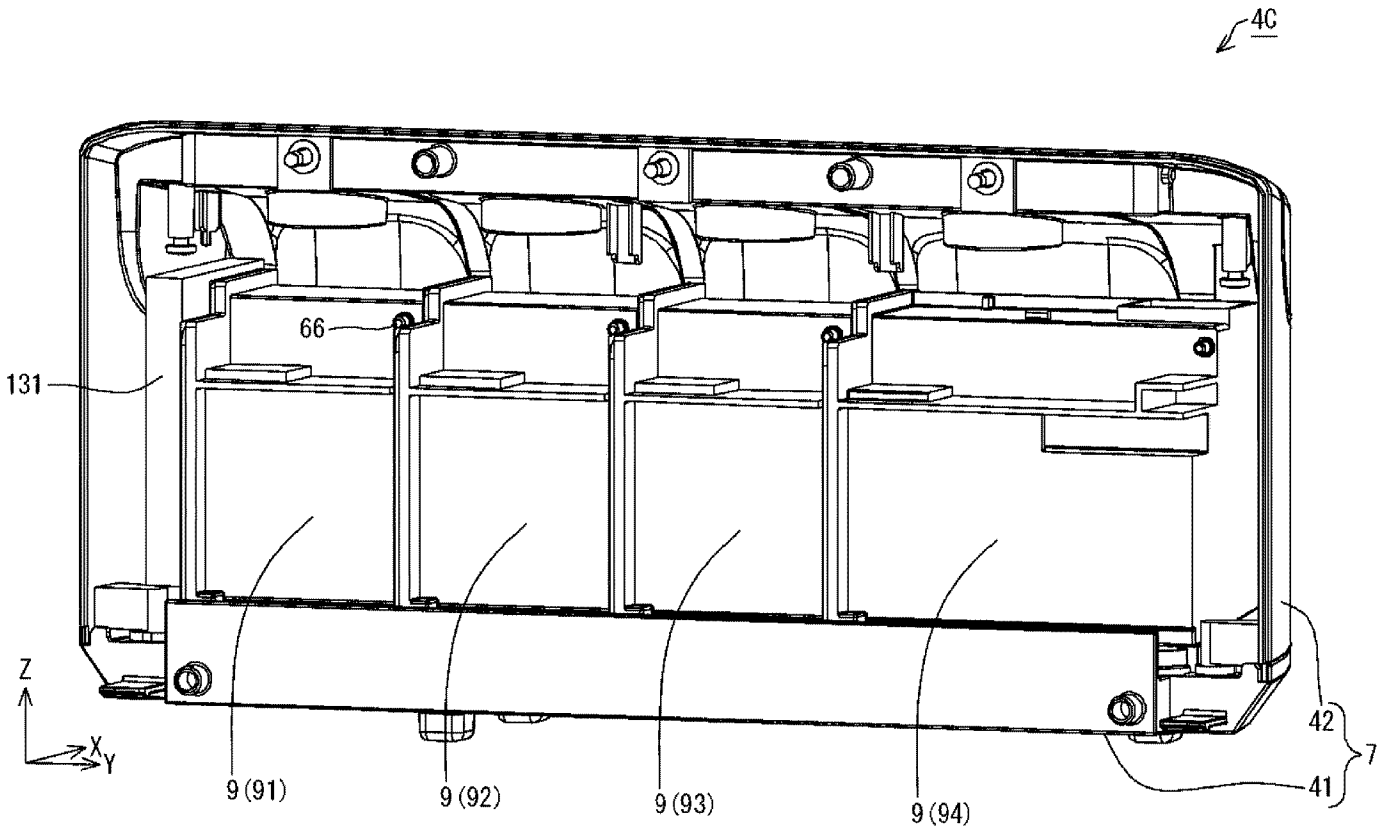
FIG. 27 is a perspective view showing the main configuration of the ink supply device in Example 10.

Within the casing 7, the liquid absorbent material 131 is positioned over the range of height from the first casing 41 to the open air port 66 of the tank 91 as shown in FIG. 27. In the ink supply device 4C, in the use orientation of the tanks 9, the liquid absorbent material 131 is in contact with the side portion of the tank 91, and is positioned at the height of the open air port 66. Therefore, even if ink leaks out from the open air port 66, the leaked ink is easily absorbed by the liquid absorbent material 131. Accordingly, the possibility of soiling caused by the ink leakage can be suppressed to a low level.

Note that from the viewpoint of absorbing the ink that has leaked from the open air port 66 using the liquid absorbent material 131, it is sufficient that the liquid absorbent material 131 is positioned at least at the height of the open air port 66. Therefore, the liquid absorbent material 131 does not need to be arranged over the range of height from the first casing 41 to the open air port 66 of the tank 91. For example, with a configuration in which the liquid absorbent material 131 is arranged only in an area overlapping the open air port 66 of the tank 91 in the state where the ink supply device 4C is viewed in the Y axis direction as well, the possibility of soiling caused by the ink leakage can be reduced.

In the ink supply device 4C, if the position of the liquid absorbent material 131 with respect to the tank 91 is fixed, displacement of the position of the liquid absorbent material 131 with respect to the open air port 66 of the tank 91 can be suppressed to a low level. Therefore, it is preferred to fix the position of the liquid absorbent material 131 with respect to the tank 91. As a method for fixing the position of the liquid absorbent material 131 with respect to the tank 91, a method similar to the method for fixing the position of the liquid absorbent material 121 with respect to the tank 94 in Example 9 can be applied, and thus detailed description thereof is omitted. In addition, as a positioning method for determining the position of the liquid absorbent material 131 with respect to the tank 91, Positioning Example 1 and Positioning Example 2 can be applied, and thus detailed description thereof is omitted.

EXAMPLE 11

Figure 28:
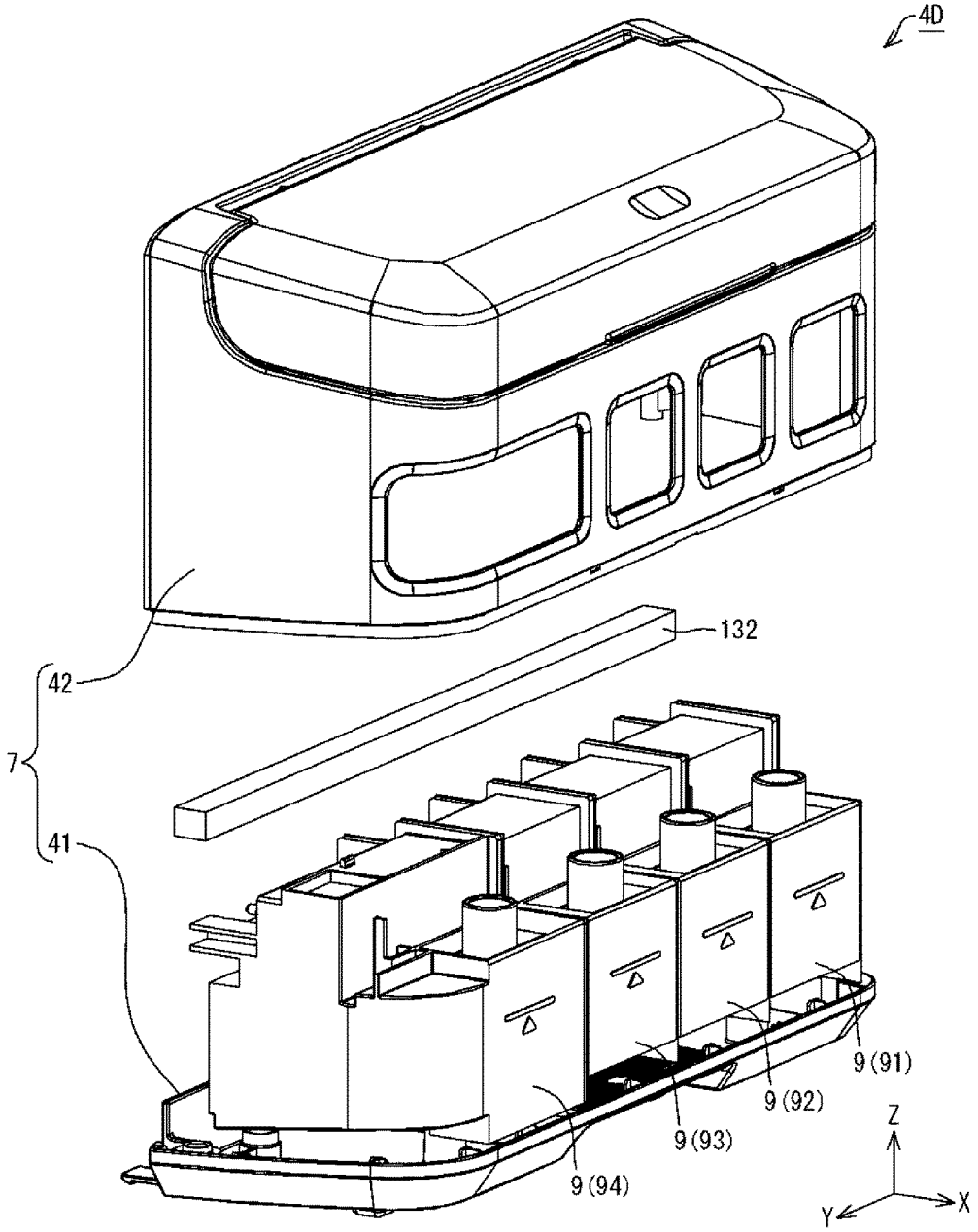
FIG. 28 is an exploded perspective view showing a main configuration of an ink supply device in Example 11.

An ink supply device 4D of Example 11 has a liquid absorbent material 132 as shown in FIG. 28. The ink supply device 4D of Example 11 has a configuration in which the liquid absorbent material 132 is added to the ink supply device 4A (FIG. 4). Except for that point, the ink supply device 4D of Example 11 has the same configuration as the ink supply device 4A. Therefore, in the following description, the same reference signs as the ink supply device 4A are given to the same constituent elements as the ink supply device 4A, and detailed description thereof is omitted.

The liquid absorbent material 132 is housed in the casing 7 along with the tanks 9. The liquid absorbent material 132 has a property of absorbing liquid and holding the absorbed liquid. The liquid absorbent material 132 is an example of a second liquid absorbent material. As the material of the liquid absorbent material 132, various materials such as foam, felt and a nonwoven fabric can be adopted. Within the casing 7, the liquid absorbent material 132 is positioned in the Z axis direction of the tanks 9. Therefore, the liquid absorbent material 132 is positioned above the tanks 9 in the use orientation of the tanks 9.

Figure 29:
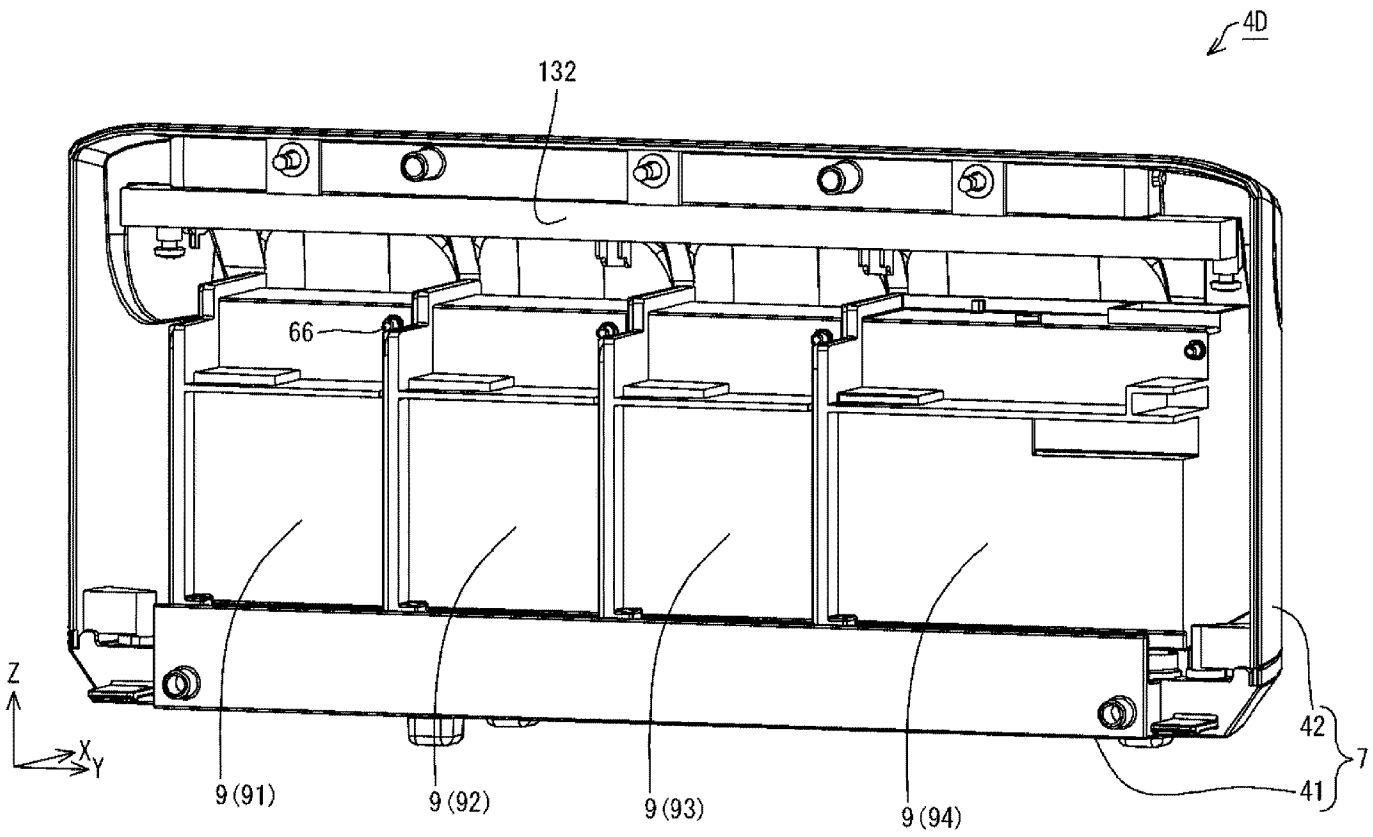
FIG. 29 is a perspective view showing the main configuration of the ink supply device in Example 11.

The liquid absorbent material 132 extends along the Y axis. The liquid absorbent material 132 extends from the tank 91 to the tank 94. Therefore, the liquid absorbent material 132 is positioned between the tanks 9 and the second casing 42. The liquid absorbent material 132 is in contact with the inner side of the second casing 42 above the tanks 9 as shown in FIG. 29. Therefore, in the case where the ink supply device 4D adopts an inverted orientation that is inverted from the use orientation, even if ink that has leaked from the open air port 66 of the tanks 9 adheres to the inner side of the second casing 42, the adhered ink can be absorbed by the liquid absorbent material 132. Accordingly, the possibility of soiling caused by the ink leakage can be suppressed to a low level.

POSITIONING EXAMPLE 3

Figure 30:
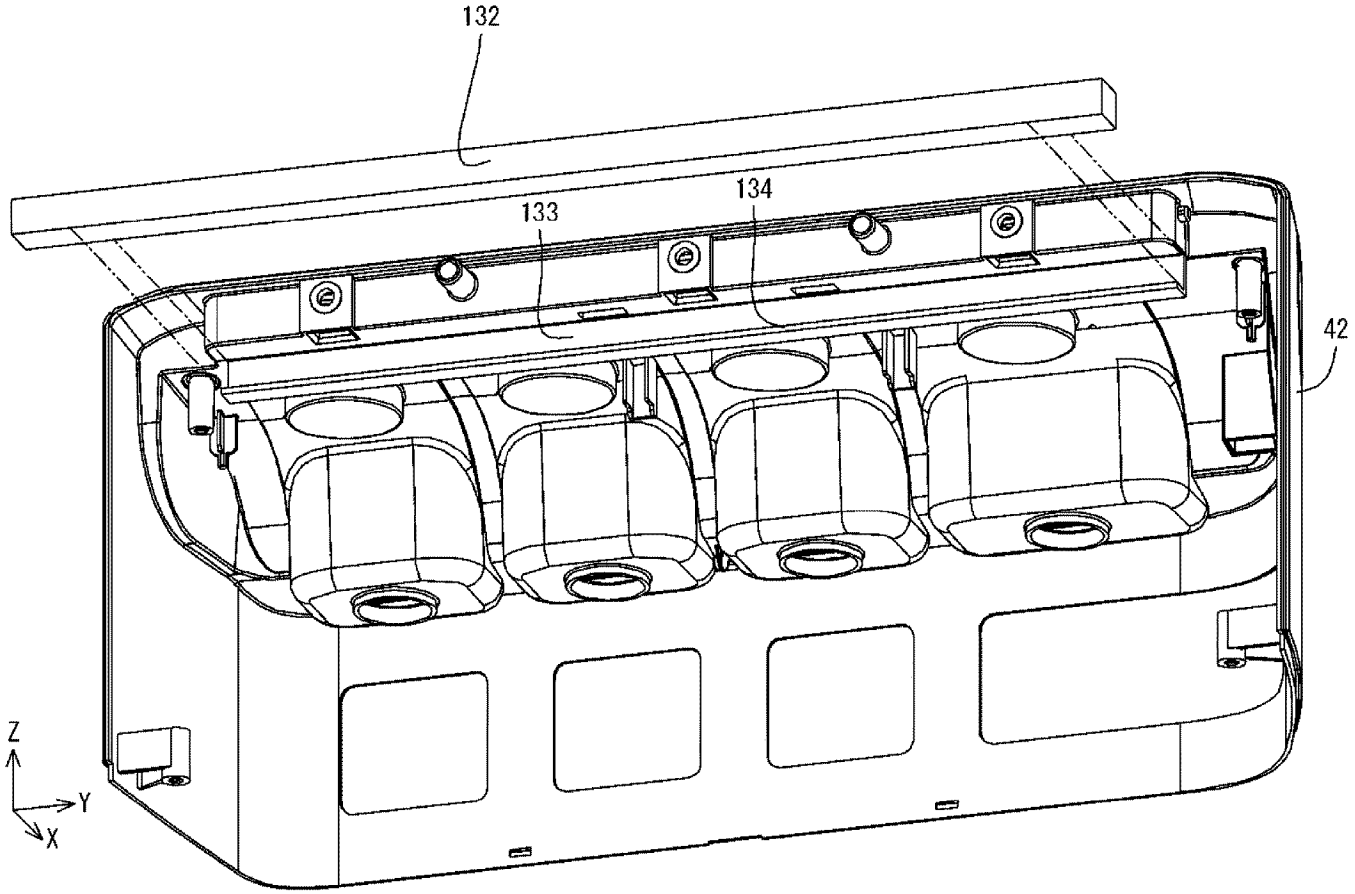
FIG. 30 is an exploded perspective view showing a main configuration of Positioning Example 3.

An example of a positioning method for determining a position of the liquid absorbent material 132 with respect to the second casing 42 will be described. In Positioning Example 3, as shown in FIG. 30, a positioning part 133 is provided on the second casing 42. The positioning part 133 is provided inside the second casing 42, protrudes from inside the second casing 42 in the −Z axis direction, and is curved in the −X axis direction. In the positioning part 133, a portion curved in the −X axis direction constitutes a supporting portion 134 that supports the liquid absorbent material 132. The liquid absorbent material 132 is sandwiched between the internal wall of the second casing 42 and the supporting portion 134 of the positioning part 133. Accordingly, the position of the liquid absorbent material 132 with respect to the second casing 42 can be determined. Note that the positioning part 133 is an example of a second positioning part. Moreover, the ink supply device 4D in which the configuration of Positioning Example 3 is adopted is an example of a liquid supply device having the positioning part 133.

In Positioning Example 3, the positioning part 133 is provided on the second casing 42. However, the location in which the positioning part 133 is provided is not limited to the second casing 42, and the tanks 9 can also be adopted. Furthermore, a configuration in which the positioning part 133 is provided on both the second casing 42 and the tanks 9 can be adopted.

EXAMPLE 12

It is also possible to apply Example 10 that is described above to Example 9. Specifically, a configuration in which the liquid absorbent material 121 and the liquid absorbent material 131 are added to the ink supply device 4A (FIG. 4) can also be adopted. The configuration in which the liquid absorbent material 121 and the liquid absorbent material 131 are added to the ink supply device 4A (FIG. 4) is indicated as an ink supply device 4E of Example 12. With the ink supply device 4E of Example 12, the number of liquid absorbent materials is higher, and thus the possibility of soiling caused by ink leakage can be further suppressed to a low level.

EXAMPLE 13

It is also possible to apply Example 11 that is described above to Example 9. Specifically, a configuration in which the liquid absorbent material 121 and the liquid absorbent material 132 are added to the ink supply device 4A (FIG. 4) can also be adopted. The configuration in which the liquid absorbent material 121 and the liquid absorbent material 132 are added to the ink supply device 4A (FIG. 4) is indicated as an ink supply device 4F of Example 13. With the ink supply device 4F of Example 13, the number of liquid absorbent materials is higher, and thus the possibility of soiling caused by ink leakage can be further suppressed to a low level.

EXAMPLE 14

It is also possible to apply Example 11 that is described above to Example 10. Specifically, a configuration in which the liquid absorbent material 131 and the liquid absorbent material 132 are added to the ink supply device 4A (FIG. 4) can also be adopted. The configuration in which the liquid absorbent material 131 and the liquid absorbent material 132 are added to the ink supply device 4A (FIG. 4) is indicated as an ink supply device 4G of Example 14. With the ink supply device 4G of Example 14, the number of liquid absorbent materials is higher, and thus the possibility of soiling caused by ink leakage can be further suppressed to a low level.

EXAMPLE 15

It is also possible to apply Example 11 and Example 10 that are described above to Example 9. Specifically, a configuration in which the liquid absorbent material 121, the liquid absorbent material 131 and the liquid absorbent material 132 are added to the ink supply device 4A (FIG. 4) can also be adopted. The configuration in which the liquid absorbent material 121, the liquid absorbent material 131 and the liquid absorbent material 132 are added to the ink supply device 4A (FIG. 4) is indicated as an ink supply device 4H of Example 15. With the ink supply device 4H of Example 15, the possibility of soiling caused by ink leakage can be further suppressed to a low level.

EXAMPLE 16

Figure 31:
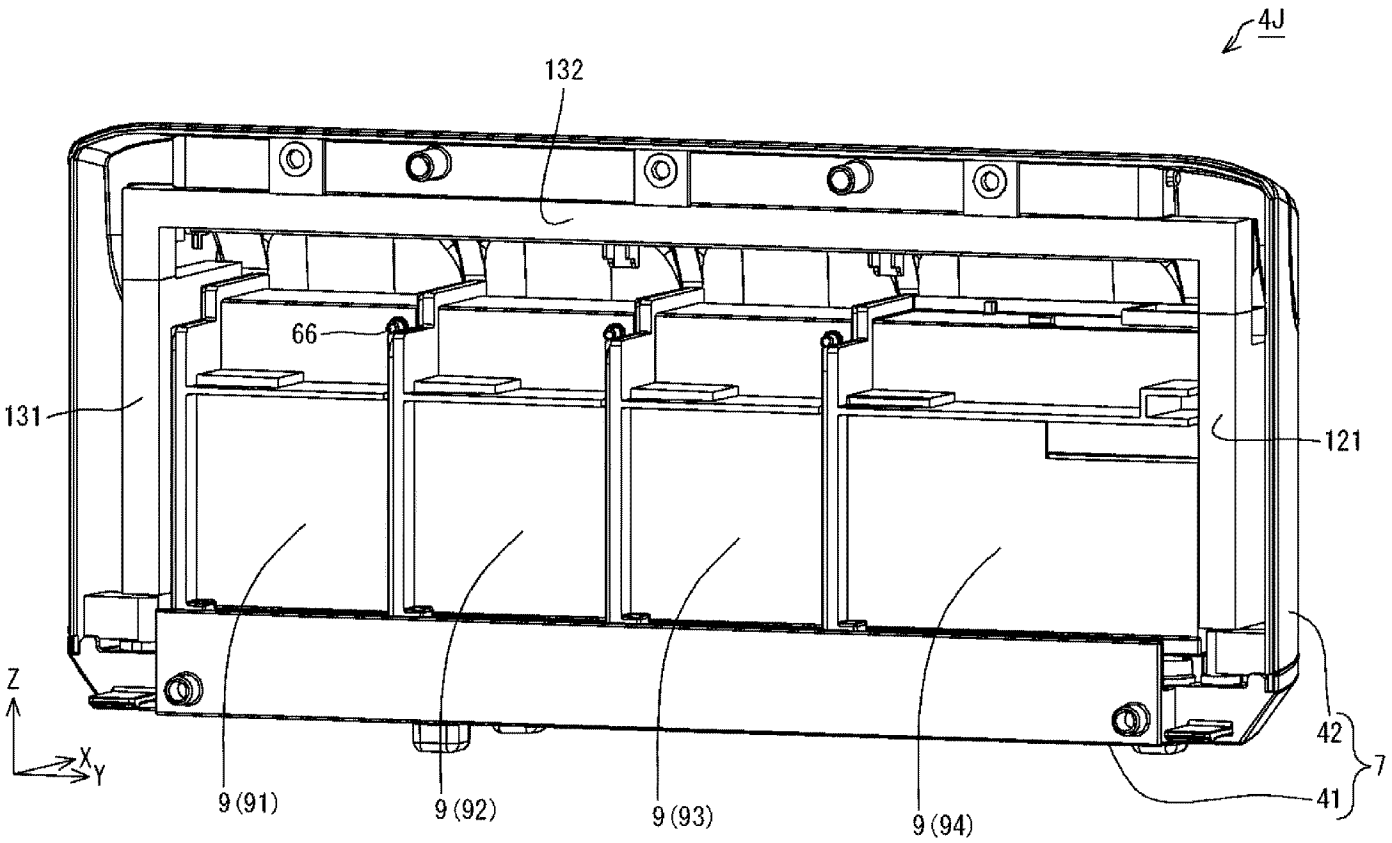
FIG. 31 is a perspective view showing a main configuration of an ink supply device in Example 16.

A configuration in which the liquid absorbent material 121, the liquid absorbent material 131 and the liquid absorbent material 132 are in contact with one another as shown in FIG. 31 in Example 15 that is described above can also be adopted. The configuration in which the liquid absorbent material 121, the liquid absorbent material 131 and the liquid absorbent material 132 are in contact with one another is indicated as an ink supply device 4J of Example 16. In the ink supply device 4J of Example 16, the liquid absorbent material 121 and the liquid absorbent material 132 are in contact with each other, and the liquid absorbent material 132 and the liquid absorbent material 131 are in contact with each other. With the ink supply device 4J of Example 16, the volume of the liquid absorbent materials can be increased, and thus the ability to absorb liquid can be improved. Therefore, with the ink supply device 4J of Example 16, the possibility of soiling caused by ink leakage can be further suppressed to a low level.

EXAMPLE 17

Figure 32:
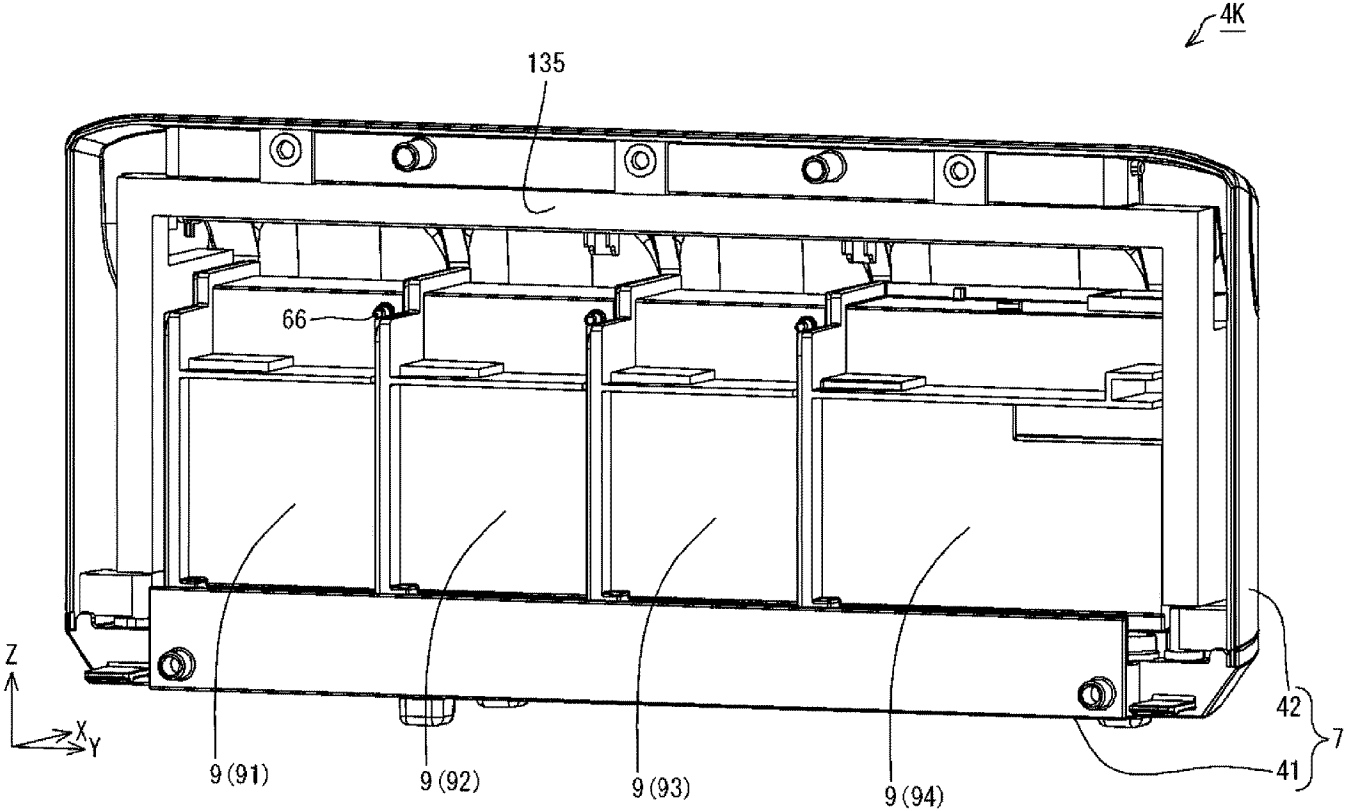
FIG. 32 is a perspective view showing a main configuration of an ink supply device in Example 17.

In Example 16 that is described above, it is possible to form the liquid absorbent material 121, the liquid absorbent material 131 and the liquid absorbent material 132 integrally with one another. A configuration in which the liquid absorbent material 121, the liquid absorbent material 131 and the liquid absorbent material 132 are formed integrally with one another is indicated as an ink supply device 4K of Example 17. The ink supply device 4K has a liquid absorbent material 135 as shown in FIG. 32. The liquid absorbent material 135 has a configuration in which the liquid absorbent material 121, the liquid absorbent material 131 and the liquid absorbent material 132 that are shown in FIG. 31 are formed integrally with one another. In Example 17 as well, the same effect as Example 16 is obtained. Furthermore, in Example 17, the number of parts can be reduced, and thus the cost can be reduced.

Note that an example that is applicable to the ink supply device 4A provided with the casing 7 is shown in each of Example 9 to Example 17 that are described above. However, each of Example 9 to Example 17 is also applicable to the liquid jet system 1 shown in FIG. 3. In the case where each of Example 9 to Example 17 is applied to the liquid jet system 1 shown in FIG. 3, a skilled person in the art can apply the configuration regarding the casing 7 to the casing 6 with appropriate changes and modifications. Moreover, in FIG. 3, the liquid absorbent material 121 is positioned at least at the height of the open air port 66. In FIG. 3, in the liquid jet system 1, the tanks 9 may be positioned in the range of the movement of the carriage 33 in the X axis direction, and may be arranged on the Y axis direction side relative to the range of the moving of the carriage 33 in the +Y axis direction, that is, the front surface side of the casing 6. Within a tank mounting portion 136 in which the tanks 9 are arranged or mounted, the position of the liquid absorbent material 121 may be determined by the positioning method as shown in FIG. 24 or FIG. 25, for example. Note that the tanks 9 may be formed integrally.

EXAMPLE 18

Figure 33:
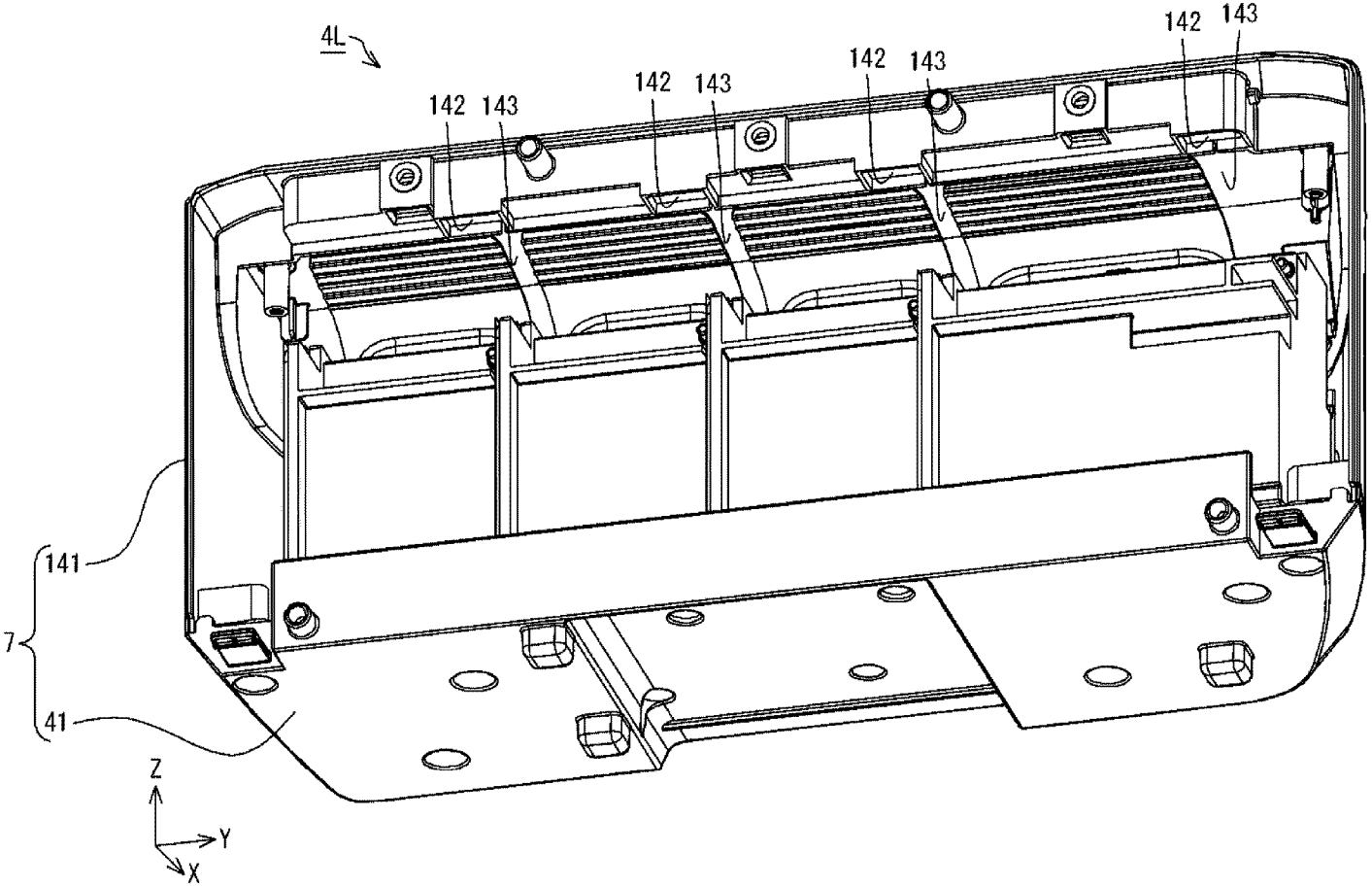
FIG. 33 is a perspective view showing a main configuration of an ink supply device in Example 18.

An ink supply device 4L of Example 18 has a second casing 141 as shown in FIG. 33. In the ink supply device 4L of Example 18, the second casing 42 of the ink supply device 4A (FIG. 4) is replaced by the second casing 141. Except for that point, the ink supply device 4L of Example 18 has the same configuration as the ink supply device 4A. Therefore, in the following description, the same reference signs as the ink supply device 4A are given to the same constituent elements as the ink supply device 4A, and detailed description thereof is omitted.

The second casing 141 is provided with liquid holding portions 142 and guiding paths 143. In this example, a plurality of liquid holding portions 142 and a plurality of guiding paths 143 are provided. In addition, in this example, the liquid holding portions 142 and the guiding paths 143 are provided in accordance with the number of the tanks 9. Specifically, in this example, four liquid holding portions 142 and four guiding paths 143 are provided based on four tanks 9.

The liquid holding portions 142 and the guiding paths 143 are each provided inside the second casing 141, specifically, in a portion of the second casing 141 that faces the tank 9 side. The liquid holding portions 142 are positioned in a location in the second casing 141 that the tanks 9 face vertically upward, that is, a location in the second casing 141 that the tanks 9 face in the Z axis direction. Therefore, as shown in FIG. 34, in the inverted orientation of the ink supply device 4L, the liquid holding portions 142 are positioned vertically below the tanks 9.

Figure 34:
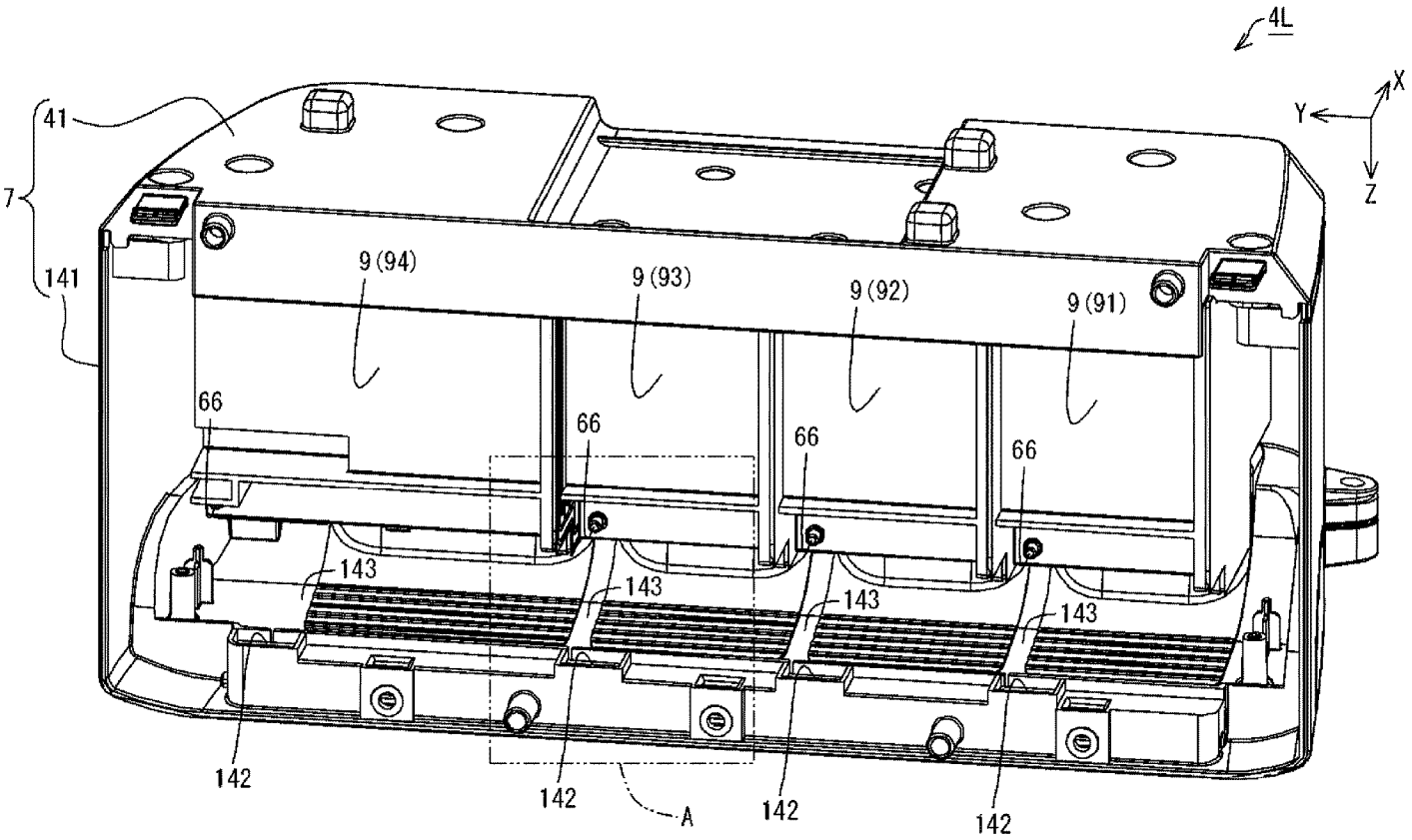
FIG. 34 is a perspective view showing the main configuration of the ink supply device in Example 18.
Figure 35:
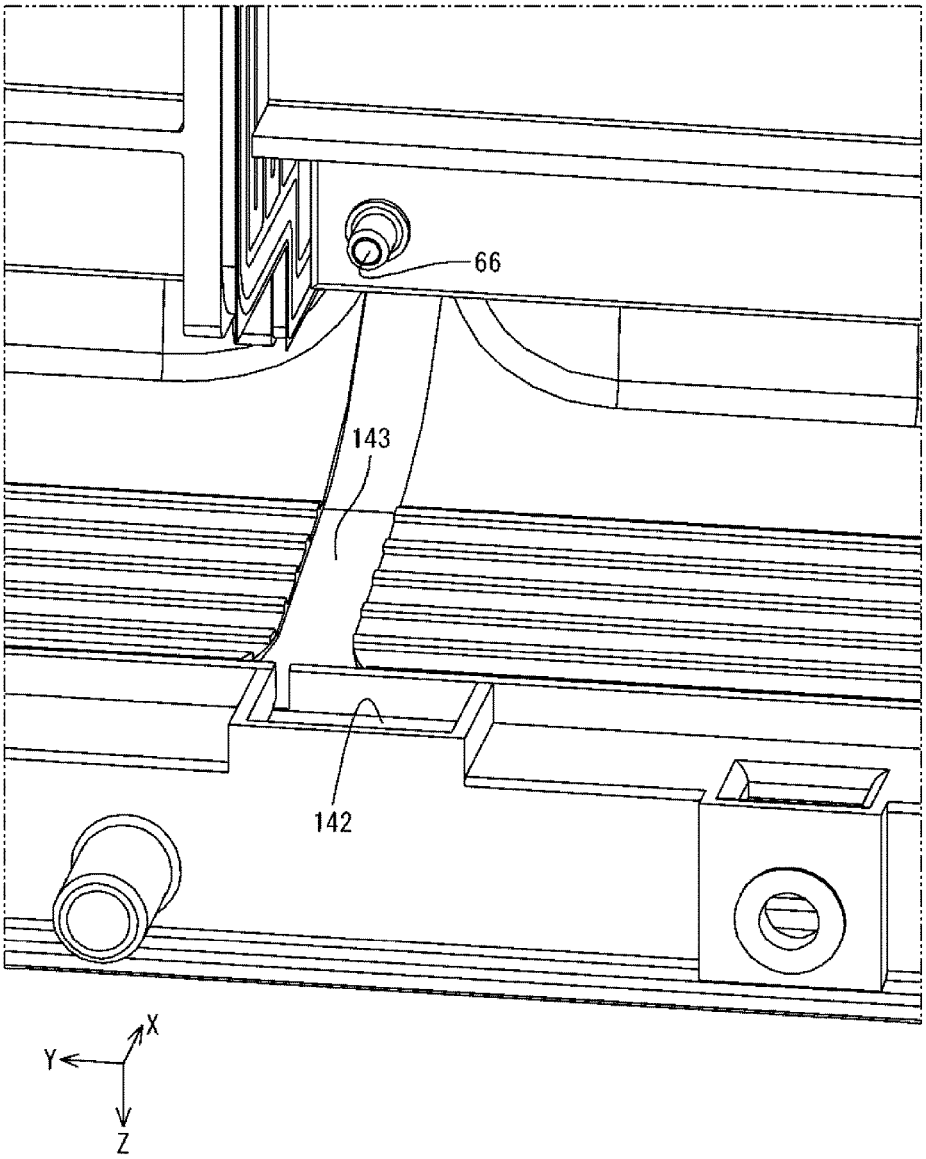
FIG. 35 is an enlarged diagram of a portion A in FIG. 34.

As shown in FIG. 35, which is an enlarged diagram of Portion A in FIG. 34, the liquid holding portions 142 are each constituted as a recessed portion formed on the second casing 141. The recessed portion formed as the liquid holding portion 142 is formed in a direction so as to become recessed in the Z axis direction. When ink is stored in the liquid holding portion 142 constituted as the recessed portion, the ink is easily kept by the liquid holding portion 142. Accordingly, in the inverted orientation, even if the ink leaks out from the open air port 66 of the tank 9, the leaked ink is easily kept by the liquid holding portions 142. As a result, in the inverted orientation, even if the ink leaks out from the open air port 66, the possibility of soiling caused by the ink leakage can be suppressed to a low level. Note that the liquid holding portions 142 are not limited to a recessed portion, and a groove formed on the second casing 141 can also be adopted.

The guiding paths 143 are each constituted as a groove formed on the second casing 141. The groove formed as the guiding path 143 is formed in a direction so as to become recessed in the Z axis direction. The guiding path 143 constituted as the groove leads to the liquid holding portion 142 constituted as the recessed portion. Therefore, in the inverted orientation, even if ink leaks out from the open air port 66 of the tanks 9, the leaked ink is easily guided to the liquid holding portions 142 by the guiding paths 143. Accordingly, in the inverted orientation, even if the ink leaks out from the open air port 66 of the tanks 9, the leaked ink is easily kept by the liquid holding portions 142. As a result, in the inverted orientation, even if the ink leaks out from the open air port 66, the possibility of soiling caused by the ink leakage can be further suppressed to a low level.

EXAMPLE 19

Figure 36:
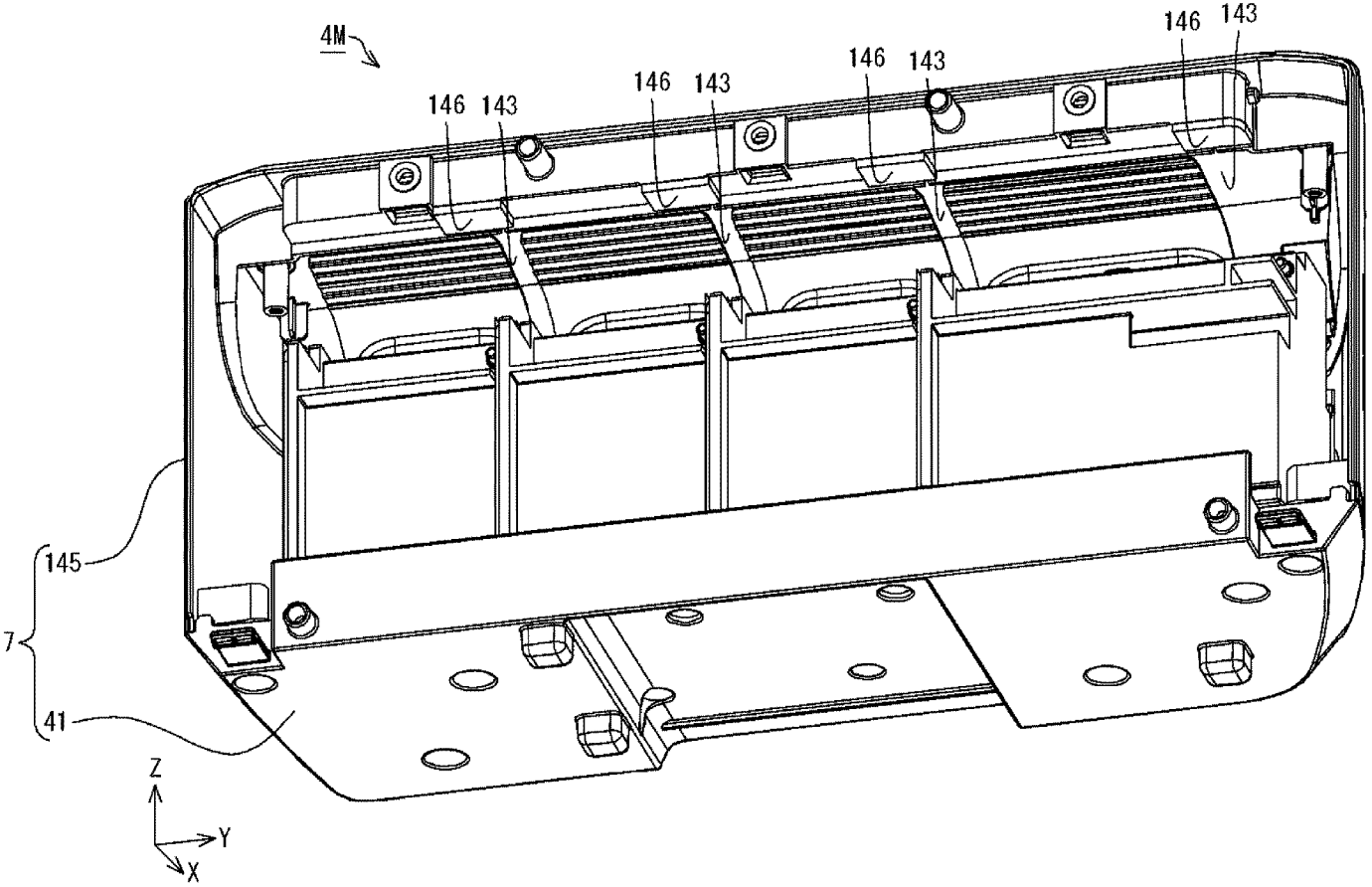
FIG. 36 is a perspective view showing a main configuration of an ink supply device in Example 19.

An ink supply device 4M of Example 19 has a second casing 145 as shown in FIG. 36. In the ink supply device 4M of Example 19, the second casing 141 of the ink supply device 4L of Example 18 (FIG. 33) is replaced by the second casing 145. Except for that point, the ink supply device 4M of Example 19 has the same configuration as the ink supply device 4L of Example 18. Therefore, in the following description, the same reference signs as Example 18 are given to the same constituent elements as Example 18, and detailed description thereof is omitted.

The second casing 145 is provided with liquid holding portions 146. In the second casing 145 of Example 19, the liquid holding portions 142 of Example 18 (FIG. 33) are replaced by the liquid holding portions 146. In other words, in the second casing 145 of Example 19, the recessed portions constituting the liquid holding portions 142 of Example 18 are omitted, and the liquid holding portions 146 are provided. Except for that point, the second casing 145 of Example 19 has the same configuration as the second casing 141 of Example 18. Therefore, in the following description, the same reference signs as Example 18 are given to the same constituent elements as Example 18, and detailed description thereof is omitted.

In Example 19, the liquid holding portions 146 are each constituted by a liquid absorbent material. The liquid holding portion 146 constituted by the liquid absorbent material has a property of absorbing liquid and holding the absorbed liquid. As the material of the liquid holding portion 146, various materials such as foam, felt and a nonwoven fabric can be adopted. The liquid holding portion 146 constituted by the liquid absorbent material can hold ink. Accordingly, in the inverted orientation, if ink leaks out from the open air port 66 of the tanks 9, the leaked ink is easily kept by the liquid holding portions 146. As a result, similarly to Example 18, in the inverted orientation, even if the ink leaks out from the open air port 66, the possibility of soiling caused by the ink leakage can be suppressed to a low level.

Moreover, in Example 19 as well, similarly to Example 18, the guiding paths 143 each constituted as a groove lead to the liquid holding portions 146 each constituted by the liquid absorbent material. Therefore, in the inverted orientation, even if ink leaks out from the open air port 66 of the tanks 9, the leaked ink is easily guided to the liquid holding portions 146 by the guiding paths 143. Accordingly, in the inverted orientation, even if the ink leaks out from the open air port 66 of the tanks 9, the leaked ink is easily kept by the liquid holding portions 146. As a result, in the inverted orientation, even if the ink leaks out from the open air port 66, the possibility of soiling caused by the ink leakage can be further suppressed to a low level.

EXAMPLE 20

Figure 37:
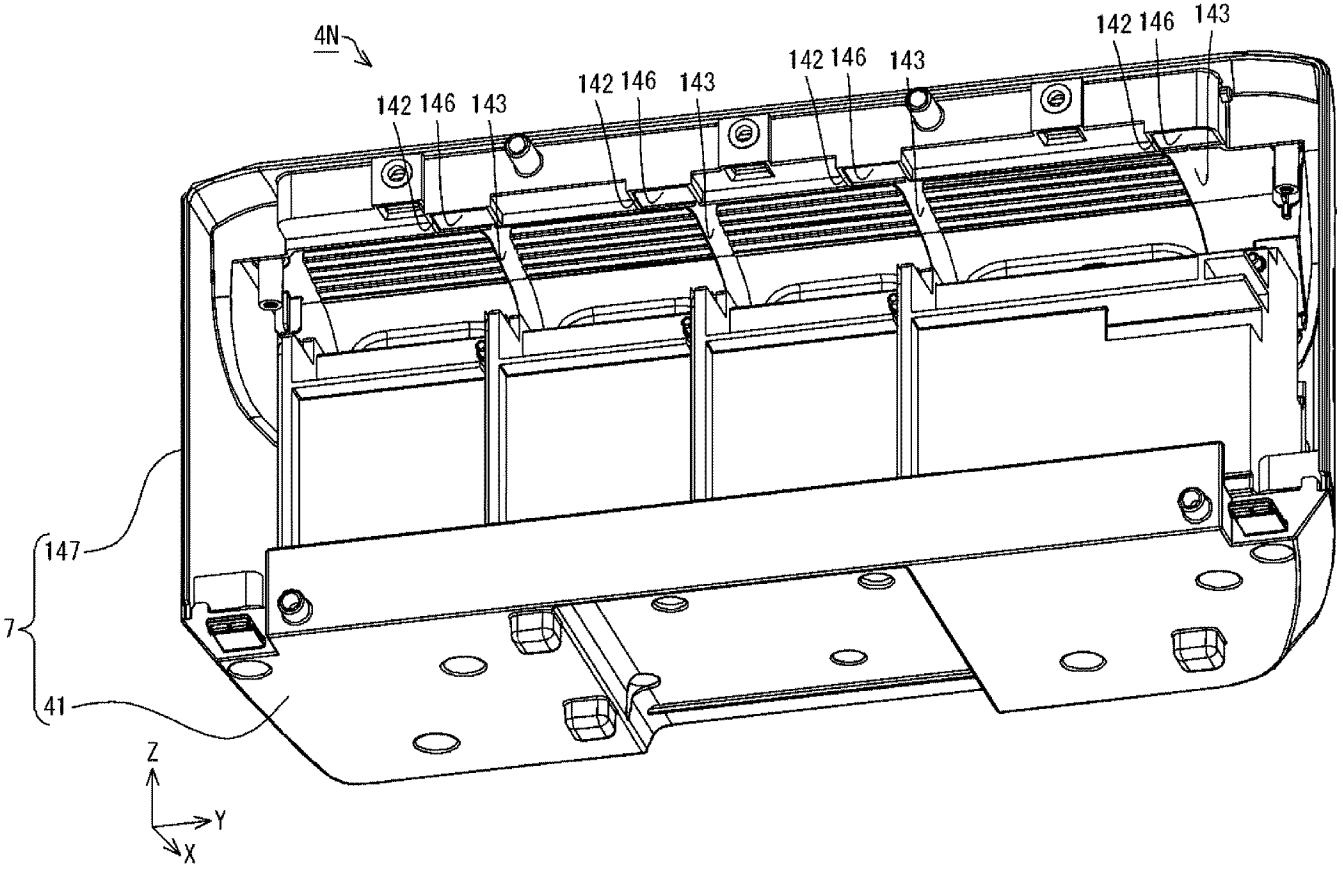
FIG. 37 is a perspective view showing a main configuration of an ink supply device in Example 20.

An ink supply device 4N of Example 20 has a second casing 147 as shown in FIG. 37. In the ink supply device 4N of Example 20, the second casing 141 of the ink supply device 4L of Example 18 (FIG. 33) is replaced by the second casing 147. Except for that point, the ink supply device 4N of Example 20 has the same configuration as the ink supply device 4L of Example 18. Therefore, in the following description, the same reference signs as Example 18 are given to the same constituent elements as Example 18, and detailed description thereof is omitted.

The second casing 147 in Example 20 has a configuration in which the liquid holding portions 146 of the second casing 145 in Example 19 are added to the liquid holding portions 142 of the second casing 141 in Example 18. In other words, the second casing 147 in Example 20 has a configuration in which the second casing 141 in Example 18 and the second casing 145 in Example 19 are composited. Therefore, the detailed description of the second casing 147 in Example 20 is omitted.

In Example 20, the liquid holding portions 146 each constituted by a liquid absorbent material are added to the liquid holding portions 142 each constituted as a recessed portion, and thus ink is further easily kept by the liquid holding portions 142 and the liquid holding portions 146. Accordingly, in the inverted orientation, even if the ink leaks out from the open air port 66, the possibility of soiling caused by the ink leakage can be further suppressed to a low level.

In addition, in Example 20 as well, similarly to Example 18 and Example 19, the guiding paths 143 each constituted as the groove lead to the liquid holding portions 142 and the liquid holding portions 146. Therefore, in the inverted orientation, even if ink leaks out from the open air port 66 of the tanks 9, the leaked ink is easily guided to the liquid holding portions 142 and the liquid holding portions 146 by the guiding paths 143. Accordingly, in the inverted orientation, even if the ink leaks out from the open air port 66 of the tanks 9, the leaked ink is easily kept by the liquid holding portions 142 and the liquid holding portions 146. As a result, in the inverted orientation, even if the ink leaks out from the open air port 66, the possibility of soiling caused by the ink leakage can be further suppressed to a low level.

In the above embodiment, the liquid jet device may be a liquid jet device that consumes liquid other than ink by jetting, ejecting, or applying the liquid as a coating. Note that examples of the state of liquid that is ejected as minuscule droplets from the liquid jet device include a spherical shape, a tear shape, and a shape having a thread-like trailing end. Furthermore, the liquid in this case may be any material that can be consumed in the liquid jet device. For example, the liquid may be any material that is in a liquid phase, and examples thereof include materials in a liquid state having high or low viscosity, sol, gel water, and other materials that flow, such as inorganic solvent, organic solvent, solution, liquid resin, liquid metal (metallic melt), and the like. Furthermore, the examples include not only liquid, as one state of materials, but also materials in which solvent contains dissolved, dispersed, or mixed particles of functional material made of a solid, such as pigments or metal particles. Typical examples of the liquid include liquid crystal and the like other than ink as described in the above embodiments. Here, it is assumed that examples of the ink include various liquid state compositions such as commonly used water-based ink, oil-based ink, gel ink, and hot melt ink. Specific examples of the liquid jet device include liquid jet devices that eject liquid containing dispersed or dissolved materials such as electrode materials or coloring material used for producing liquid crystal displays, electro luminescence (EL) displays, field emission displays, color filters, and the like. The examples may further include liquid jet devices that eject bioorganic materials used to manufacture biochips, liquid jet devices that are used as precision pipettes and eject sample liquid, textile printing apparatus, micro-dispensers, and the like. The examples may further include liquid jet devices that eject lubricating oil for pinpoint application onto precision machines such as watches or cameras, liquid jet devices that eject transparent resin liquid such as ultraviolet curing resin onto a substrate in order to form minute hemispherical lenses (optical lenses) used for optical communications devices or the like. The examples may further include liquid jet devices that eject acidic or alkaline etching liquid in order to perform etching on a substrate or the like The invention is not limited to the above-described embodiments, and can be achieved in various configurations without departing from the gist of the invention. For example, the technical features in the embodiments corresponding to the technical features in the aspects described in Summary can be replaced or combined as appropriate in order to solve some or all of the problems described above, or in order to achieve some or all of the aforementioned effects. Technical features that are not described as essential in the specification can be deleted as appropriate.

What is claimed is:

1. A liquid container comprising:

a liquid containing portion configured to contain a liquid;

a liquid inlet portion configured to receive injection of the liquid into the liquid containing portion;

an open air port that communicates with the liquid containing portion and introducing atmospheric air into the liquid containing portion; and a liquid absorbent material that is arranged at least in a portion of a periphery of the open air port, wherein the liquid absorbent material defines a through-hole, wherein the open air port is positioned inside of the through-hole of the liquid absorbent material.

2. The liquid container according to claim 1, wherein the liquid absorbent material covers the open air port, and wherein the liquid absorbent material defines an opening portion that extends completely through the liquid absorbent material and that is open to atmospheric air such that the liquid absorbent material only surrounds a portion of the periphery of the open air port.

3. The liquid container according to claim 2, wherein assuming that an orientation when the liquid container is being used is a use orientation of the liquid container, the opening portion is positioned vertically below the open air port in the use orientation.

4. The liquid container according to claim 1, wherein the liquid absorbent material includes a first portion positioned in a periphery of the open air port and a second portion facing the open air port, wherein the first portion defines the through-hole, wherein the first portion and the second portion are joined together such that the second portion covers the through-hole.

5. The liquid container according to claim 4, wherein the first portion is separated from the second portion.

6. The liquid container according to claim 1, comprising:

a positioning member for determining a position of the liquid absorbent material.

7. The liquid container according to claim 6, comprising:

an absorbent material housing part housing the liquid absorbent material, wherein the positioning member is positioned on the opposite side of the liquid containing portion from the liquid absorbent material.

8. The liquid container of claim 1, wherein the liquid absorbent material has a substantially annular shape.

9. The liquid container of claim 1, wherein the liquid absorbent material is positioned outside of the liquid containing portion.

10. The liquid container of claim 1, wherein the liquid inlet portion is provided at a position different from the open air port.

* * * * *